US010775084B2

(12) United States Patent
Pham

(10) Patent No.: US 10,775,084 B2
(45) Date of Patent: Sep. 15, 2020

(54) SYSTEM FOR REFRIGERANT CHARGE VERIFICATION

(71) Applicant: Emerson Climate Technologies, Inc., Sidney, OH (US)

(72) Inventor: Hung M. Pham, Dayton, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 207 days.

(21) Appl. No.: 15/798,081

(22) Filed: Oct. 30, 2017

(65) Prior Publication Data

US 2018/0045445 A1 Feb. 15, 2018

Related U.S. Application Data

(63) Continuation of application No. 14/193,568, filed on Feb. 28, 2014, now Pat. No. 9,803,902.
(Continued)

(51) Int. Cl.
*F25B 45/00* (2006.01)
*F25B 40/02* (2006.01)

(52) U.S. Cl.
CPC ..... *F25B 45/00* (2013.01); *F25B 40/02* (2013.01); *F25B 2345/003* (2013.01);
(Continued)

(58) Field of Classification Search
CPC ..... F25B 2345/003; F25B 45/00; F25B 2700/21162; F25B 2700/21163; F25B 2500/222; F25B 2700/04; F25B 2600/19
See application file for complete search history.

(56) References Cited

U.S. PATENT DOCUMENTS 2,054,542 A 9/1936 Hoelle
2,296,822 A 9/1942 Wolfert
(Continued)

FOREIGN PATENT DOCUMENTS

CA 1147440 A1 5/1983
CA 1151265 A1 8/1983
(Continued)

OTHER PUBLICATIONS

Office Action regarding Chinese Patent Application No. 201480025776.7, dated Jan. 10, 2018. Translation provided by Unitalen Attorneys At Law.
(Continued)

*Primary Examiner* — David J Teitelbaum
(74) *Attorney, Agent, or Firm* — Harness, Dickey & Pierce, P.L.C.

(57) ABSTRACT

A charge-verification tool is used with a charge-verification system to diagnose and remedy a charge condition. The charge-verification tool includes a device having a controller configured to communicate with a system controller in the charge-verification system and a display configured to display measurements and instructions to an installer. The device is a user interface and is configured to provide communication between the installer and the system controller in the charge-verification system. The controller prompts the installer to input charge-verification system information including refrigeration line length and diameter. The controller receives a subcooling temperature calculated by the system controller and determines whether the subcooling temperature is between a threshold and a target subcooling temperature. The controller displays an amount of charge to add to the charge-verification system based on whether the subcooling temperature is between the threshold and the target subcooling temperature.

20 Claims, 7 Drawing Sheets

Related U.S. Application Data

(60) Provisional application No. 61/789,913, filed on Mar. 15, 2013.

(52) U.S. Cl.
CPC ..... *F25B 2600/19* (2013.01); *F25B 2700/04* (2013.01); *F25B 2700/21162* (2013.01); *F25B 2700/21163* (2013.01)

(56) References Cited

U.S. PATENT DOCUMENTS 2,631,050 A 3/1953 Haeberlein
2,804,839 A 9/1957 Hallinan
2,961,606 A 11/1960 Mead
2,962,702 A 11/1960 Derr et al.
2,978,879 A 4/1961 Heidorn
3,027,865 A 4/1962 Kautz et al.
3,047,696 A 7/1962 Heidorn
3,082,951 A 3/1963 Kayan
3,107,843 A 10/1963 Finn
3,170,304 A 2/1965 Hale
3,232,519 A 2/1966 Long
3,278,111 A 10/1966 Parker
3,327,197 A 6/1967 Marquis
3,339,164 A 8/1967 Landis et al.
3,400,374 A 9/1968 Schumann
3,513,662 A 5/1970 Golber
3,581,281 A 5/1971 Martin et al.
3,585,451 A 6/1971 Day, III
3,653,783 A 4/1972 Sauder
3,660,718 A 5/1972 Pinckaers
3,665,339 A 5/1972 Liu
3,665,399 A 5/1972 Zehr et al.
3,680,324 A 8/1972 Garland
3,697,953 A 10/1972 Schoenwitz
3,707,851 A 1/1973 McAshan, Jr.
3,729,949 A 5/1973 Talbot
3,735,377 A 5/1973 Kaufman
3,742,302 A 6/1973 Neill
3,742,303 A 6/1973 Dageford
3,767,328 A 10/1973 Ladusaw
3,777,240 A 12/1973 Neill
3,783,681 A 1/1974 Hirt et al.
3,820,074 A 6/1974 Toman
3,882,305 A 5/1975 Johnstone
3,924,972 A 12/1975 Szymaszek
3,927,712 A 12/1975 Nakayama
3,935,519 A 1/1976 Pfarrer et al.
3,950,962 A 4/1976 Odashima
3,960,011 A 6/1976 Renz et al.
3,978,382 A 8/1976 Pfarrer et al.
3,998,068 A 12/1976 Chirnside
4,006,460 A 2/1977 Hewitt et al.
4,014,182 A 3/1977 Granryd
4,018,584 A 4/1977 Mullen
4,019,172 A 4/1977 Srodes
4,024,725 A 5/1977 Uchida et al.
4,027,289 A 5/1977 Toman
4,034,570 A 7/1977 Anderson et al.
4,038,061 A 7/1977 Anderson et al.
4,045,973 A 9/1977 Anderson et al.
4,046,532 A 9/1977 Nelson
RE29,450 E 10/1977 Goldsby et al.
4,060,716 A 11/1977 Pekrul et al.
4,066,869 A 1/1978 Apaloo et al.
4,090,248 A 5/1978 Swanson et al.
4,102,150 A 7/1978 Kountz
4,102,394 A 7/1978 Botts
4,104,888 A 8/1978 Reedy et al.
4,105,063 A 8/1978 Bergt
4,112,703 A 9/1978 Kountz
4,132,086 A 1/1979 Kountz
4,136,730 A 1/1979 Kinsey
4,137,057 A 1/1979 Piet et al.
4,137,725 A 2/1979 Martin
4,142,375 A 3/1979 Abe et al.
4,143,707 A 3/1979 Lewis et al.
4,146,085 A 3/1979 Wills
RE29,966 E 4/1979 Nussbaum
4,151,725 A 5/1979 Kountz et al.
4,153,003 A 5/1979 Willis
4,156,350 A 5/1979 Elliott et al.
4,161,106 A 7/1979 Savage et al.
4,165,619 A 8/1979 Girard
4,171,622 A 10/1979 Yamaguchi et al.
4,173,871 A 11/1979 Brooks
4,178,988 A 12/1979 Cann et al.
RE30,242 E 4/1980 del Toro et al.
4,197,717 A 4/1980 Schumacher
4,205,381 A 5/1980 Games et al.
4,209,994 A 7/1980 Mueller et al.
4,211,089 A 7/1980 Mueller et al.
4,217,761 A 8/1980 Cornaire et al.
4,220,010 A 9/1980 Mueller et al.
4,227,862 A 10/1980 Andrew et al.
4,232,530 A 11/1980 Mueller
4,233,818 A 11/1980 Lastinger
4,236,379 A 12/1980 Mueller
4,244,182 A 1/1981 Behr
4,246,763 A 1/1981 Mueller et al.
4,248,051 A 2/1981 Darcy et al.
4,251,988 A 2/1981 Allard et al.
4,257,795 A 3/1981 Shaw
4,259,847 A 4/1981 Pearse, Jr.
4,267,702 A 5/1981 Houk
4,270,174 A 5/1981 Karlin et al.
4,271,898 A 6/1981 Freeman
4,281,358 A 7/1981 Plouffe et al.
4,284,849 A 8/1981 Anderson et al.
4,286,438 A 9/1981 Clarke
4,290,480 A 9/1981 Sulkowski
4,296,727 A 10/1981 Bryan
4,301,660 A 11/1981 Mueller et al.
4,306,293 A 12/1981 Marathe
4,307,775 A 12/1981 Saunders et al.
4,308,725 A 1/1982 Chiyoda
4,311,188 A 1/1982 Kojima et al.
4,319,461 A 3/1982 Shaw
4,321,529 A 3/1982 Simmonds et al.
4,325,223 A 4/1982 Cantley
4,328,678 A 5/1982 Kono et al.
4,328,680 A 5/1982 Stamp, Jr. et al.
4,333,316 A 6/1982 Stamp, Jr. et al.
4,333,317 A 6/1982 Sawyer
4,336,001 A 6/1982 Andrew et al.
4,338,790 A 7/1982 Saunders et al.
4,338,791 A 7/1982 Stamp, Jr. et al.
4,345,162 A 8/1982 Hammer et al.
4,346,755 A 8/1982 Alley et al.
4,350,021 A 9/1982 Lundstrom
4,350,023 A 9/1982 Kuwabara et al.
4,351,163 A 9/1982 Johannsen
4,356,703 A 11/1982 Vogel
4,361,273 A 11/1982 Levine et al.
4,365,983 A 12/1982 Abraham et al.
4,370,098 A 1/1983 McClain et al.
4,372,119 A 2/1983 Gillbrand et al.
4,376,926 A 3/1983 Senor
4,381,549 A 4/1983 Stamp, Jr. et al.
4,382,367 A 5/1983 Roberts
4,384,462 A 5/1983 Overman et al.
4,387,368 A 6/1983 Day, III et al.
4,387,578 A 6/1983 Paddock
4,390,058 A 6/1983 Otake et al.
4,390,321 A 6/1983 Langlois et al.
4,390,922 A 6/1983 Pelliccia
4,395,886 A 8/1983 Mayer
4,395,887 A 8/1983 Sweetman
4,399,548 A 8/1983 Castleberry
4,402,054 A 8/1983 Osborne et al.
4,406,133 A 9/1983 Saunders et al.
4,407,138 A 10/1983 Mueller
4,408,660 A 10/1983 Sutoh et al.

(56) References Cited

U.S. PATENT DOCUMENTS 4,412,788 A 11/1983 Shaw et al.
4,415,896 A 11/1983 Allgood
4,418,388 A 11/1983 Allgor et al.
4,420,947 A 12/1983 Yoshino
4,425,010 A 1/1984 Bryant et al.
4,429,578 A 2/1984 Darrel et al.
4,432,232 A 2/1984 Brantley et al.
4,434,390 A 2/1984 Elms
4,441,329 A 4/1984 Dawley
4,448,038 A 5/1984 Barbier
4,449,375 A 5/1984 Briccetti
4,451,929 A 5/1984 Yoshida
4,460,123 A 7/1984 Beverly
4,463,571 A 8/1984 Wiggs
4,463,574 A 8/1984 Spethmann et al.
4,463,576 A 8/1984 Burnett et al.
4,465,229 A 8/1984 Kompelien
4,467,230 A 8/1984 Rovinsky
4,467,385 A 8/1984 Bandoli et al.
4,467,613 A 8/1984 Behr et al.
4,470,092 A 9/1984 Lombardi
4,470,266 A 9/1984 Briccetti et al.
4,474,024 A 10/1984 Eplett et al.
4,474,542 A 10/1984 Kato et al.
4,479,389 A 10/1984 Anderson, III et al.
4,484,452 A * 11/1984 Houser, Jr. ..... F25B 13/00 62/149
4,489,551 A 12/1984 Watanabe et al.
4,490,986 A 1/1985 Paddock
4,494,383 A 1/1985 Nagatomo et al.
4,495,779 A 1/1985 Tanaka et al.
4,496,296 A 1/1985 Arai et al.
4,497,031 A 1/1985 Froehling et al.
4,498,310 A 2/1985 Imanishi et al.
4,499,739 A 2/1985 Matsuoka et al.
4,502,084 A 2/1985 Hannett
4,502,833 A 3/1985 Hibino et al.
4,502,842 A 3/1985 Currier et al.
4,502,843 A 3/1985 Martin
4,505,125 A 3/1985 Baglione
4,506,518 A 3/1985 Yoshikawa et al.
4,507,934 A 4/1985 Tanaka et al.
4,510,547 A 4/1985 Rudich, Jr.
4,510,576 A 4/1985 MacArthur et al.
4,512,161 A 4/1985 Logan et al.
4,516,407 A 5/1985 Watabe
4,517,468 A 5/1985 Kemper et al.
4,520,674 A 6/1985 Canada et al.
4,523,435 A 6/1985 Lord
4,523,436 A 6/1985 Schedel et al.
4,527,247 A 7/1985 Kaiser et al.
4,527,399 A 7/1985 Lord
4,535,607 A 8/1985 Mount
4,538,420 A 9/1985 Nelson
4,538,422 A 9/1985 Mount et al.
4,539,820 A 9/1985 Zinsmeyer
4,540,040 A 9/1985 Fukumoto et al.
4,545,210 A 10/1985 Lord
4,545,214 A 10/1985 Kinoshita
4,548,549 A 10/1985 Murphy et al.
4,549,403 A 10/1985 Lord et al.
4,549,404 A 10/1985 Lord
4,550,770 A 11/1985 Nussdorfer et al.
4,553,400 A 11/1985 Branz
4,555,057 A 11/1985 Foster
4,555,910 A 12/1985 Sturges
4,557,317 A 12/1985 Harmon, Jr.
4,558,181 A 12/1985 Blanchard et al.
4,561,260 A 12/1985 Nishi et al.
4,563,624 A 1/1986 Yu
4,563,877 A 1/1986 Harnish
4,563,878 A 1/1986 Baglione
4,567,733 A 2/1986 Mecozzi
4,568,909 A 2/1986 Whynacht
4,574,871 A 3/1986 Parkinson et al.
4,575,318 A 3/1986 Blain
4,577,977 A 3/1986 Pejsa
4,580,947 A 4/1986 Shibata et al.
4,583,373 A 4/1986 Shaw
4,589,060 A 5/1986 Zinsmeyer
4,593,367 A 6/1986 Slack et al.
4,598,764 A 7/1986 Beckey
4,602,484 A 7/1986 Bendikson
4,603,556 A 8/1986 Suefuji et al.
4,604,036 A 8/1986 Sutou et al.
4,611,470 A 9/1986 Enstrom
4,612,775 A 9/1986 Branz et al.
4,614,089 A 9/1986 Dorsey
4,617,804 A 10/1986 Fukushima et al.
4,620,286 A 10/1986 Smith et al.
4,620,424 A 11/1986 Tanaka et al.
4,621,502 A 11/1986 Ibrahim et al.
4,626,753 A 12/1986 Letterman
4,627,245 A 12/1986 Levine
4,627,483 A 12/1986 Harshbarger, III et al.
4,627,484 A 12/1986 Harshbarger, Jr. et al.
4,630,572 A 12/1986 Evans
4,630,670 A 12/1986 Wellman et al.
4,642,034 A 2/1987 Terauchi
4,642,782 A 2/1987 Kemper et al.
4,644,479 A 2/1987 Kemper et al.
4,646,532 A 3/1987 Nose
4,648,044 A 3/1987 Hardy et al.
4,649,515 A 3/1987 Thompson et al.
4,649,710 A 3/1987 Inoue et al.
4,653,280 A 3/1987 Hansen et al.
4,653,285 A 3/1987 Pohl
4,655,688 A 4/1987 Bohn et al.
4,660,386 A 4/1987 Hansen et al.
4,662,184 A 5/1987 Pohl et al.
4,674,292 A 6/1987 Ohya et al.
4,677,830 A 7/1987 Sumikawa et al.
4,680,940 A 7/1987 Vaughn
4,682,473 A 7/1987 Rogers, III
4,684,060 A 8/1987 Adams et al.
4,685,615 A 8/1987 Hart
4,686,835 A 8/1987 Alsenz
4,689,967 A 9/1987 Han et al.
4,697,431 A 10/1987 Alsenz
4,698,978 A 10/1987 Jones
4,698,981 A 10/1987 Kaneko et al.
4,701,824 A 10/1987 Beggs et al.
4,703,325 A 10/1987 Chamberlin et al.
4,706,152 A 11/1987 DeFilippis et al.
4,706,469 A 11/1987 Oguni et al.
4,712,648 A 12/1987 Mattes et al.
4,713,717 A 12/1987 Pejouhy et al.
4,715,190 A 12/1987 Han et al.
4,715,792 A 12/1987 Nishizawa et al.
4,716,582 A 12/1987 Blanchard et al.
4,716,957 A 1/1988 Thompson et al.
4,720,980 A 1/1988 Howland
4,722,018 A 1/1988 Pohl
4,722,019 A 1/1988 Pohl
4,724,678 A 2/1988 Pohl
4,735,054 A 4/1988 Beckey
4,735,060 A 4/1988 Alsenz
4,744,223 A 5/1988 Umezu
4,745,765 A 5/1988 Pettitt
4,745,766 A 5/1988 Bahr
4,745,767 A 5/1988 Ohya et al.
4,750,332 A 6/1988 Jenski et al.
4,750,672 A 6/1988 Beckey et al.
4,751,501 A 6/1988 Gut
4,751,825 A 6/1988 Voorhis et al.
4,754,410 A 6/1988 Leech et al.
4,755,957 A 7/1988 White et al.
4,765,150 A 8/1988 Persem
4,768,346 A 9/1988 Mathur
4,768,348 A 9/1988 Noguchi
4,783,752 A 11/1988 Kaplan et al.
4,787,213 A 11/1988 Gras et al.
4,790,142 A 12/1988 Beckey
4,796,142 A 1/1989 Libert

(56) References Cited

U.S. PATENT DOCUMENTS 4,796,466 A 1/1989 Farmer
4,798,055 A 1/1989 Murray et al.
4,805,118 A 2/1989 Rishel
4,807,445 A 2/1989 Matsuoka et al.
4,820,130 A 4/1989 Eber et al.
4,829,779 A 5/1989 Munson et al.
4,831,560 A 5/1989 Zaleski
4,831,832 A 5/1989 Alsenz
4,831,833 A 5/1989 Duenes et al.
4,835,706 A 5/1989 Asahi
4,835,980 A 6/1989 Oyanagi et al.
4,838,037 A 6/1989 Wood
4,841,734 A 6/1989 Torrence
4,843,575 A 6/1989 Crane
4,845,956 A 7/1989 Berntsen et al.
4,848,099 A 7/1989 Beckey et al.
4,848,100 A 7/1989 Barthel et al.
4,850,198 A 7/1989 Helt et al.
4,850,204 A 7/1989 Bos et al.
4,852,363 A 8/1989 Kampf et al.
4,853,693 A 8/1989 Eaton-Williams
4,856,286 A 8/1989 Sulfstede et al.
4,858,676 A 8/1989 Bolfik et al.
4,866,635 A 9/1989 Kahn et al.
4,866,944 A 9/1989 Yamazaki
4,869,073 A 9/1989 Kawai et al.
4,873,836 A 10/1989 Thompson
4,875,589 A 10/1989 Lacey et al.
4,877,382 A 10/1989 Caillat et al.
4,878,355 A 11/1989 Beckey et al.
4,881,184 A 11/1989 Abegg, III et al.
4,882,747 A 11/1989 Williams
4,882,908 A 11/1989 White
4,884,412 A 12/1989 Sellers et al.
4,885,707 A 12/1989 Nichol et al.
4,885,914 A 12/1989 Pearman
4,887,436 A 12/1989 Enomoto et al.
4,887,857 A 12/1989 VanOmmeren
4,889,280 A 12/1989 Grald et al.
4,893,480 A 1/1990 Matsui et al.
4,899,551 A 2/1990 Weintraub
4,903,500 A 2/1990 Hanson
4,903,759 A 2/1990 Lapeyrouse
4,904,993 A 2/1990 Sato
4,909,041 A 3/1990 Jones
4,909,076 A 3/1990 Busch et al.
4,910,966 A 3/1990 Levine et al.
4,913,625 A 4/1990 Gerlowski
4,916,633 A 4/1990 Tychonievich et al.
4,916,909 A 4/1990 Mathur et al.
4,916,912 A 4/1990 Levine et al.
4,918,690 A 4/1990 Markkula, Jr. et al.
4,918,932 A 4/1990 Gustafson et al.
4,924,404 A 5/1990 Reinke, Jr.
4,924,418 A 5/1990 Bachman et al.
4,928,750 A 5/1990 Nurczyk
4,932,588 A 6/1990 Fedter et al.
4,939,909 A 7/1990 Tsuchiyama et al.
4,943,003 A 7/1990 Shimizu et al.
4,944,160 A 7/1990 Malone et al.
4,945,491 A 7/1990 Rishel
4,948,040 A 8/1990 Kobayashi et al.
4,949,550 A 8/1990 Hanson
4,953,784 A 9/1990 Yasufuku et al.
4,959,970 A 10/1990 Meckler
4,964,060 A 10/1990 Hartsog
4,964,125 A 10/1990 Kim
4,966,006 A 10/1990 Thuesen et al.
4,967,567 A 11/1990 Proctor et al.
4,970,496 A 11/1990 Kirkpatrick
4,974,427 A 12/1990 Diab
4,974,665 A 12/1990 Zillner, Jr.
4,975,024 A 12/1990 Heckel
4,977,751 A 12/1990 Hanson
4,985,857 A 1/1991 Bajpai et al.
4,987,748 A 1/1991 Meckler
4,990,057 A 2/1991 Rollins
4,990,893 A 2/1991 Kiluk
4,991,770 A 2/1991 Bird et al.
5,000,009 A 3/1991 Clanin
5,005,365 A 4/1991 Lynch
5,009,074 A 4/1991 Goubeaux et al.
5,009,075 A 4/1991 Okoren
5,009,076 A 4/1991 Winslow
5,012,629 A 5/1991 Rehman et al.
5,018,357 A 5/1991 Livingstone et al.
5,018,665 A 5/1991 Sulmone
RE33,620 E 6/1991 Persem
5,022,234 A 6/1991 Goubeaux et al.
5,039,009 A 8/1991 Baldwin et al.
5,042,264 A 8/1991 Dudley
5,051,720 A 9/1991 Kittirutsunetorn
5,054,294 A 10/1991 Dudley
5,056,036 A 10/1991 Van Bork
5,056,329 A 10/1991 Wilkinson
5,058,388 A 10/1991 Shaw et al.
5,062,278 A 11/1991 Sugiyama
5,065,593 A 11/1991 Dudley et al.
5,067,099 A 11/1991 McCown et al.
RE33,775 E 12/1991 Behr et al.
5,070,468 A 12/1991 Niinomi et al.
5,071,065 A 12/1991 Aalto et al.
5,073,091 A 12/1991 Burgess et al.
5,073,862 A 12/1991 Carlson
5,076,067 A 12/1991 Prenger et al.
5,076,494 A 12/1991 Ripka
5,077,983 A 1/1992 Dudley
5,083,438 A 1/1992 McMullin
5,086,385 A 2/1992 Launey et al.
5,088,297 A 2/1992 Maruyama et al.
5,094,086 A 3/1992 Shyu
5,095,712 A 3/1992 Narreau
5,095,715 A 3/1992 Dudley
5,099,654 A 3/1992 Baruschke et al.
5,102,316 A 4/1992 Caillat et al.
5,103,391 A 4/1992 Barrett
5,107,500 A 4/1992 Wakamoto et al.
5,109,222 A 4/1992 Welty
5,109,676 A 5/1992 Waters et al.
5,109,700 A 5/1992 Hicho
5,109,916 A 5/1992 Thompson
5,115,406 A 5/1992 Zatezalo et al.
5,115,643 A 5/1992 Hayata et al.
5,115,644 A 5/1992 Alsenz
5,115,967 A 5/1992 Wedekind
5,118,260 A 6/1992 Fraser, Jr.
5,119,466 A 6/1992 Suzuki
5,119,637 A 6/1992 Bard et al.
5,121,610 A 6/1992 Atkinson et al.
5,123,017 A 6/1992 Simpkins et al.
5,123,252 A 6/1992 Hanson
5,123,253 A 6/1992 Hanson et al.
5,123,255 A 6/1992 Ohizumi
5,125,067 A 6/1992 Erdman
RE34,001 E 7/1992 Wrobel
5,127,232 A 7/1992 Paige et al.
5,131,237 A 7/1992 Valbjorn
5,136,855 A 8/1992 Lenarduzzi
5,140,394 A 8/1992 Cobb, III et al.
5,141,407 A 8/1992 Ramsey et al.
5,142,877 A 9/1992 Shimizu
5,150,584 A 9/1992 Tomasov et al.
5,156,539 A 10/1992 Anderson et al.
5,167,494 A 12/1992 Inagaki et al.
5,170,935 A 12/1992 Federspiel et al.
5,170,936 A 12/1992 Kubo et al.
5,181,389 A 1/1993 Hanson et al.
5,186,014 A 2/1993 Runk
5,197,666 A 3/1993 Wedekind
5,199,855 A 4/1993 Nakajima et al.
5,200,872 A 4/1993 D'Entremont et al.
5,200,987 A 4/1993 Gray
5,201,862 A 4/1993 Pettitt
5,203,178 A 4/1993 Shyu

(56) References Cited

U.S. PATENT DOCUMENTS

| | | | |
|---|---|---|---|
| 5,203,179 | A | 4/1993 | Powell |
| 5,209,076 | A | 5/1993 | Kauffman et al. |
| 5,209,400 | A | 5/1993 | Winslow et al. |
| 5,219,041 | A | 6/1993 | Greve |
| 5,224,354 | A | 7/1993 | Ito et al. |
| 5,224,835 | A | 7/1993 | Oltman |
| 5,226,472 | A | 7/1993 | Benevelli et al. |
| 5,228,300 | A | 7/1993 | Shim |
| 5,228,304 | A | 7/1993 | Ryan |
| 5,228,307 | A | 7/1993 | Koce |
| 5,230,223 | A | 7/1993 | Hullar et al. |
| 5,231,844 | A | 8/1993 | Park |
| 5,233,841 | A | 8/1993 | Jyrek |
| 5,235,526 | A | 8/1993 | Saffell |
| 5,237,830 | A | 8/1993 | Grant |
| 5,241,664 | A | 8/1993 | Ohba et al. |
| 5,241,833 | A | 9/1993 | Ohkoshi |
| 5,243,827 | A | 9/1993 | Hagita et al. |
| 5,243,829 | A | 9/1993 | Bessler |
| 5,245,833 | A | 9/1993 | Mei et al. |
| 5,248,244 | A | 9/1993 | Ho et al. |
| 5,251,453 | A | 10/1993 | Stanke et al. |
| 5,251,454 | A | 10/1993 | Yoon |
| 5,255,977 | A | 10/1993 | Eimer et al. |
| 5,257,506 | A | 11/1993 | DeWolf et al. |
| 5,262,704 | A | 11/1993 | Farr |
| 5,265,434 | A | 11/1993 | Alsenz |
| 5,269,458 | A | 12/1993 | Sol |
| 5,271,556 | A | 12/1993 | Helt et al. |
| 5,274,571 | A | 12/1993 | Hesse et al. |
| 5,276,630 | A | 1/1994 | Baldwin et al. |
| 5,279,458 | A | 1/1994 | DeWolf et al. |
| 5,282,728 | A | 2/1994 | Swain |
| 5,284,026 | A | 2/1994 | Powell |
| 5,285,646 | A | 2/1994 | TaeDuk |
| 5,289,362 | A | 2/1994 | Liebl et al. |
| 5,290,154 | A | 3/1994 | Kotlarek et al. |
| 5,291,752 | A | 3/1994 | Alvarez et al. |
| 5,299,504 | A | 4/1994 | Abele |
| 5,303,112 | A | 4/1994 | Zulaski et al. |
| 5,303,560 | A | 4/1994 | Hanson et al. |
| 5,311,451 | A | 5/1994 | Barrett |
| 5,311,562 | A | 5/1994 | Palusamy et al. |
| 5,316,448 | A | 5/1994 | Ziegler et al. |
| 5,320,506 | A | 6/1994 | Fogt |
| 5,333,460 | A | 8/1994 | Lewis et al. |
| 5,335,507 | A | 8/1994 | Powell |
| 5,336,058 | A | 8/1994 | Yokoyama |
| 5,337,576 | A | 8/1994 | Dorfman et al. |
| 5,347,476 | A | 9/1994 | McBean, Sr. |
| 5,351,037 | A | 9/1994 | Martell et al. |
| 5,362,206 | A | 11/1994 | Westerman et al. |
| 5,362,211 | A | 11/1994 | Iizuka et al. |
| 5,368,446 | A | 11/1994 | Rode |
| 5,369,958 | A | 12/1994 | Kasai et al. |
| 5,381,669 | A | 1/1995 | Bahel et al. |
| 5,381,692 | A | 1/1995 | Winslow et al. |
| 5,388,176 | A | 2/1995 | Dykstra et al. |
| 5,395,042 | A | 3/1995 | Riley et al. |
| 5,410,230 | A | 4/1995 | Bessler et al. |
| 5,414,792 | A | 5/1995 | Shorey |
| 5,415,008 | A | 5/1995 | Bessler |
| 5,416,781 | A | 5/1995 | Ruiz |
| 5,423,190 | A | 6/1995 | Friedland |
| 5,423,192 | A | 6/1995 | Young et al. |
| 5,426,952 | A | 6/1995 | Bessler |
| 5,431,026 | A | 7/1995 | Jaster |
| 5,432,500 | A | 7/1995 | Scripps |
| 5,435,145 | A | 7/1995 | Jaster |
| 5,435,148 | A | 7/1995 | Sandofsky et al. |
| 5,440,890 | A | 8/1995 | Bahel et al. |
| 5,440,891 | A | 8/1995 | Hindmon, Jr. et al. |
| 5,440,895 | A | 8/1995 | Bahel et al. |
| 5,446,677 | A | 8/1995 | Jensen et al. |
| 5,450,359 | A | 9/1995 | Sharma et al. |
| 5,452,291 | A | 9/1995 | Eisenhandler et al. |
| 5,454,229 | A | 10/1995 | Hanson et al. |
| 5,457,965 | A | 10/1995 | Blair et al. |
| 5,460,006 | A | 10/1995 | Torimitsu |
| 5,467,011 | A | 11/1995 | Hunt |
| 5,467,264 | A | 11/1995 | Rauch et al. |
| 5,469,045 | A | 11/1995 | Dove et al. |
| 5,475,986 | A | 12/1995 | Bahel et al. |
| 5,478,212 | A | 12/1995 | Sakai et al. |
| 5,481,481 | A | 1/1996 | Frey et al. |
| 5,481,884 | A | 1/1996 | Scoccia |
| 5,483,141 | A | 1/1996 | Uesugi |
| 5,491,978 | A | 2/1996 | Young et al. |
| 5,495,722 | A | 3/1996 | Manson et al. |
| 5,499,512 | A | 3/1996 | Jurewicz et al. |
| 5,509,786 | A | 4/1996 | Mizutani et al. |
| 5,511,387 | A | 4/1996 | Tinsler |
| 5,512,883 | A | 4/1996 | Lane, Jr. |
| 5,515,267 | A | 5/1996 | Alsenz |
| 5,515,692 | A | 5/1996 | Sterber et al. |
| 5,519,301 | A | 5/1996 | Yoshida et al. |
| 5,519,337 | A | 5/1996 | Casada |
| 5,528,908 | A | 6/1996 | Bahel et al. |
| 5,532,534 | A | 7/1996 | Baker et al. |
| 5,533,347 | A | 7/1996 | Ott et al. |
| 5,535,136 | A | 7/1996 | Standifer |
| 5,535,597 | A | 7/1996 | An |
| 5,546,015 | A | 8/1996 | Okabe |
| 5,546,073 | A | 8/1996 | Duff et al. |
| 5,546,756 | A | 8/1996 | Ali |
| 5,546,757 | A | 8/1996 | Whipple, III |
| 5,548,966 | A | 8/1996 | Tinsler |
| 5,555,195 | A | 9/1996 | Jensen et al. |
| 5,562,426 | A | 10/1996 | Watanabe et al. |
| 5,563,490 | A | 10/1996 | Kawaguchi et al. |
| 5,564,280 | A | 10/1996 | Schilling et al. |
| 5,566,084 | A | 10/1996 | Cmar |
| 5,570,085 | A | 10/1996 | Bertsch |
| 5,570,258 | A | 10/1996 | Manning |
| 5,572,643 | A | 11/1996 | Judson |
| 5,577,905 | A | 11/1996 | Momber et al. |
| 5,579,648 | A | 12/1996 | Hanson et al. |
| 5,581,229 | A | 12/1996 | Hunt |
| 5,586,445 | A | 12/1996 | Bessler |
| 5,586,446 | A | 12/1996 | Torimitsu |
| 5,590,830 | A | 1/1997 | Kettler et al. |
| 5,592,058 | A | 1/1997 | Archer et al. |
| 5,592,824 | A | 1/1997 | Sogabe et al. |
| 5,596,507 | A | 1/1997 | Jones et al. |
| 5,600,960 | A | 2/1997 | Schwedler et al. |
| 5,602,749 | A | 2/1997 | Vosburgh |
| 5,602,757 | A | 2/1997 | Haseley et al. |
| 5,602,761 | A | 2/1997 | Spoerre et al. |
| 5,610,339 | A | 3/1997 | Haseley et al. |
| 5,611,674 | A | 3/1997 | Bass et al. |
| 5,613,841 | A | 3/1997 | Bass et al. |
| 5,615,071 | A | 3/1997 | Higashikata et al. |
| 5,616,829 | A | 4/1997 | Balaschak et al. |
| 5,623,834 | A | 4/1997 | Bahel et al. |
| 5,628,201 | A | 5/1997 | Bahel et al. |
| 5,630,325 | A | 5/1997 | Bahel et al. |
| 5,635,896 | A | 6/1997 | Tinsley et al. |
| 5,641,270 | A | 6/1997 | Sgourakes et al. |
| 5,643,482 | A | 7/1997 | Sandelman et al. |
| 5,650,936 | A | 7/1997 | Loucks et al. |
| 5,651,263 | A | 7/1997 | Nonaka et al. |
| 5,655,379 | A | 8/1997 | Jaster et al. |
| 5,655,380 | A | 8/1997 | Calton |
| 5,656,765 | A | 8/1997 | Gray |
| 5,656,767 | A | 8/1997 | Garvey, III et al. |
| 5,666,815 | A | 9/1997 | Aloise |
| 5,682,949 | A | 11/1997 | Ratcliffe et al. |
| 5,684,463 | A | 11/1997 | Diercks et al. |
| 5,689,963 | A | 11/1997 | Bahel et al. |
| 5,691,692 | A | 11/1997 | Herbstritt |
| 5,694,010 | A | 12/1997 | Oomura et al. |
| 5,696,501 | A | 12/1997 | Ouellette et al. |
| 5,699,670 | A | 12/1997 | Jurewicz et al. |
| 5,706,007 | A | 1/1998 | Fragnito et al. |

(56) References Cited

U.S. PATENT DOCUMENTS 5,707,210 A 1/1998 Ramsey et al.
5,711,785 A 1/1998 Maxwell
5,713,724 A 2/1998 Centers et al.
5,714,931 A 2/1998 Petite et al.
5,715,704 A 2/1998 Cholkeri et al.
5,718,822 A 2/1998 Richter
5,724,571 A 3/1998 Woods
5,729,474 A 3/1998 Hildebrand et al.
5,737,931 A 4/1998 Ueno et al.
5,741,120 A 4/1998 Bass et al.
5,743,109 A 4/1998 Schulak
5,745,114 A 4/1998 King et al.
5,749,238 A 5/1998 Schmidt
5,751,916 A 5/1998 Kon et al.
5,752,385 A 5/1998 Nelson
5,754,450 A 5/1998 Solomon et al.
5,754,732 A 5/1998 Vlahu
5,757,664 A 5/1998 Rogers et al.
5,757,892 A 5/1998 Blanchard et al.
5,761,083 A 6/1998 Brown, Jr. et al.
5,764,509 A 6/1998 Gross et al.
5,772,214 A 6/1998 Stark
5,772,403 A 6/1998 Allison et al.
5,782,101 A 7/1998 Dennis
5,784,232 A 7/1998 Farr
5,790,898 A 8/1998 Kishima et al.
5,795,381 A 8/1998 Holder
5,798,941 A 8/1998 McLeister
5,802,860 A 9/1998 Barrows
5,805,856 A 9/1998 Hanson
5,807,336 A 9/1998 Russo et al.
5,808,441 A 9/1998 Nehring
5,810,908 A 9/1998 Gray et al.
5,812,061 A 9/1998 Simons
5,825,597 A 10/1998 Young
5,827,963 A 10/1998 Selegatto et al.
5,839,094 A 11/1998 French
5,839,291 A 11/1998 Chang et al.
5,841,654 A 11/1998 Verissimo et al.
5,857,348 A 1/1999 Conry
5,860,286 A 1/1999 Tulpule
5,861,807 A 1/1999 Leyden et al.
5,867,998 A 2/1999 Guertin
5,869,960 A 2/1999 Brand
5,873,257 A 2/1999 Peterson
5,875,430 A 2/1999 Koether
5,875,638 A 3/1999 Tinsler
5,884,494 A 3/1999 Okoren et al.
5,887,786 A 3/1999 Sandelman
5,900,801 A 5/1999 Heagle et al.
5,904,049 A 5/1999 Jaster et al.
5,918,200 A 6/1999 Tsutsui et al.
5,924,295 A 7/1999 Park
5,924,486 A 7/1999 Ehlers et al.
5,926,103 A 7/1999 Petite
5,926,531 A 7/1999 Petite
5,930,773 A 7/1999 Crooks et al.
5,934,087 A 8/1999 Watanabe et al.
5,939,974 A 8/1999 Heagle et al.
5,946,922 A 9/1999 Viard et al.
5,947,693 A 9/1999 Yang
5,947,701 A 9/1999 Hugenroth
5,949,677 A 9/1999 Ho
5,950,443 A 9/1999 Meyer et al.
5,953,490 A 9/1999 Wiklund et al.
5,956,658 A 9/1999 McMahon
5,971,712 A 10/1999 Kann
5,975,854 A 11/1999 Culp, III et al.
5,984,645 A 11/1999 Cummings
5,986,571 A 11/1999 Flick
5,987,903 A 11/1999 Bathla
5,988,986 A 11/1999 Brinken et al.
5,995,347 A 11/1999 Rudd et al.
5,995,351 A 11/1999 Katsumata et al.
6,006,142 A 12/1999 Seem et al.
6,006,171 A 12/1999 Vines et al.
6,011,368 A 1/2000 Kalpathi et al.
6,013,108 A 1/2000 Karolys et al.
6,017,192 A 1/2000 Clack et al.
6,020,702 A 2/2000 Farr
6,023,420 A 2/2000 McCormick et al.
6,026,651 A 2/2000 Sandelman
6,028,522 A 2/2000 Petite
6,035,653 A 3/2000 Itoh et al.
6,035,661 A 3/2000 Sunaga et al.
6,038,871 A 3/2000 Gutierrez et al.
6,041,605 A 3/2000 Heinrichs
6,041,609 A 3/2000 Hornsleth et al.
6,041,856 A 3/2000 Thrasher et al.
6,042,344 A 3/2000 Lifson
6,044,062 A 3/2000 Brownrigg et al.
6,047,557 A 4/2000 Pham et al.
6,050,098 A 4/2000 Meyer et al.
6,050,780 A 4/2000 Hasegawa et al.
6,052,731 A 4/2000 Holdsworth et al.
6,057,771 A 5/2000 Lakra
6,065,946 A 5/2000 Lathrop
6,068,447 A 5/2000 Foege
6,070,110 A 5/2000 Shah et al.
6,075,530 A 6/2000 Lucas et al.
6,077,051 A 6/2000 Centers et al.
6,081,750 A 6/2000 Hoffberg et al.
6,082,495 A 7/2000 Steinbarger et al.
6,082,971 A 7/2000 Gunn et al.
6,085,530 A 7/2000 Barito
6,088,659 A 7/2000 Kelley et al.
6,088,688 A 7/2000 Crooks et al.
6,092,370 A 7/2000 Tremoulet, Jr. et al.
6,092,378 A 7/2000 Das et al.
6,092,992 A 7/2000 Imblum et al.
6,095,674 A 8/2000 Verissimo et al.
6,098,893 A 8/2000 Berglund et al.
6,102,665 A 8/2000 Centers et al.
6,110,260 A 8/2000 Kubokawa
6,119,949 A 9/2000 Lindstrom
6,122,603 A 9/2000 Budike, Jr.
6,125,642 A 10/2000 Seener et al.
6,128,583 A 10/2000 Dowling
6,128,953 A 10/2000 Mizukoshi
6,129,527 A 10/2000 Donahoe et al.
6,138,461 A 10/2000 Park et al.
6,142,741 A 11/2000 Nishihata et al.
6,144,888 A 11/2000 Lucas et al.
6,145,328 A 11/2000 Choi
6,147,601 A 11/2000 Sandelman et al.
6,152,375 A 11/2000 Robison
6,152,376 A 11/2000 Sandelman et al.
6,153,942 A 11/2000 Roseman et al.
6,153,993 A 11/2000 Oomura et al.
6,154,488 A 11/2000 Hunt
6,157,310 A 12/2000 Milne et al.
6,158,230 A 12/2000 Katsuki
6,160,477 A 12/2000 Sandelman et al.
6,169,979 B1 1/2001 Johnson
6,172,476 B1 1/2001 Tolbert, Jr. et al.
6,174,136 B1 1/2001 Kilayko et al.
6,176,683 B1 1/2001 Yang
6,176,686 B1 1/2001 Wallis et al.
6,177,884 B1 1/2001 Hunt et al.
6,178,362 B1 1/2001 Woolard et al.
6,179,214 B1 1/2001 Key et al.
6,181,033 B1 1/2001 Wright
6,190,442 B1 2/2001 Redner
6,191,545 B1 2/2001 Kawabata et al.
6,192,282 B1 2/2001 Smith et al.
6,199,018 B1 3/2001 Quist et al.
6,211,782 B1 4/2001 Sandelman et al.
6,213,731 B1 4/2001 Doepker et al.
6,215,405 B1 4/2001 Handley et al.
6,216,956 B1 4/2001 Ehlers et al.
6,218,953 B1 4/2001 Petite
6,223,543 B1 5/2001 Sandelman
6,223,544 B1 5/2001 Seem
6,228,155 B1 5/2001 Tai

(56) References Cited

U.S. PATENT DOCUMENTS 6,230,501 B1 5/2001 Bailey, Sr. et al.
6,233,327 B1 5/2001 Petite
6,234,019 B1 5/2001 Caldeira
6,240,733 B1 6/2001 Brandon et al.
6,240,736 B1 6/2001 Fujita et al.
6,244,061 B1 6/2001 Takagi et al.
6,249,516 B1 6/2001 Brownrigg et al.
6,260,004 B1 7/2001 Hays et al.
6,266,968 B1 7/2001 Redlich
6,268,664 B1 7/2001 Rolls et al.
6,272,868 B1 8/2001 Grabon et al.
6,276,901 B1 8/2001 Farr et al.
6,279,332 B1 8/2001 Yeo et al.
6,290,043 B1 9/2001 Ginder et al.
6,293,114 B1 9/2001 Kamemoto
6,293,767 B1 9/2001 Bass
6,302,654 B1 10/2001 Millet et al.
6,304,934 B1 10/2001 Pimenta et al.
6,320,275 B1 11/2001 Okamoto et al.
6,324,854 B1 12/2001 Jayanth
6,327,541 B1 12/2001 Pitchford et al.
6,332,327 B1 12/2001 Street et al.
6,334,093 B1 12/2001 More
6,349,883 B1 2/2002 Simmons et al.
6,350,111 B1 2/2002 Perevozchikov et al.
6,359,410 B1 3/2002 Randolph
6,360,551 B1 3/2002 Renders
6,366,889 B1 4/2002 Zaloom
6,368,065 B1 4/2002 Hugenroth et al.
6,375,439 B1 4/2002 Missio
6,378,315 B1 4/2002 Gelber et al.
6,381,971 B2 5/2002 Honda
6,385,510 B1 5/2002 Hoog et al.
6,389,823 B1 5/2002 Loprete et al.
6,390,779 B1 5/2002 Cunkelman
6,391,102 B1 5/2002 Bodden et al.
6,393,848 B2 5/2002 Roh et al.
6,397,606 B1 6/2002 Roh et al.
6,397,612 B1 6/2002 Kernkamp et al.
6,406,265 B1 6/2002 Hahn et al.
6,406,266 B1 6/2002 Hugenroth et al.
6,408,228 B1 6/2002 Seem et al.
6,408,258 B1 6/2002 Richer
6,412,293 B1 7/2002 Pham et al.
6,414,594 B1 7/2002 Guerlain
6,430,268 B1 8/2002 Petite
6,433,791 B2 8/2002 Selli et al.
6,437,691 B1 8/2002 Sandelman et al.
6,437,692 B1 8/2002 Petite et al.
6,438,981 B1 8/2002 Whiteside
6,442,953 B1 9/2002 Trigiani et al.
6,449,972 B2 9/2002 Pham et al.
6,450,771 B1 9/2002 Centers et al.
6,451,210 B1 9/2002 Sivavec et al.
6,453,687 B2 9/2002 Sharood et al.
6,454,177 B1 9/2002 Sasao et al.
6,454,538 B1 9/2002 Witham et al.
6,456,928 B1 9/2002 Johnson
6,457,319 B1 10/2002 Ota et al.
6,457,948 B1 10/2002 Pham
6,460,731 B2 10/2002 Estelle et al.
6,462,654 B1 10/2002 Sandelman et al.
6,463,747 B1 10/2002 Temple
6,466,971 B1 10/2002 Humpleman et al.
6,467,280 B2 10/2002 Pham et al.
6,471,486 B1 10/2002 Centers et al.
6,474,084 B2 11/2002 Gauthier et al.
6,484,520 B2 11/2002 Kawaguchi et al.
6,487,457 B1 11/2002 Hull et al.
6,490,506 B1 12/2002 March
6,492,923 B1 12/2002 Inoue et al.
6,497,554 B2 12/2002 Yang et al.
6,501,240 B2 12/2002 Ueda et al.
6,501,629 B1 12/2002 Marriott
6,502,409 B1 1/2003 Gatling et al.
6,505,087 B1 1/2003 Lucas et al.
6,505,475 B1 1/2003 Zugibe et al.
6,510,350 B1 1/2003 Steen, III et al.
6,522,974 B2 2/2003 Sitton
6,523,130 B1 2/2003 Hickman et al.
6,526,766 B1 3/2003 Hiraoka et al.
6,529,590 B1 3/2003 Centers
6,529,839 B1 3/2003 Uggerud et al.
6,533,552 B2 3/2003 Centers et al.
6,535,123 B2 3/2003 Sandelman et al.
6,535,270 B1 3/2003 Murayama
6,535,859 B1 3/2003 Yablonowski et al.
6,537,034 B2 3/2003 Park et al.
6,542,062 B1 4/2003 Herrick
6,549,135 B2 4/2003 Singh et al.
6,551,069 B2 4/2003 Narney, II et al.
6,553,774 B1 4/2003 Ishio et al.
6,558,126 B1 5/2003 Hahn et al.
6,560,976 B2 5/2003 Jayanth
6,571,280 B1 5/2003 Hubacher
6,571,566 B1 6/2003 Temple et al.
6,571,586 B1 6/2003 Ritson et al.
6,574,561 B2 6/2003 Alexander et al.
6,577,959 B1 6/2003 Chajec et al.
6,577,962 B1 6/2003 Afshari
6,578,373 B1 6/2003 Barbier
6,583,720 B1 6/2003 Quigley
6,589,029 B1 7/2003 Heller
6,591,620 B2 7/2003 Kikuchi et al.
6,595,475 B2 7/2003 Svabek et al.
6,595,757 B2 7/2003 Shen
6,598,056 B1 7/2003 Hull et al.
6,601,397 B2 8/2003 Pham et al.
6,604,093 B1 8/2003 Etzion et al.
6,609,070 B1 8/2003 Lueck
6,609,078 B2 8/2003 Starling et al.
6,615,594 B2 9/2003 Jayanth et al.
6,616,415 B1 9/2003 Renken et al.
6,618,578 B1 9/2003 Petite
6,618,709 B1 9/2003 Sneeringer
6,621,443 B1 9/2003 Selli et al.
6,622,925 B2 9/2003 Carner et al.
6,622,926 B1 9/2003 Sartain et al.
6,628,764 B1 9/2003 Petite
6,629,420 B2 10/2003 Renders
6,630,749 B1 10/2003 Takagi et al.
6,631,298 B1 10/2003 Pagnano et al.
6,636,893 B1 10/2003 Fong
6,643,567 B2 11/2003 Kolk et al.
6,644,848 B1 11/2003 Clayton et al.
6,647,735 B2 11/2003 Street et al.
6,658,345 B2 12/2003 Miller
6,658,373 B2 12/2003 Rossi et al.
6,662,584 B1 12/2003 Whiteside
6,662,653 B1 12/2003 Scaliante et al.
6,671,586 B2 12/2003 Davis et al.
6,672,846 B2 1/2004 Rajendran et al.
6,675,591 B2 1/2004 Singh et al.
6,679,072 B2 1/2004 Pham et al.
6,681,582 B2 1/2004 Suzuki et al.
6,684,349 B2 1/2004 Gullo et al.
6,685,438 B2 2/2004 Yoo et al.
6,698,218 B2 3/2004 Goth et al.
6,701,725 B2 3/2004 Rossi et al.
6,708,083 B2 3/2004 Orthlieb et al.
6,708,508 B2 3/2004 Demuth et al.
6,709,244 B2 3/2004 Pham
6,711,470 B1 3/2004 Hartenstein et al.
6,711,911 B1 3/2004 Grabon et al.
6,717,513 B1 4/2004 Sandelman et al.
6,721,770 B1 4/2004 Morton et al.
6,725,182 B2 4/2004 Pagnano et al.
6,732,538 B2 5/2004 Trigiani et al.
6,745,107 B1 6/2004 Miller
6,747,557 B1 6/2004 Petite et al.
6,757,665 B1 6/2004 Unsworth et al.
6,758,050 B2 7/2004 Jayanth et al.
6,758,051 B2 7/2004 Jayanth et al.
6,760,207 B2 7/2004 Wyatt et al.

(56) References Cited

U.S. PATENT DOCUMENTS 6,772,096 B2 8/2004 Murakami et al.
6,772,598 B1 8/2004 Rinehart
6,775,995 B1 8/2004 Bahel et al.
6,784,807 B2 8/2004 Petite et al.
6,785,592 B1 8/2004 Smith et al.
6,786,473 B1 9/2004 Alles
6,799,951 B2 10/2004 Lifson et al.
6,804,993 B2 10/2004 Selli
6,811,380 B2 11/2004 Kim
6,813,897 B1 11/2004 Bash et al.
6,816,811 B2 11/2004 Seem
6,823,680 B2 11/2004 Jayanth
6,829,542 B1 12/2004 Reynolds et al.
6,832,120 B1 12/2004 Frank et al.
6,832,898 B2 12/2004 Yoshida et al.
6,836,737 B2 12/2004 Petite et al.
6,837,922 B2 1/2005 Gorin
6,839,790 B2 1/2005 Barros De Almeida et al.
6,854,345 B2 2/2005 Alves et al.
6,862,498 B2 3/2005 Davis et al.
6,868,678 B2 3/2005 Mei et al.
6,868,686 B2 3/2005 Ueda et al.
6,869,272 B2 3/2005 Odachi et al.
6,870,486 B2 3/2005 Souza et al.
6,885,949 B2 4/2005 Selli
6,889,173 B2 5/2005 Singh
6,891,838 B1 5/2005 Petite et al.
6,892,546 B2 5/2005 Singh et al.
6,897,772 B1 5/2005 Scheffler et al.
6,900,738 B2 5/2005 Crichlow
6,901,066 B1 5/2005 Helgeson
6,904,385 B1 6/2005 Budike, Jr.
6,914,533 B2 7/2005 Petite
6,914,893 B2 7/2005 Petite
6,922,155 B1 7/2005 Evans et al.
6,931,445 B2 8/2005 Davis
6,934,862 B2 8/2005 Sharood et al.
6,952,658 B2 10/2005 Greulich et al.
6,953,630 B2 10/2005 Wells
6,956,344 B2 10/2005 Robertson et al.
6,964,558 B2 11/2005 Hahn et al.
6,966,759 B2 11/2005 Hahn et al.
6,968,295 B1 11/2005 Carr
6,973,410 B2 12/2005 Seigel
6,973,793 B2 12/2005 Douglas et al.
6,973,794 B2 12/2005 Street et al.
6,976,366 B2 12/2005 Starling et al.
6,978,225 B2 12/2005 Retlich et al.
6,981,384 B2 1/2006 Dobmeier et al.
6,983,321 B2 1/2006 Trinon et al.
6,983,889 B2 1/2006 Alles
6,986,469 B2 1/2006 Gauthier et al.
6,987,450 B2 1/2006 Marino et al.
6,990,821 B2 1/2006 Singh et al.
6,992,452 B1 1/2006 Sachs et al.
6,996,441 B1 2/2006 Tobias
6,997,390 B2 2/2006 Alles
6,998,807 B2 2/2006 Phillips et al.
6,998,963 B2 2/2006 Flen et al.
6,999,996 B2 2/2006 Sunderland
7,000,422 B2 2/2006 Street et al.
7,003,378 B2 2/2006 Poth
7,009,510 B1 3/2006 Douglass et al.
7,010,925 B2 3/2006 Sienel et al.
7,019,667 B2 3/2006 Petite et al.
7,024,665 B2 4/2006 Ferraz et al.
7,024,870 B2 4/2006 Singh et al.
7,030,752 B2 4/2006 Tyroler
7,031,880 B1 4/2006 Seem et al.
7,035,693 B2 4/2006 Cassiolato et al.
7,039,532 B2 5/2006 Hunter
7,042,180 B2 5/2006 Terry et al.
7,042,350 B2 5/2006 Patrick et al.
7,043,339 B2 5/2006 Maeda et al.
7,043,459 B2 5/2006 Peevey
7,047,753 B2 5/2006 Street et al.
7,053,766 B2 5/2006 Fisler et al.
7,053,767 B2 5/2006 Petite et al.
7,054,271 B2 5/2006 Brownrigg et al.
7,062,580 B2 6/2006 Donaires
7,062,830 B2 6/2006 Alles
7,063,537 B2 6/2006 Selli et al.
7,072,797 B2 7/2006 Gorinevsky
7,075,327 B2 7/2006 Dimino et al.
7,079,810 B2 7/2006 Petite et al.
7,079,967 B2 7/2006 Rossi et al.
7,082,380 B2 7/2006 Wiebe et al.
7,089,125 B2 8/2006 Sonderegger
7,091,847 B2 8/2006 Capowski et al.
7,092,767 B2 8/2006 Pagnano et al.
7,092,794 B1 8/2006 Hill et al.
7,096,153 B2 8/2006 Guralnik et al.
7,102,490 B2 9/2006 Flen et al.
7,103,511 B2 9/2006 Petite
7,110,843 B2 9/2006 Pagnano et al.
7,110,898 B2 9/2006 Montijo et al.
7,113,376 B2 9/2006 Nomura et al.
7,114,343 B2 10/2006 Kates
7,123,020 B2 10/2006 Hill et al.
7,123,458 B2 10/2006 Mohr et al.
7,124,728 B2 10/2006 Carey et al.
7,126,465 B2 10/2006 Faltesek
7,130,170 B2 10/2006 Wakefield et al.
7,130,832 B2 10/2006 Bannai et al.
7,134,295 B2 11/2006 Maekawa
7,137,550 B1 11/2006 Petite
7,142,125 B2 11/2006 Larson et al.
7,145,438 B2 12/2006 Flen et al.
7,145,462 B2 12/2006 Dewing et al.
7,159,408 B2 1/2007 Sadegh et al.
7,162,884 B2 1/2007 Alles
7,163,158 B2 1/2007 Rossi et al.
7,171,372 B2 1/2007 Daniel et al.
7,174,728 B2 2/2007 Jayanth
7,180,412 B2 2/2007 Bonicatto et al.
7,184,861 B2 2/2007 Petite
7,188,482 B2 3/2007 Sadegh et al.
7,188,779 B2 3/2007 Alles
7,201,006 B2 4/2007 Kates
7,207,496 B2 4/2007 Alles
7,209,840 B2 4/2007 Petite et al.
7,212,887 B2 5/2007 Shah et al.
7,222,493 B2 5/2007 Jayanth et al.
7,224,740 B2 5/2007 Hunt
7,225,193 B2 5/2007 Mets et al.
7,227,450 B2 6/2007 Garvy et al.
7,228,691 B2 6/2007 Street et al.
7,230,528 B2 6/2007 Kates
7,234,313 B2 6/2007 Bell et al.
7,236,765 B2 6/2007 Bonicatto et al.
7,244,294 B2 7/2007 Kates
7,246,014 B2 7/2007 Forth et al.
7,255,285 B2 8/2007 Troost et al.
7,257,501 B2 8/2007 Zhan et al.
7,260,505 B2 8/2007 Felke et al.
7,261,762 B2 8/2007 Kang et al.
7,263,073 B2 8/2007 Petite et al.
7,263,446 B2 8/2007 Morin et al.
7,266,812 B2 9/2007 Pagnano
7,270,278 B2 9/2007 Street et al.
7,274,995 B2 9/2007 Zhan et al.
7,275,377 B2 10/2007 Kates
7,286,945 B2 10/2007 Zhan et al.
7,290,398 B2 11/2007 Wallace et al.
7,290,989 B2 11/2007 Jayanth
7,295,128 B2 11/2007 Petite
7,295,896 B2 11/2007 Norbeck
7,317,952 B2 1/2008 Bhandiwad et al.
7,328,192 B1 2/2008 Stengard et al.
7,330,886 B2 2/2008 Childers et al.
7,331,187 B2 2/2008 Kates
7,336,168 B2 2/2008 Kates
7,337,191 B2 2/2008 Haeberle et al.
7,343,750 B2 3/2008 Lifson et al.

(56) References Cited

U.S. PATENT DOCUMENTS

| | | | |
|---|---|---|---|
| 7,343,751 | B2 | 3/2008 | Kates |
| 7,346,463 | B2 | 3/2008 | Petite et al. |
| 7,346,472 | B1 | 3/2008 | Moskowitz et al. |
| 7,349,824 | B2 | 3/2008 | Seigel |
| 7,350,112 | B2 | 3/2008 | Fox et al. |
| 7,351,274 | B2 | 4/2008 | Helt et al. |
| 7,352,545 | B2 | 4/2008 | Wyatt et al. |
| 7,363,200 | B2 | 4/2008 | Lu |
| 7,376,712 | B1 | 5/2008 | Granatelli et al. |
| 7,377,118 | B2 | 5/2008 | Esslinger |
| 7,383,030 | B2 | 6/2008 | Brown et al. |
| 7,383,158 | B2 | 6/2008 | Krocker et al. |
| 7,392,661 | B2 | 7/2008 | Alles |
| 7,397,907 | B2 | 7/2008 | Petite |
| 7,400,240 | B2 | 7/2008 | Shrode et al. |
| 7,412,842 | B2 | 8/2008 | Pham |
| 7,414,525 | B2 | 8/2008 | Costea et al. |
| 7,421,351 | B2 | 9/2008 | Navratil |
| 7,421,374 | B2 | 9/2008 | Zhan et al. |
| 7,421,850 | B2 | 9/2008 | Street et al. |
| 7,424,343 | B2 | 9/2008 | Kates |
| 7,424,345 | B2 | 9/2008 | Norbeck |
| 7,424,527 | B2 | 9/2008 | Petite |
| 7,432,824 | B2 | 10/2008 | Flen et al. |
| 7,433,854 | B2 | 10/2008 | Joseph et al. |
| 7,434,742 | B2 | 10/2008 | Mueller et al. |
| 7,437,150 | B1 | 10/2008 | Morelli et al. |
| 7,440,560 | B1 | 10/2008 | Barry |
| 7,440,767 | B2 | 10/2008 | Ballay et al. |
| 7,443,313 | B2 | 10/2008 | Davis et al. |
| 7,444,251 | B2 | 10/2008 | Nikovski et al. |
| 7,445,665 | B2 | 11/2008 | Hsieh et al. |
| 7,447,603 | B2 | 11/2008 | Bruno |
| 7,447,609 | B2 | 11/2008 | Guralnik et al. |
| 7,451,606 | B2 | 11/2008 | Harrod |
| 7,454,439 | B1 | 11/2008 | Gansner et al. |
| 7,458,223 | B2 | 12/2008 | Pham |
| 7,468,661 | B2 | 12/2008 | Petite et al. |
| 7,469,546 | B2 | 12/2008 | Kates |
| 7,474,992 | B2 | 1/2009 | Ariyur |
| 7,480,501 | B2 | 1/2009 | Petite |
| 7,483,810 | B2 | 1/2009 | Jackson et al. |
| 7,484,376 | B2 | 2/2009 | Pham |
| 7,490,477 | B2 | 2/2009 | Singh et al. |
| 7,491,034 | B2 | 2/2009 | Jayanth |
| 7,503,182 | B2 | 3/2009 | Bahel et al. |
| 7,510,126 | B2 | 3/2009 | Rossi et al. |
| 7,523,619 | B2 | 4/2009 | Kojima et al. |
| 7,528,711 | B2 | 5/2009 | Kates |
| 7,533,070 | B2 | 5/2009 | Guralnik et al. |
| 7,537,172 | B2 | 5/2009 | Rossi et al. |
| 7,552,030 | B2 | 6/2009 | Guralnik et al. |
| 7,552,596 | B2 | 6/2009 | Galante et al. |
| 7,555,364 | B2 | 6/2009 | Poth et al. |
| 7,574,333 | B2 | 8/2009 | Lu |
| 7,580,812 | B2 | 8/2009 | Ariyur et al. |
| 7,594,407 | B2 | 9/2009 | Singh et al. |
| 7,596,959 | B2 | 10/2009 | Singh et al. |
| 7,606,683 | B2 | 10/2009 | Bahel et al. |
| 7,631,508 | B2 | 12/2009 | Braun et al. |
| 7,636,901 | B2 | 12/2009 | Munson et al. |
| 7,644,591 | B2 | 1/2010 | Singh et al. |
| 7,648,077 | B2 | 1/2010 | Rossi et al. |
| 7,648,342 | B2 | 1/2010 | Jayanth |
| 7,650,425 | B2 | 1/2010 | Davis et al. |
| 7,660,700 | B2 | 2/2010 | Moskowitz et al. |
| 7,660,774 | B2 | 2/2010 | Mukherjee et al. |
| 7,664,613 | B2 | 2/2010 | Hansen |
| 7,665,315 | B2 | 2/2010 | Singh et al. |
| 7,686,872 | B2 | 3/2010 | Kang |
| 7,693,809 | B2 | 4/2010 | Gray |
| 7,697,492 | B2 | 4/2010 | Petite |
| 7,703,694 | B2 | 4/2010 | Mueller et al. |
| 7,704,052 | B2 | 4/2010 | Iimura et al. |
| 7,706,320 | B2 | 4/2010 | Davis et al. |
| 7,724,131 | B2 | 5/2010 | Chen |
| 7,726,583 | B2 | 6/2010 | Maekawa |
| 7,734,451 | B2 | 6/2010 | MacArthur et al. |
| 7,738,999 | B2 | 6/2010 | Petite |
| 7,739,378 | B2 | 6/2010 | Petite |
| 7,742,393 | B2 | 6/2010 | Bonicatto et al. |
| 7,752,853 | B2 | 7/2010 | Singh et al. |
| 7,752,854 | B2 | 7/2010 | Singh et al. |
| 7,756,086 | B2 | 7/2010 | Petite et al. |
| 7,791,468 | B2 | 9/2010 | Bonicatto et al. |
| 7,844,366 | B2 | 11/2010 | Singh |
| 7,845,179 | B2 | 12/2010 | Singh et al. |
| 7,848,827 | B2 | 12/2010 | Chen |
| 7,848,900 | B2 | 12/2010 | Steinberg et al. |
| 7,877,218 | B2 | 1/2011 | Bonicatto et al. |
| 7,878,006 | B2 | 2/2011 | Pham |
| 7,885,959 | B2 | 2/2011 | Horowitz et al. |
| 7,885,961 | B2 | 2/2011 | Horowitz et al. |
| 7,905,098 | B2 | 3/2011 | Pham |
| 7,908,116 | B2 | 3/2011 | Steinberg et al. |
| 7,908,117 | B2 | 3/2011 | Steinberg et al. |
| 7,922,914 | B1 | 4/2011 | Verdegan et al. |
| 7,937,623 | B2 | 5/2011 | Ramacher et al. |
| 7,941,294 | B2 | 5/2011 | Shahi et al. |
| 7,949,494 | B2 | 5/2011 | Moskowitz et al. |
| 7,949,615 | B2 | 5/2011 | Ehlers et al. |
| 7,963,454 | B2 | 6/2011 | Sullivan et al. |
| 7,966,152 | B2 | 6/2011 | Stluka et al. |
| 7,967,218 | B2 | 6/2011 | Alles |
| 7,978,059 | B2 | 7/2011 | Petite et al. |
| 7,987,679 | B2 | 8/2011 | Tanaka et al. |
| 7,996,045 | B1 | 8/2011 | Bauer et al. |
| 7,999,668 | B2 | 8/2011 | Cawthorne et al. |
| 8,000,314 | B2 | 8/2011 | Brownrigg et al. |
| 8,002,199 | B2 | 8/2011 | Habegger |
| 8,005,640 | B2 | 8/2011 | Chiefetz et al. |
| 8,010,237 | B2 | 8/2011 | Cheung et al. |
| 8,013,732 | B2 | 9/2011 | Petite et al. |
| 8,018,182 | B2 | 9/2011 | Roehm et al. |
| 8,019,567 | B2 | 9/2011 | Steinberg et al. |
| 8,029,608 | B1 | 10/2011 | Breslin |
| 8,031,455 | B2 | 10/2011 | Paik et al. |
| 8,031,650 | B2 | 10/2011 | Petite et al. |
| 8,034,170 | B2 | 10/2011 | Kates |
| 8,036,844 | B2 | 10/2011 | Ling et al. |
| 8,040,231 | B2 | 10/2011 | Kuruvila et al. |
| 8,041,539 | B2 | 10/2011 | Guralnik et al. |
| 8,046,107 | B2 | 10/2011 | Zugibe et al. |
| 8,061,417 | B2 | 11/2011 | Gray |
| 8,064,412 | B2 | 11/2011 | Petite |
| 8,065,886 | B2 | 11/2011 | Singh et al. |
| 8,068,997 | B2 | 11/2011 | Ling et al. |
| 8,090,477 | B1 | 1/2012 | Steinberg |
| 8,090,559 | B2 | 1/2012 | Parthasarathy et al. |
| 8,090,824 | B2 | 1/2012 | Tran et al. |
| 8,095,337 | B2 | 1/2012 | Kolbet et al. |
| 8,108,200 | B2 | 1/2012 | Anne et al. |
| 8,125,230 | B2 | 2/2012 | Bharadwaj et al. |
| 8,131,497 | B2 | 3/2012 | Steinberg et al. |
| 8,131,506 | B2 | 3/2012 | Steinberg et al. |
| 8,134,330 | B2 | 3/2012 | Alles |
| 8,150,720 | B2 | 4/2012 | Singh et al. |
| 8,156,208 | B2 | 4/2012 | Bornhoevd et al. |
| 8,160,827 | B2 | 4/2012 | Jayanth et al. |
| 8,170,968 | B2 | 5/2012 | Colclough et al. |
| 8,171,136 | B2 | 5/2012 | Petite |
| 8,175,846 | B2 | 5/2012 | Khalak et al. |
| 8,180,492 | B2 | 5/2012 | Steinberg |
| 8,182,579 | B2 | 5/2012 | Woo et al. |
| 8,214,175 | B2 | 7/2012 | Moskowitz et al. |
| 8,228,648 | B2 | 7/2012 | Jayanth et al. |
| 8,239,922 | B2 | 8/2012 | Sullivan et al. |
| 8,258,763 | B2 | 9/2012 | Nakamura et al. |
| 8,279,565 | B2 | 10/2012 | Hall et al. |
| 8,280,536 | B1 | 10/2012 | Fadell et al. |
| 8,328,524 | B2 | 12/2012 | Iimura et al. |
| 8,335,657 | B2 | 12/2012 | Jayanth et al. |
| 8,380,556 | B2 | 2/2013 | Singh et al. |
| 8,393,169 | B2 | 3/2013 | Pham |

(56) References Cited

U.S. PATENT DOCUMENTS

| | | | |
|---|---|---|---|
| 8,625,244 | B2 | 1/2014 | Paik et al. |
| 9,046,900 | B2 | 6/2015 | Kates |
| 9,168,315 | B1 | 10/2015 | Scaringe et al. |
| 9,304,521 | B2 | 4/2016 | Kates |
| 9,310,094 | B2 | 4/2016 | Kates |
| 9,310,439 | B2 | 4/2016 | Pham et al. |
| 9,690,307 | B2 | 6/2017 | Kates |
| 9,765,979 | B2 | 9/2017 | Alsaleem et al. |
| 2001/0005320 | A1 | 6/2001 | Ueda et al. |
| 2001/0023596 | A1 | 9/2001 | Fujita et al. |
| 2001/0025349 | A1 | 9/2001 | Sharood et al. |
| 2001/0054291 | A1 | 12/2001 | Roh et al. |
| 2001/0054293 | A1 | 12/2001 | Gustafson et al. |
| 2001/0054294 | A1 | 12/2001 | Tsuboi |
| 2002/0000092 | A1 | 1/2002 | Sharood et al. |
| 2002/0013679 | A1 | 1/2002 | Petite |
| 2002/0016639 | A1 | 2/2002 | Smith et al. |
| 2002/0017057 | A1 | 2/2002 | Weder |
| 2002/0018724 | A1 | 2/2002 | Millet et al. |
| 2002/0020175 | A1 | 2/2002 | Street et al. |
| 2002/0029575 | A1 | 3/2002 | Okamoto |
| 2002/0031101 | A1 | 3/2002 | Petite et al. |
| 2002/0035495 | A1 | 3/2002 | Spira et al. |
| 2002/0040280 | A1 | 4/2002 | Morgan |
| 2002/0059803 | A1 | 5/2002 | Jayanth |
| 2002/0064463 | A1 | 5/2002 | Park et al. |
| 2002/0067999 | A1 | 6/2002 | Suitou et al. |
| 2002/0082747 | A1 | 6/2002 | Kramer |
| 2002/0082924 | A1 | 6/2002 | Koether |
| 2002/0093259 | A1 | 7/2002 | Sunaga et al. |
| 2002/0095269 | A1 | 7/2002 | Natalini et al. |
| 2002/0103655 | A1 | 8/2002 | Boies et al. |
| 2002/0108384 | A1 | 8/2002 | Higashiyama |
| 2002/0113877 | A1 | 8/2002 | Welch |
| 2002/0117992 | A1 | 8/2002 | Hirono et al. |
| 2002/0118106 | A1 | 8/2002 | Brenn |
| 2002/0127120 | A1 | 9/2002 | Hahn et al. |
| 2002/0138217 | A1 | 9/2002 | Shen et al. |
| 2002/0139128 | A1 | 10/2002 | Suzuki et al. |
| 2002/0143482 | A1 | 10/2002 | Karanam et al. |
| 2002/0152298 | A1 | 10/2002 | Kikta et al. |
| 2002/0157408 | A1 | 10/2002 | Egawa et al. |
| 2002/0157409 | A1 | 10/2002 | Pham et al. |
| 2002/0159890 | A1 | 10/2002 | Kajiwara et al. |
| 2002/0161545 | A1 | 10/2002 | Starling et al. |
| 2002/0163436 | A1 | 11/2002 | Singh et al. |
| 2002/0170299 | A1 | 11/2002 | Jayanth et al. |
| 2002/0173929 | A1 | 11/2002 | Seigel |
| 2002/0187057 | A1 | 12/2002 | Loprete et al. |
| 2002/0189267 | A1 | 12/2002 | Singh et al. |
| 2002/0193890 | A1 | 12/2002 | Pouchak |
| 2002/0198629 | A1 | 12/2002 | Ellis |
| 2003/0004660 | A1 | 1/2003 | Hunter |
| 2003/0004765 | A1 | 1/2003 | Wiegand |
| 2003/0005710 | A1 | 1/2003 | Singh et al. |
| 2003/0006884 | A1 | 1/2003 | Hunt |
| 2003/0014218 | A1 | 1/2003 | Trigiani et al. |
| 2003/0019221 | A1 | 1/2003 | Rossi et al. |
| 2003/0036810 | A1 | 2/2003 | Petite |
| 2003/0037555 | A1 | 2/2003 | Street et al. |
| 2003/0050737 | A1 | 3/2003 | Osann |
| 2003/0050824 | A1 | 3/2003 | Suermondt et al. |
| 2003/0051490 | A1 | 3/2003 | Jayanth |
| 2003/0055603 | A1 | 3/2003 | Rossi et al. |
| 2003/0055663 | A1 | 3/2003 | Struble |
| 2003/0061825 | A1 | 4/2003 | Sullivan |
| 2003/0063983 | A1 | 4/2003 | Ancel et al. |
| 2003/0070438 | A1 | 4/2003 | Kikuchi et al. |
| 2003/0070544 | A1 | 4/2003 | Mulvaney et al. |
| 2003/0074285 | A1 | 4/2003 | Hoffman et al. |
| 2003/0077179 | A1 | 4/2003 | Collins et al. |
| 2003/0078677 | A1 | 4/2003 | Hull et al. |
| 2003/0078742 | A1 | 4/2003 | VanderZee et al. |
| 2003/0089493 | A1 | 5/2003 | Takano et al. |
| 2003/0094004 | A1 | 5/2003 | Pham et al. |
| 2003/0108430 | A1 | 6/2003 | Yoshida et al. |
| 2003/0115890 | A1 | 6/2003 | Jayanth et al. |
| 2003/0135786 | A1 | 7/2003 | Vollmar et al. |
| 2003/0137396 | A1 | 7/2003 | Durej et al. |
| 2003/0150924 | A1 | 8/2003 | Peter |
| 2003/0150926 | A1 | 8/2003 | Rosen |
| 2003/0150927 | A1 | 8/2003 | Rosen |
| 2003/0171851 | A1 | 9/2003 | Brickfield et al. |
| 2003/0183085 | A1 | 10/2003 | Alexander |
| 2003/0191606 | A1 | 10/2003 | Fujiyama et al. |
| 2003/0199247 | A1 | 10/2003 | Striemer |
| 2003/0205143 | A1 | 11/2003 | Cheng |
| 2003/0213256 | A1 | 11/2003 | Ueda et al. |
| 2003/0213851 | A1 | 11/2003 | Burd et al. |
| 2003/0216837 | A1 | 11/2003 | Reich et al. |
| 2003/0216888 | A1 | 11/2003 | Ridolfo |
| 2003/0233172 | A1 | 12/2003 | Granqvist et al. |
| 2004/0016241 | A1 | 1/2004 | Street et al. |
| 2004/0016244 | A1 | 1/2004 | Street et al. |
| 2004/0016251 | A1 | 1/2004 | Street et al. |
| 2004/0016253 | A1 | 1/2004 | Street et al. |
| 2004/0019584 | A1 | 1/2004 | Greening et al. |
| 2004/0024495 | A1 | 2/2004 | Sunderland |
| 2004/0026522 | A1 | 2/2004 | Keen et al. |
| 2004/0037706 | A1 | 2/2004 | Hahn et al. |
| 2004/0042904 | A1 | 3/2004 | Kim |
| 2004/0047406 | A1 | 3/2004 | Hunt |
| 2004/0049715 | A1 | 3/2004 | Jaw |
| 2004/0059691 | A1 | 3/2004 | Higgins |
| 2004/0068390 | A1 | 4/2004 | Saunders |
| 2004/0078695 | A1 | 4/2004 | Bowers et al. |
| 2004/0079093 | A1 | 4/2004 | Gauthier et al. |
| 2004/0093879 | A1 | 5/2004 | Street et al. |
| 2004/0095237 | A1 | 5/2004 | Chen et al. |
| 2004/0111186 | A1 | 6/2004 | Rossi et al. |
| 2004/0117166 | A1 | 6/2004 | Cassiolato |
| 2004/0133314 | A1 | 7/2004 | Ehlers et al. |
| 2004/0133367 | A1 | 7/2004 | Hart |
| 2004/0140772 | A1 | 7/2004 | Gullo et al. |
| 2004/0140812 | A1 | 7/2004 | Scallante et al. |
| 2004/0144106 | A1 | 7/2004 | Douglas et al. |
| 2004/0153437 | A1 | 8/2004 | Buchan |
| 2004/0159113 | A1 | 8/2004 | Singh et al. |
| 2004/0159114 | A1 | 8/2004 | Demuth et al. |
| 2004/0183687 | A1 | 9/2004 | Petite et al. |
| 2004/0184627 | A1 | 9/2004 | Kost et al. |
| 2004/0184928 | A1 | 9/2004 | Millet et al. |
| 2004/0184929 | A1 | 9/2004 | Millet et al. |
| 2004/0184930 | A1 | 9/2004 | Millet et al. |
| 2004/0184931 | A1 | 9/2004 | Millet et al. |
| 2004/0187502 | A1 | 9/2004 | Jayanth et al. |
| 2004/0191073 | A1 | 9/2004 | Iimura et al. |
| 2004/0199480 | A1 | 10/2004 | Unsworth et al. |
| 2004/0210419 | A1 | 10/2004 | Wiebe et al. |
| 2004/0213384 | A1 | 10/2004 | Alles et al. |
| 2004/0230582 | A1 | 11/2004 | Pagnano et al. |
| 2004/0230899 | A1 | 11/2004 | Pagnano et al. |
| 2004/0239266 | A1 | 12/2004 | Lee et al. |
| 2004/0258542 | A1 | 12/2004 | Wiertz et al. |
| 2004/0261431 | A1 | 12/2004 | Singh et al. |
| 2005/0040249 | A1 | 2/2005 | Wacker et al. |
| 2005/0043923 | A1 | 2/2005 | Forster et al. |
| 2005/0053471 | A1 | 3/2005 | Hong et al. |
| 2005/0056031 | A1 | 3/2005 | Jeong |
| 2005/0066675 | A1 | 3/2005 | Manole et al. |
| 2005/0073532 | A1 | 4/2005 | Scott et al. |
| 2005/0086341 | A1 | 4/2005 | Enga et al. |
| 2005/0100449 | A1 | 5/2005 | Hahn et al. |
| 2005/0103036 | A1 | 5/2005 | Maekawa |
| 2005/0125439 | A1 | 6/2005 | Nourbakhsh et al. |
| 2005/0126190 | A1 | 6/2005 | Lifson et al. |
| 2005/0131624 | A1 | 6/2005 | Gaessler et al. |
| 2005/0149570 | A1 | 7/2005 | Sasaki et al. |
| 2005/0154495 | A1 | 7/2005 | Shah |
| 2005/0159924 | A1 | 7/2005 | Shah et al. |
| 2005/0166610 | A1 | 8/2005 | Jayanth |
| 2005/0169636 | A1 | 8/2005 | Aronson et al. |
| 2005/0172647 | A1 | 8/2005 | Thybo et al. |
| 2005/0188842 | A1 | 9/2005 | Hsieh et al. |

(56) References Cited

U.S. PATENT DOCUMENTS

2005/0195775 A1 9/2005 Petite et al.
2005/0196285 A1 9/2005 Jayanth
2005/0198063 A1 9/2005 Thomas et al.
2005/0201397 A1 9/2005 Petite
2005/0204756 A1 9/2005 Dobmeier et al.
2005/0207741 A1 9/2005 Shah et al.
2005/0214148 A1 9/2005 Ogawa et al.
2005/0222715 A1 10/2005 Ruhnke et al.
2005/0228607 A1 10/2005 Simons
2005/0229612 A1 10/2005 Hrejsa et al.
2005/0229777 A1 10/2005 Brown et al.
2005/0232781 A1 10/2005 Herbert et al.
2005/0235660 A1 10/2005 Pham
2005/0235661 A1 10/2005 Pham
2005/0235662 A1 10/2005 Pham
2005/0235663 A1 10/2005 Pham
2005/0235664 A1 10/2005 Pham
2005/0247194 A1 11/2005 Kang et al.
2005/0251293 A1 11/2005 Seigel
2005/0252220 A1 11/2005 Street et al.
2005/0262856 A1 12/2005 Street et al.
2005/0262923 A1 12/2005 Kates
2005/0279110 A1 12/2005 Zeng et al.
2006/0010898 A1 1/2006 Suharno et al.
2006/0015777 A1 1/2006 Loda
2006/0020426 A1 1/2006 Singh
2006/0021362 A1 2/2006 Sadegh et al.
2006/0032245 A1 2/2006 Kates
2006/0032246 A1 2/2006 Kates
2006/0032247 A1 2/2006 Kates
2006/0032248 A1 2/2006 Kates
2006/0032379 A1 2/2006 Kates
2006/0036349 A1 2/2006 Kates
2006/0041335 A9 2/2006 Rossi et al.
2006/0042276 A1* 3/2006 Doll, Jr. ..... F25B 49/005 62/129
2006/0071089 A1 4/2006 Kates
2006/0071666 A1 4/2006 Unsworth et al.
2006/0074917 A1 4/2006 Chand et al.
2006/0097063 A1 5/2006 Zeevi
2006/0098576 A1 5/2006 Brownrigg et al.
2006/0117767 A1* 6/2006 Mowris ..... F25B 49/005 62/149
2006/0117773 A1 6/2006 Street et al.
2006/0123807 A1 6/2006 Sullivan et al.
2006/0129339 A1 6/2006 Bruno
2006/0130500 A1 6/2006 Gauthier et al.
2006/0137364 A1 6/2006 Braun et al.
2006/0137368 A1 6/2006 Kang et al.
2006/0138866 A1 6/2006 Bergmann et al.
2006/0140209 A1 6/2006 Cassiolato et al.
2006/0151037 A1 7/2006 Lepola et al.
2006/0179854 A1 8/2006 Esslinger
2006/0182635 A1 8/2006 Jayanth
2006/0185373 A1 8/2006 Butler et al.
2006/0196196 A1 9/2006 Kates
2006/0196197 A1 9/2006 Kates
2006/0201168 A1 9/2006 Kates
2006/0222507 A1 10/2006 Jayanth
2006/0229739 A1 10/2006 Morikawa
2006/0235650 A1 10/2006 Vinberg et al.
2006/0238388 A1 10/2006 Jayanth
2006/0242200 A1 10/2006 Horowitz et al.
2006/0244641 A1 11/2006 Jayanth et al.
2006/0256488 A1 11/2006 Benzing et al.
2006/0259276 A1 11/2006 Rossi et al.
2006/0271589 A1 11/2006 Horowitz et al.
2006/0271623 A1 11/2006 Horowitz et al.
2006/0280627 A1 12/2006 Jayanth
2007/0002505 A1 1/2007 Watanabe et al.
2007/0006124 A1 1/2007 Ahmed et al.
2007/0027735 A1 2/2007 Rokos
2007/0067512 A1 3/2007 Donaires et al.
2007/0089434 A1 4/2007 Singh et al.
2007/0089435 A1 4/2007 Singh et al.
2007/0089438 A1 4/2007 Singh et al.
2007/0089439 A1 4/2007 Singh et al.
2007/0089440 A1 4/2007 Singh et al.
2007/0101750 A1 5/2007 Pham et al.
2007/0125102 A1* 6/2007 Concha ..... B60H 1/00978 62/149
2007/0159978 A1 7/2007 Anglin et al.
2007/0186569 A1 8/2007 Street et al.
2007/0204635 A1 9/2007 Tanaka et al.
2007/0204921 A1 9/2007 Alles
2007/0205296 A1 9/2007 Bell et al.
2007/0229305 A1 10/2007 Bonicatto et al.
2007/0239894 A1 10/2007 Thind et al.
2008/0000241 A1 1/2008 Larsen et al.
2008/0015797 A1 1/2008 Kates
2008/0016888 A1 1/2008 Kates
2008/0033674 A1 2/2008 Nikovski et al.
2008/0051945 A1 2/2008 Kates
2008/0058970 A1 3/2008 Perumalsamy et al.
2008/0078289 A1 4/2008 Sergi et al.
2008/0109185 A1 5/2008 Cheung et al.
2008/0110189 A1 5/2008 Alston et al.
2008/0114569 A1 5/2008 Seigel
2008/0121729 A1 5/2008 Gray
2008/0183424 A1 7/2008 Seem
2008/0186898 A1 8/2008 Petite
2008/0209925 A1 9/2008 Pham
2008/0216494 A1 9/2008 Pham et al.
2008/0216495 A1 9/2008 Kates
2008/0223051 A1 9/2008 Kates
2008/0234869 A1 9/2008 Yonezawa et al.
2008/0315000 A1 12/2008 Gorthala et al.
2008/0319688 A1 12/2008 Kim
2009/0007777 A1 1/2009 Cohen et al.
2009/0030555 A1 1/2009 Gray
2009/0037142 A1 2/2009 Kates
2009/0038010 A1 2/2009 Ma et al.
2009/0055465 A1 2/2009 DePue et al.
2009/0057424 A1 3/2009 Sullivan et al.
2009/0057428 A1 3/2009 Geadelmann et al.
2009/0068947 A1 3/2009 Petite
2009/0071175 A1 3/2009 Pham
2009/0072985 A1 3/2009 Patel et al.
2009/0093916 A1 4/2009 Parsonnet et al.
2009/0094998 A1 4/2009 McSweeney et al.
2009/0096605 A1 4/2009 Petite et al.
2009/0099699 A1 4/2009 Steinberg et al.
2009/0106601 A1 4/2009 Ngai et al.
2009/0112672 A1 4/2009 Flamig et al.
2009/0114309 A1 5/2009 Sakai et al.
2009/0119036 A1 5/2009 Jayanth et al.
2009/0125151 A1 5/2009 Steinberg et al.
2009/0125257 A1 5/2009 Jayanth et al.
2009/0140880 A1 6/2009 Flen et al.
2009/0151374 A1 6/2009 Kasahara
2009/0187281 A1 7/2009 Kates
2009/0215424 A1 8/2009 Petite
2009/0229469 A1 9/2009 Campbell et al.
2009/0241570 A1 10/2009 Kuribayashi et al.
2009/0296832 A1 12/2009 Hunt
2009/0324428 A1 12/2009 Tolbert, Jr. et al.
2010/0006042 A1 1/2010 Pitonyak et al.
2010/0011962 A1 1/2010 Totsugi
2010/0017465 A1 1/2010 Brownrigg et al.
2010/0039984 A1 2/2010 Brownrigg
2010/0044449 A1 2/2010 Tessier
2010/0070084 A1 3/2010 Steinberg et al.
2010/0070234 A1 3/2010 Steinberg et al.
2010/0070666 A1 3/2010 Brindle
2010/0078493 A1 4/2010 Alles
2010/0081357 A1 4/2010 Alles
2010/0081372 A1 4/2010 Alles
2010/0089076 A1 4/2010 Schuster et al.
2010/0102136 A1 4/2010 Hadzidedic et al.
2010/0111709 A1 5/2010 Jayanth
2010/0168924 A1 7/2010 Tessier et al.
2010/0169030 A1 7/2010 Parlos
2010/0179703 A1 7/2010 Singh et al.
2010/0191487 A1 7/2010 Rada et al.

(56) References Cited

U.S. PATENT DOCUMENTS

2010/0194582 A1 8/2010 Petite
2010/0214709 A1 8/2010 Hall et al.
2010/0217550 A1 8/2010 Crabtree et al.
2010/0250054 A1 9/2010 Petite
2010/0257410 A1 10/2010 Cottrell et al.
2010/0262299 A1 10/2010 Cheung et al.
2010/0265909 A1 10/2010 Petite et al.
2010/0280667 A1 11/2010 Steinberg
2010/0282857 A1 11/2010 Steinberg
2010/0287489 A1 11/2010 Alles
2010/0293397 A1 11/2010 Pham et al.
2010/0305718 A1 12/2010 Clark et al.
2010/0308119 A1 12/2010 Steinberg et al.
2010/0312881 A1 12/2010 Davis et al.
2010/0318227 A1 12/2010 Steinberg et al.
2010/0330985 A1 12/2010 Addy
2011/0004350 A1 1/2011 Cheifetz et al.
2011/0022429 A1 1/2011 Yates et al.
2011/0023045 A1 1/2011 Yates et al.
2011/0023945 A1 2/2011 Hayashi et al.
2011/0040785 A1 2/2011 Steenberg et al.
2011/0042541 A1 2/2011 Spencer et al.
2011/0045454 A1 2/2011 McManus et al.
2011/0054842 A1 3/2011 Kates
2011/0071960 A1 3/2011 Singh
2011/0077896 A1 3/2011 Steinberg et al.
2011/0083450 A1 4/2011 Turner et al.
2011/0102159 A1 5/2011 Olson et al.
2011/0103460 A1 5/2011 Bonicatto
2011/0106471 A1 5/2011 Curtis et al.
2011/0112814 A1 5/2011 Clark
2011/0118905 A1 5/2011 Mylaraswamy et al.
2011/0121952 A1 5/2011 Bonicatto et al.
2011/0144932 A1 6/2011 Alles
2011/0144944 A1 6/2011 Pham
2011/0166828 A1 7/2011 Steinberg et al.
2011/0181438 A1 7/2011 Millstein et al.
2011/0184563 A1 7/2011 Foslien et al.
2011/0185895 A1 8/2011 Freen
2011/0190910 A1 8/2011 Lombard et al.
2011/0212700 A1 9/2011 Petite
2011/0218957 A1 9/2011 Coon et al.
2011/0264324 A1 10/2011 Petite et al.
2011/0264409 A1 10/2011 Jayanth et al.
2011/0290893 A1 12/2011 Steinberg
2011/0307103 A1 12/2011 Cheung et al.
2011/0309953 A1 12/2011 Petite et al.
2011/0310929 A1 12/2011 Petite et al.
2011/0315019 A1 12/2011 Lyon et al.
2011/0320050 A1 12/2011 Petite et al.
2012/0005590 A1 1/2012 Lombard et al.
2012/0047940 A1* 3/2012 Junge ..... F25D 11/00 62/452
2012/0054242 A1 3/2012 Ferrara et al.
2012/0065783 A1 3/2012 Fadell et al.
2012/0065935 A1 3/2012 Steinberg et al.
2012/0066168 A1 3/2012 Fadell et al.
2012/0075092 A1 3/2012 Petite et al.
2012/0092154 A1 4/2012 Petite
2012/0125559 A1 5/2012 Fadell et al.
2012/0125592 A1 5/2012 Fadell et al.
2012/0126019 A1 5/2012 Warren et al.
2012/0126020 A1 5/2012 Filson et al.
2012/0126021 A1 5/2012 Warren et al.
2012/0128025 A1 5/2012 Huppi et al.
2012/0130546 A1 5/2012 Matas et al.
2012/0130547 A1 5/2012 Fadell et al.
2012/0130548 A1 5/2012 Fadell et al.
2012/0130679 A1 5/2012 Fadell et al.
2012/0131504 A1 5/2012 Fadell et al.
2012/0143528 A1 6/2012 Kates
2012/0179300 A1 7/2012 Warren et al.
2012/0186774 A1 7/2012 Matsuoka et al.
2012/0191257 A1 7/2012 Corcoran et al.
2012/0199660 A1 8/2012 Warren et al.
2012/0203379 A1 8/2012 Sloo et al.
2012/0221150 A1 8/2012 Arensmeier
2012/0229521 A1 9/2012 Hales, IV et al.
2012/0232969 A1 9/2012 Fadell et al.
2012/0233478 A1 9/2012 Mucignat et al.
2012/0239207 A1 9/2012 Fadell et al.
2012/0239221 A1 9/2012 Mighdoll et al.
2012/0245968 A1 9/2012 Beaulieu et al.
2012/0248210 A1 10/2012 Warren et al.
2012/0248211 A1 10/2012 Warren et al.
2012/0260804 A1 10/2012 Kates
2012/0265491 A1 10/2012 Drummy
2012/0265586 A1 10/2012 Mammone
2012/0271673 A1 10/2012 Riley
2012/0291629 A1 11/2012 Tylutki et al.
2012/0318135 A1 12/2012 Hoglund et al.
2012/0318137 A1 12/2012 Ragland et al.
2013/0066479 A1 3/2013 Shetty et al.
2013/0156607 A1 6/2013 Jayanth
2013/0166231 A1 6/2013 Jayanth et al.
2013/0174588 A1 7/2013 Pham
2013/0176649 A1 7/2013 Wallis et al.
2013/0182285 A1 7/2013 Matsuhara et al.
2013/0287063 A1 10/2013 Kates
2013/0294933 A1 11/2013 Pham
2014/0000290 A1 1/2014 Kates
2014/0000291 A1 1/2014 Kates
2014/0000292 A1 1/2014 Kates
2014/0000293 A1 1/2014 Kates
2014/0000294 A1 1/2014 Kates
2014/0012422 A1 1/2014 Kates
2014/0069121 A1 3/2014 Pham
2014/0074730 A1 3/2014 Arensmeier et al.
2014/0084836 A1 3/2014 Pham et al.
2014/0229014 A1 8/2014 Pham et al.
2014/0260342 A1 9/2014 Pham
2014/0260390 A1 9/2014 Pham
2014/0262134 A1 9/2014 Arensmeier et al.
2014/0266755 A1 9/2014 Arensmeier et al.
2014/0297208 A1 10/2014 Arensmeier
2014/0299289 A1 10/2014 Alsaleem et al.
2015/0135748 A1 5/2015 Alsaleem et al.
2015/0155701 A1 6/2015 Wallis et al.
2015/0261230 A1 9/2015 Kates
2015/0367463 A1 12/2015 Pham
2016/0076536 A1 3/2016 Jayanth et al.
2016/0223238 A1 8/2016 Kates
2016/0226416 A1 8/2016 Pham et al.
2017/0179709 A1 6/2017 Wallis et al.
2017/0308072 A1 10/2017 Arensmeier

FOREIGN PATENT DOCUMENTS

CA 2528778 A1 12/2004
CA 2567264 A1 7/2007
CH 173493 A 11/1934
CN 1133425 A 10/1996
CN 1169619 A 1/1998
CN 1297522 A 5/2001
CN 1354347 A 6/2002
CN 1356472 A 7/2002
CN 1654893 A 8/2005
CN 1742427 A 3/2006
CN 1906453 A 1/2007
CN 1922445 A 2/2007
CN 101048713 A 10/2007
CN 101124436 A 2/2008
CN 101156033 A 4/2008
CN 101270908 A 9/2008
CN 101361244 A 2/2009
CN 101466193 A 6/2009
CN 101506600 A 8/2009
CN 101802521 A 8/2010
CN 101821693 A 9/2010
CN 102354206 A 2/2012
DE 842351 C 6/1952
DE 764179 C 4/1953
DE 1144461 B 2/1963
DE 1403516 A1 10/1968

(56) References Cited

FOREIGN PATENT DOCUMENTS

| | | | |
|---|---|---|---|
| DE | 1403467 | A1 | 10/1969 |
| DE | 3118638 | A1 | 5/1982 |
| DE | 3133502 | A1 | 6/1982 |
| DE | 3508353 | A1 | 9/1985 |
| DE | 3422398 | A1 | 12/1985 |
| DE | 29723145 | U1 | 4/1998 |
| EP | 0008524 | A1 | 3/1980 |
| EP | 0060172 | A1 | 9/1982 |
| EP | 0085246 | A1 | 8/1983 |
| EP | 0124603 | A1 | 11/1984 |
| EP | 0254253 | A2 | 1/1988 |
| EP | 0346152 | A2 | 12/1989 |
| EP | 0351272 | A1 | 1/1990 |
| EP | 0351833 | A2 | 1/1990 |
| EP | 0355255 | A2 | 2/1990 |
| EP | 0361394 | A2 | 4/1990 |
| EP | 0398436 | A1 | 11/1990 |
| EP | 0410330 | A2 | 1/1991 |
| EP | 0419857 | A2 | 4/1991 |
| EP | 0432085 | A2 | 6/1991 |
| EP | 0453302 | A1 | 10/1991 |
| EP | 0479421 | A1 | 4/1992 |
| EP | 0557023 | A1 | 8/1993 |
| EP | 0579374 | A1 | 1/1994 |
| EP | 0660213 | A2 | 6/1995 |
| EP | 0747598 | A2 | 12/1996 |
| EP | 0877462 | A2 | 11/1998 |
| EP | 0982497 | A1 | 3/2000 |
| EP | 1008816 | A2 | 6/2000 |
| EP | 1087142 | A2 | 3/2001 |
| EP | 1087184 | A2 | 3/2001 |
| EP | 1138949 | A2 | 10/2001 |
| EP | 1139037 | A1 | 10/2001 |
| EP | 1187021 | A2 | 3/2002 |
| EP | 1209427 | A1 | 5/2002 |
| EP | 1241417 | A1 | 9/2002 |
| EP | 1245912 | A2 | 10/2002 |
| EP | 1245913 | A1 | 10/2002 |
| EP | 1393034 | A1 | 3/2004 |
| EP | 1435002 | A1 | 7/2004 |
| EP | 1487077 | A2 | 12/2004 |
| EP | 1541869 | A1 | 6/2005 |
| EP | 2180270 | A1 | 4/2010 |
| FR | 2472862 | A1 | 7/1981 |
| FR | 2582430 | A1 | 11/1986 |
| FR | 2589561 | A1 | 5/1987 |
| FR | 2628558 | A1 | 9/1989 |
| FR | 2660739 | A1 | 10/1991 |
| GB | 2062919 | A | 5/1981 |
| GB | 2064818 | A | 6/1981 |
| GB | 2075774 | A | 11/1981 |
| GB | 2116635 | A | 9/1983 |
| GB | 2229295 | A | 9/1990 |
| GB | 2347217 | A | 8/2000 |
| JP | 56010639 | A | 2/1981 |
| JP | 59145392 | A | 8/1984 |
| JP | 61046485 | A | 3/1986 |
| JP | 62116844 | A | 5/1987 |
| JP | 63061783 | A | 3/1988 |
| JP | 63302238 | A | 12/1988 |
| JP | 01014554 | A | 1/1989 |
| JP | 02110242 | A | 4/1990 |
| JP | 02294580 | A | 12/1990 |
| JP | 04080578 | A | 3/1992 |
| JP | 06058273 | A | 3/1994 |
| JP | 08021675 | A | 1/1996 |
| JP | 08087229 | A | 4/1996 |
| JP | 08284842 | A | 10/1996 |
| JP | H08261541 | A | 10/1996 |
| JP | 2000350490 | A | 12/2000 |
| JP | 2002155868 | A | 5/2002 |
| JP | 2003018883 | A | 1/2003 |
| JP | 2003176788 | A | 6/2003 |
| JP | 2004316504 | A | 11/2004 |
| JP | 2005188790 | A | 7/2005 |
| JP | 2005241089 | A | 9/2005 |
| JP | 2005345096 | A | 12/2005 |
| JP | 2006046219 | A | 2/2006 |
| JP | 2006046519 | A | 2/2006 |
| JP | 2006274807 | A | 10/2006 |
| JP | 2009002651 | A | 1/2009 |
| JP | 2009229184 | A | 10/2009 |
| JP | 2010048433 | A | 3/2010 |
| KR | 10-1998-0036844 | A | 8/1998 |
| KR | 20000000261 | A | 1/2000 |
| KR | 1020000025265 | | 5/2000 |
| KR | 1020020041977 | | 6/2002 |
| KR | 20030042857 | A | 6/2003 |
| KR | 1020040021281 | | 3/2004 |
| KR | 1020060020353 | | 3/2006 |
| RU | 30009 | U1 | 6/2003 |
| RU | 55218 | U1 | 7/2006 |
| WO | WO-8601262 | A1 | 2/1986 |
| WO | WO-8703988 | A1 | 7/1987 |
| WO | WO-8705097 | A1 | 8/1987 |
| WO | WO-8802527 | A1 | 4/1988 |
| WO | WO-8806703 | A1 | 9/1988 |
| WO | WO-9718636 | A2 | 5/1997 |
| WO | WO-9748161 | A1 | 12/1997 |
| WO | WO-9917066 | A1 | 4/1999 |
| WO | WO-9961847 | A1 | 12/1999 |
| WO | WO-9965681 | A1 | 12/1999 |
| WO | WO-0021047 | A1 | 4/2000 |
| WO | WO-0051223 | A1 | 8/2000 |
| WO | WO-0169147 | A1 | 9/2001 |
| WO | WO-0214968 | A1 | 2/2002 |
| WO | WO-0249178 | A2 | 6/2002 |
| WO | WO-0275227 | A1 | 9/2002 |
| WO | WO-02/090840 | A2 | 11/2002 |
| WO | WO-02/090913 | A1 | 11/2002 |
| WO | WO-02090914 | A1 | 11/2002 |
| WO | WO-03031996 | A1 | 4/2003 |
| WO | WO-03090000 | A1 | 10/2003 |
| WO | WO-04049088 | A1 | 6/2004 |
| WO | WO-2005022049 | A2 | 3/2005 |
| WO | WO-2005065355 | A2 | 7/2005 |
| WO | WO-05073686 | A1 | 8/2005 |
| WO | WO-2005108882 | A2 | 11/2005 |
| WO | WO-06023075 | A2 | 3/2006 |
| WO | WO-2006025880 | A1 | 3/2006 |
| WO | WO-2006091521 | A2 | 8/2006 |
| WO | WO-2008010988 | A1 | 1/2008 |
| WO | WO-2008079108 | A1 | 7/2008 |
| WO | WO-08144864 | A1 | 12/2008 |
| WO | WO-2009058356 | A1 | 5/2009 |
| WO | WO-2009061370 | A1 | 5/2009 |
| WO | WO-10138831 | A2 | 12/2010 |
| WO | WO-11069170 | A1 | 6/2011 |
| WO | WO-12092625 | A2 | 7/2012 |
| WO | WO-2012118550 | A1 | 9/2012 |

OTHER PUBLICATIONS

Office Action regarding U.S. Appl. No. 15/645,970 dated Feb. 16, 2018.

Notice of Allowance regarding U.S. Appl. No. 15/645,970 dated Oct. 31, 2018.

Notice of Allowance regarding U.S. Appl. No. 14/949,090 dated Nov. 26, 2018.

Non Final Office Action for U.S. Appl. No. 15/096,186 dated Sep. 20, 2018, 14 pages.

Non-Final Office Action regarding U.S. Appl. No. 16/113,271 dated Jan. 25, 2019.

First Examination Report issued by the Indian Patent Office regarding Application No. 479/MUMNP/2015 dated Dec. 21, 2018.

Non-Final Office Action regarding U.S. Appl. No. 15/633,657 dated Feb. 20, 2019.

Non-Final Office Action regarding U.S. Appl. No. 14/949,090 dated Feb. 14, 2019.

Notice of Allowance regarding U.S. Appl. No. 15/613,375 dated Feb. 27, 2019.

First Examination Report issued by the Indian Patent Office regarding Application No. 2574/MUMNP/2015 dated Mar. 20, 2019.

(56) References Cited

OTHER PUBLICATIONS

Office Action regarding U.S. Appl. No. 11/850,846, dated Aug. 13, 2010.
Second Office Action regarding Chinese Patent Application No. 200780030810X, dated Aug. 4, 2010. English translation provided by Unitalen Attorneys at Law.
The International Search Report regarding International Application No. PCT/U82007/019563, dated Jan. 15, 2008.
Written Opinion of the International Searching Authority regarding International Application No. PCT/US2007/019563, dated Jan. 15, 2008.
Einstein RX-300 Refrigeration Controller Installation and Operation Manual, Computer Process Controls, Apr. 1, 1998, 329 pages.
International Search Report for International Application No. PCT/US2008/012364 dated Mar. 13, 2009.
Written Opinion of the International Searching Authority for International Application No. PCT/US2008/012364 dated Mar. 12, 2009.
International Search Report for International Application No. PCT/US2008/012362, dated Feb. 12, 2009.
International Search Report for International Application No. PCT/US2007/016135 dated Oct. 22, 2007.
International Preliminary Report on Patentability regarding International Application No. PCT/US2007/019563 dated Mar. 10, 2009.
International Search Report for International Application No. PCT/US2005/11154, dated Oct. 19, 2005.
First Office Action issued by the Chinese Patent Office dated May 30, 2008 regarding Application No. 200580013451.8, 8 Pages.
Second Office Action issued by the Chinese Patent Office dated Mar. 6, 2009 regarding Application No. 200580013451.8, 7 Pages.
Third Office Action issued by the Chinese Patent Office dated Jun. 19, 2009 regarding Application No. 200580013451.8, translated by CCPIT Patent and Trademark Law Office.
First Office Action from the Patent Office of the People's Republic of China regarding Application No. 200510005907.8, dated Jun. 29, 2007.
"A Practical Example of a Building's Automatic Control," cited in First Office Action from the Patent Office of the People's Republic of China dated Jun. 29, 2007, regarding Application No. 200510005907.8, including translation by CCPIT Patent and Trademark Law Office.
"Product Performance Introduction of York Company," cited in First Office Action from the Patent Office of the People's Republic of China dated Jun. 29, 2007 regarding Application No. 200510005907.8, including translation by CCPIT Patent and Trademark Law Office.
Second Office action issued by the Chinese Patent Office dated Jun. 19, 2009 regarding Application No. 200510005907.8, translation provided by CCPIT Patent and Trademark Law Office.
Ultrasite 32 User's Guide, Computer Process Controls, Sep. 28, 1999.
Ultrasite User's Guide BEC Supplement, Computer Process Controls, Oct. 6, 1997.
Ultrasite User's Guide BCU Supplement, Computer Process Controls, Sep. 4, 1997.
Ultrasite User's Guide RMCC Supplement, Computer Process Controls, Jun. 9, 1997.
Refrigeration Monitor and Case Control Installation and Operation Manual, Computer Process Controls, Aug. 12, 1999.
Building Environmental Control (BEC) Installation and Operation Manual, Computer Process Controls, Jan. 5, 1998.
Building Control Unit (BCU) Installation and Operation Manual, Computer Process Controls, Jan. 28, 1998, 141 pages.
First Office Action issued by the Chinese Patent Office regarding Application No. 200780030810.X dated Dec. 25, 2009.
"Manual for Freezing and Air Conditioning Technology," Fan Jili, Liaoning Science and Technology Press, Sep. 1995 (cited in First Office Action issued by the Chinese Patent Office regarding Application No. 200780030810.X dated Dec. 25, 2009).
International Preliminary Report on Patentability for International Application No. PCT/US2008/012362, dated May 4, 2010.
International Preliminary Report on Patentability for International Application No. PCT/US2008/012364, dated May 4, 2010.
Office Action regarding U.S. Appl. No. 11/098,575, dated Mar. 26, 2008.
Office Action regarding U.S. Appl. No. 11/098,575, dated Sep. 9, 2008.
Office Action regarding U.S. Appl. No. 11/098,575, dated Jan. 29, 2009.
Office Action regarding U.S. Appl. No. 11/098,575, dated Jul. 13, 2009.
Advisory Action Before the Filing of An Appeal Brief regarding U.S. Appl. No. 11/098,575, dated Sep. 28, 2009.
Advisory Action Before the Filing of an Appeal Brief regarding U.S. Appl. No. 11/098,575, dated Nov. 16, 2009.
Non-Final Office Action for U.S. Appl. No. 11/098,575 dated Jan. 27, 2010.
Interview Summary regarding U.S. Appl. No. 11/098,582, dated Apr. 27, 2010.
Office Action regarding U.S. Appl. No. 11/098,582 dated Mar. 3, 2010.
Office Action regarding U.S. Appl. No. 11/098,582, dated Aug. 4, 2009.
Notice of Allowance and Fees Due and Notice of Allowability regarding U.S. Appl. No. 11/098,582, dated Feb. 24, 2009.
Office Action regarding U.S. Appl. No. 11/098,582, dated Jul. 7, 2008.
Office Action regarding U.S. Appl. No. 11/098,582, dated Sep. 21, 2007.
Translation of claims and Abstract of KR Patent Laying-Open No. 2000-0000261.
Notice of Panel Decision from Pre-Appeal Brief Review regarding U.S. Appl. No. 09/977,552, dated Aug. 4, 2009.
Final Office Action regarding U.S. Appl. No. 09/977,552, dated Oct. 22, 2008.
Office Action regarding U.S. Appl. No. 09/977,552, dated Jan. 11, 2008.
Final Office Action regarding U.S. Appl. No. 09/977,552, dated Jul. 23, 2007.
Office Action Communication regarding U.S. Appl. No. 09/977,552, dated Apr. 18, 2007.
Election/Restriction Requirement regarding U.S. Appl. No. 09/977,552, dated Jan. 25, 2007.
Office Action regarding U.S. Appl. No. 09/977,552, dated Jul. 12, 2006.
Advisory Action Before the Filing of an Appeal Brief regarding U.S. Appl. No. 09/977,552, dated Nov. 10, 2005.
Final Office Action regarding U.S. Appl. No. 09/977,552, dated May 13, 2005.
Office Action regarding U.S. Appl. No. 09/977,552, dated Oct. 18, 2004.
Final Office Action regarding U.S. Appl. No. 09/977,552, dated Apr. 26, 2004.
Response to Rule 312 Communication regarding U.S. Appl. No. 09/977,552, dated Oct. 31, 2003.
Office Action regarding U.S. Appl. No. 09/977,552, dated Dec. 3, 2003.
Final Office Action regarding U.S. Appl. No. 09/977,552, dated Jun. 18, 2003.
Office Action regarding U.S. Appl. No. 09/977,552, dated Jan. 14, 2003.
Final Office Action regarding U.S. Appl. No. 11/098,575, dated Jun. 17, 2010.
Notice of Allowance and Fees Due and Notice of Allowability regarding U.S. Appl. No. 11/098,582, dated Sep. 24, 2010.
Office Action regarding U.S. Appl. No. 11/776,879, dated Sep. 17, 2010.
First Office Action from The State Intellectual Property Office of the People's Republic of China regarding Chinese Patent Application No. 200890100287.3, dated Oct. 25, 2010. Translation provided by Unitalen Attorneys at Law.
Non-Final Office Action regarding U.S. Appl. No. 12/261,643, dated Jan. 27, 2011.

(56) References Cited

OTHER PUBLICATIONS

First Office Action regarding Chinese Patent Application No. 200780032977.X, dated Sep. 27, 2010. English translation provided by Unitalen Attorneys at Law.
Official Action regarding Australian Patent Application No. 2008325240, dated Jan. 19, 2011.
Second Office Action regarding Chinese Patent Application No. 200890100287.3, dated Jan. 27, 2011. English translation provided by Unitalen Attorneys at Law.
First Office Action regarding Chinese Patent Application No. 201010117657.8, dated Dec. 29, 2010. English translation provided by Unitalen Attorneys at Law.
Non-Final Office Action dated Mar. 3, 2011 for U.S. Appl. No. 12/054,011.
Final Office Action dated Dec. 7, 2010 for U.S. Appl. No. 12/054,011.
Non-Final Office Action dated Aug. 13, 2010 for U.S. Appl. No. 12/054,011.
International Search Report for International Application No. PCT/US2008/009618, dated Dec. 8, 2008.
Written Opinion of International Searching Authority for International Application No. PCT/US2008/009618, dated Dec. 8, 2008.
International Preliminary Report on Patentability for International Application No. PCT/US2008/009618, dated Mar. 24, 2010.
First Office Action issued by the Chinese Patent Office for Application No. 200480015875.3, dated Sep. 5, 2008.
Second Office Action issued by the Chinese Patent Office for Application No. 200480015875.3, dated Feb. 27, 2009.
BChydro, "Power Factor" Guides to Energy Management: The GEM Series, Oct. 1999.
European Search Report for Application No. EP 06 02 6263, dated Jul. 17, 2007, 4 Pages.
European Search Report for Application No. EP 04 81 5853, dated Jul. 17, 2007, 2 Pages.
European Search Report for Application No. EP 02 25 1531, dated Sep. 30, 2002.
International Search Report for International Application No. PCT/US04/43859, dated Mar. 2, 2006.
European Search Report for Application No. EP 01 30 1752, dated Mar. 26, 2002.
Final Office Action for U.S. Appl. No. 12/054,011, dated Jun. 30, 2011.
First Office Action regarding Chinese Application No. 200880106319.5, dated May 25, 2011. English translation provided by Unitalen Attorneys at Law.
Final Office Action regarding U.S. Appl. No. 12/261,643, dated Jul. 7, 2011.
Office Action regarding U.S. Appl. No. 12/261,677, dated Aug. 4, 2011.
Third Office Action regarding Chinese Application No. 2005100059078 from the State Intellectual Property Office of People's Republic of China, dated Aug. 24, 2011. Translation provided by Unitalen Attorneys at Law.
Office Action regarding U.S. Appl. No. 12/261,643, dated Nov. 2, 2011.
Fourth Office Action from the State Intellectual Property Office of People's Republic of China regarding Chinese Patent Applicaiton No. 200510005907.8, dated Dec. 8, 2011. Translation provided by Unitalen Attorneys at Law.
Non-Final Office Action for U.S. Appl. No. 12/054,011, dated Oct. 20, 2011.
Non-Final Office Action in U.S. Appl. No. 12/685,375, dated Jan. 19, 2012.
Notice of Allowance regarding U.S. Appl. No. 12/261,677, dated Dec. 15, 2011.
Office Action regarding U.S. Appl. No. 12/261,643, dated Feb. 15, 2012.
Non-Final Office Action for U.S. Appl. No. 11/776,879, dated Mar. 16, 2012.
Examiner's Report No. 2 regarding Australian Patent Application No. 2008325240, dated Mar. 5, 2012.
Non-Final Office Action for U.S. Appl. No. 12/054,011, dated Apr. 10, 2012.
Non-Final office Action regarding U.S. Appl. No. 11/850,846, dated Apr. 24, 2012.
Non-Final Office Action regarding U.S. Appl. No. 13/176,021, dated May 8, 2012.
First Office Action regarding Chinese Patent Application No. 200910211779.0, dated May 3, 2012. English translation provided by Unitalen Attorneys at Law.
Final Office Action regarding U.S. Appl. No. 12/261,643, dated Jun. 27, 2012.
Patent Examination Report No. 3 regarding Australian Patent Application No. 2008325240, dated Jul. 19, 2012.
Final Office Action for U.S. Appl. No. 11/850,846, dated Aug. 13, 2012.
Notice of Allowance regarding U.S. Appl. No. 11/776,879, dated Jul. 9, 2012.
Non-Final Office Action for U.S. Appl. No. 12/685,375, dated Aug. 6, 2012.
European Search Report regarding Application No. 04022784.5-2315 / 1500821, dated Aug. 14, 2012.
Examiner's First Report on Australian Patent Application No. 2007292917 dated Jan. 10, 2012.
Examiner's First Report on Australian Patent Application No. 2008319275, dated Jan. 31, 2011.
Non-Final Office Action for U.S. Appl. No. 13/030,549, dated Nov. 5, 2012.
Extended European Search Report regarding Application No. 12182243.1-2311, dated Oct. 29, 2012.
Notification of First Office Action from the State Intellectual Property Office of People's Republic of China regarding Chinese Patent Application No. 200880122964.6, dated Nov. 5, 2012. Translation provided by Unitalen Attorneys at Law.
Examiner's Answer regarding U.S. Appl. No. 09/977,552, dated Dec. 17, 2009.
Record of Oral Hearing regarding U.S. Appl. No. 09/977,552, dated Nov. 29, 2012.
European Search Report for Application No. EP 12 182 243.1, dated Oct. 29, 2012.
Second Office Action regarding Chinese Patent Application No. 200910211779.0, dated Feb. 4, 2013. English translation provided by Unitalen Attorneys at Law.
Non-Final Office Action regarding U.S. Appl. No. 12/261,643, dated Mar. 12, 2013.
International Search Report regarding Application No. PCT/US2013/021161, dated May 8, 2013.
Written Opinion of the International Searching Authority regarding Application No. PCT/US2013/021161, dated May 8, 2013.
Non-Final Office Action in U.S. Appl. No. 11/850,846, dated May 24, 2013.
Non-Final Office Action regarding U.S. Appl. No. 13/770,123, dated Jul. 3, 2013.
Third Office Action regarding Chinese Patent Application No. 200910211779.0, dated Sep. 4, 2013. English translation provided by Unitalen Attorneys at Law.
Final Office Action regarding U.S. Appl. No. 12/261,643, dated Sep. 16, 2013.
First Examination Report regarding Australian Patent Application No. 2012241185, dated Sep. 27, 2013.
Advisory Action regarding U.S. Appl. No. 12/261,643, dated Nov. 22, 2013.
Final Office Action regarding U.S. Appl. No. 13/770,123, dated Nov. 15, 2013.
Notice of Grounds for Refusal regarding Korean Patent Application No. 10-2009-7000850, dated Oct. 4, 2013. English translation provided by Y.S. Chang & Associates.
First Office Action regarding Chinese Patent Application No. 201110349785.X, dated Nov. 21, 2013, and Search Report. English translation provided by Unitalen Attorneys at Law.
Non-Final Office Action regarding U.S. Appl. No. 13/932,611, dated Nov. 25, 2013.
European Search Report regarding Application No. 07811712.4-1608 / 2069638 PCT/US2007019563, dated Jan. 7, 2014.

(56) References Cited

OTHER PUBLICATIONS

Office Action regarding U.S. Appl. No. 13/737,566, dated Dec. 20, 2013.
Fourth Office Action regarding Chinese Patent Application No. 200910211779.0, dated Jan. 6, 2014. English translation provided by Unitalen Attorneys at Law.
Final Office Action regarding U.S. Appl. No. 11/850,846, dated Jan. 17, 2014.
Non-Final Office Action regarding U.S. Appl. No. 13/770,479, dated Jan. 16, 2014.
Non-Final Office Action regarding U.S. Appl. No. 13/784,890, dated Jun. 11, 2013.
Final Office Action regarding U.S. Appl. No. 13/784,890, dated Dec. 30, 2013.
Supplementary European Search Report regarding Application No. EP 07 81 1712, dated Jan. 7, 2014.
Final Office Action regarding U.S. Appl. No. 13/932,611, dated May 28, 2014.
International Search Report from related PCT Application No. PCT/US2014/028074 dated Jun. 19, 2014.
Written Opinion from related PCT Application No. PCT/US2014/028074 dated Jun. 19, 2014.
Restriction Requirement regarding U.S. Appl. No. 11/776,879, dated Jun. 4, 2010.
Interview Summary regarding U.S. Appl. No. 12/054,011, dated Jan. 30, 2012.
Advisory Action from related U.S. Appl. No. 13/784,890 dated Mar. 14, 2014.
Examiner's Answer from related U.S. Appl. No. 13/784,890 dated Jul. 3, 2014.
Invitation to Indicate Claims to be Searched regarding European Patent Application No. 07 796 879.0, dated Feb. 20, 2013.
Written Opinion of the International Searching Authority regarding Application No. PCT/US2007/016135, dated Oct. 22, 2007.
"Small-type Freezing and Air Conditioning Operation," Chinese State Economy and Trading Committee, China Meteorological Press, Mar. 2003 (cited in First Office Action issued by the Chinese Patent Office regarding Application No. 200780030810.X dated Dec. 25, 2009).
Office Action regarding U.S. Appl. No. 14/193,568, dated Nov. 3, 2015.
Notice of Allowance and Fees Due regarding U.S. Appl. No. 13/737,566, dated Jun. 18, 2014.
Non-Final Office Action regarding U.S. Appl. No. 13/770,123, dated Jun. 11, 2014.
Reh, F. John, "Cost Benefit Analysis", http://management.about.com/cs/money/a/CostBenefit.htm, Dec. 8, 2003.
Udelhoven, Darrell, "Air Conditioning System Sizing for Optimal Efficiency," http://www.udarrell.com/ airconditioning-sizing.html, Oct. 6, 2003, 7 pages.
Texas Instruments, Inc., Product catalog for "TRF690 1 Single-Chip RF Transceiver," Copyright 2001-2003, Revised Oct. 2003, 27 pages.
Advanced Utility Metering: Period of Performance, Subcontractor Report, National Renewable Energy Laboratory, Sep. 2003, 59 pages.
Honeywell, Advanced Portable A/C Diagnostics, The HVAC Service Assistant, 2003.
Vandenbrink et al.,"Design of a Refrigeration Cycle Evaporator Unit," Apr. 18, 2003.
Udelhoven, Darrell, "Air Conditioner EER, SEER Ratings, BTUH Capacity Ratings, & Evaporator Heat Load," http://www.udarrell.com/air-conditioner-capacity-seer.html, Apr. 3, 2003, 15 pages.
The Honeywell HVAC Service Assistant, A Tool for Reducing Electrical Power Demand and Energy Consumption, Field Diagnostics, 2003.
Trane EarthWise™ CenTra Vac™ Water-Cooled Liquid Chillers 165-3950 Tons 50 and 60 Hz; CTV PRC007-EN; Oct. 2002; 56 pages.
Honeywell, HVAC Service Assistant, TRGpro PalmTM OS Interface and HVAC Service Assistant A7075A1000, 2002.
"Air Conditioning Equipment and Diagnostic Primer," Field Diagnostic Services, Inc., Sep. 9, 2002.
Udelhoven, Darrell, "Optimizing Air Conditioning Efficiency TuneUp Optimizing the Condensor Output, Seer, Air, HVAC Industry," http://www.udarrell.com/air-conditioning-efficiency.html, Jul. 19, 2002, 13 pages.
Honeywell, A7075A1000 HVAC Service Assistant, 2001.
LIPA Launches Free, First-in-Nation Internet-Based Air Conditioner Control Program to Help LIPA and Its Customers Conserve Electricity & Save Money, Apr. 19, 2001, http://www.lipower.org/newscmter/pr/2001/aprill9_01.html, 3 pages.
K. A. Manske et al.; Evaporative Condenser Control in Industrial Refrigeration Systems; University of Wisconsin—Madison, Mechanical Engineering Department; International Journal of Refrigeration, vol. 24, No. 7; pp. 676-691; 2001, 21 pages.
Flow & Level Measurement: Mass Flowmeters, http://www.omega.com/literature/transactions/volume4/T9904-10-MASS.html, 2001, 19 pages.
Frequently Asked Questions, http://www.lipaedge.com/faq.asp, Copyright © 2001, 5 pages.
Liao et al., A Correlation of Optimal Heat Rejection Pressures in Transcritical Carbon Dioxide Cycles, Applied Thermal Engineering 20 (2000), Jul. 25, 1999, 831-841.
Low-Cost Multi-Service Home Gateway Creates New Business Opportunities, Coactive Networks, Copyright 1998-1999, 7 pages.
Pin, C. et al., "Predictive Models as Means to Quantify the Interactions of Spoilage Organisms," International Journal of Food Microbiology, vol. 41, No. 1, 1998, pp. 59-72, XP-002285119.
Watt, James; Development of Empirical Temperature and Humidity-Based Degraded-Condition Indicators for Low-Tonnage Air Conditioners; ESL-TH-97/12-03; Dec. 1997.
Texas Instruments, Inc. Mechanical Data for "PT (S-PQFP-G48) Plastic Quad Flatpack," Revised Dec. 1996, 2 pages.
Honeywell, Excel 5000® System, Excel Building Supervisor, 74-2033-1, Copyright © 1996, Rev. 6-96, 12 pages.
UltraSite User's Guide, Computer Process Controls, Apr. 1, 1996.
Honeywell, Excel 5000® System, Excel Building Supervisor-Integrated, 74-2034, Copyright © 1994, Rev. 11-94, 12 pages.
Tamarkin, Tom D., "Automatic Meter Reading," Public Power magazine, vol. 50, No. 5, Sep.-Oct. 1992, http://www.energycite.com/news/amr.html, 6 pages.
Palani, M. et al, The Effect of Reducted Evaporator Air Flow on the Performance of a Residential Central Air Conditioner, ESL-HH-92-05-04, Energy Systems Laboratory, Mechanical Engineering Department, Texas A&M University, Eighth Symposium on Improving Building System in Hot and Humid Climates, May 13-14, 1992.
Palani, M. et al, Monitoring the Performance of a Residential Central Air Conditioner under Degraded Conditions on a Test Bench, ESL-TR-92/05-05, May 1992.
European Search Report for EP 82306809.3; dated Apr. 28, 1983; 1 Page.
European Search Report for EP 91 30 3518; dated Jul. 22, 1991; 1 Page.
European Search Report for EP 93 30 4470; dated Oct. 26, 1993; 1 Page.
International Search Report; International Application No. PCT/IB96/01435; dated May 23, 1997; 1 Page.
European Search Report for EP 96 30 4219; dated Dec. 1, 1998; 2 Pages.
International Search Report; International Application No. PCT/US98/18710; dated Jan. 26, 1999; 1 Page.
European Search Report for EP 94 30 3484; dated Apr. 3, 1997; 1 Page.
European Search Report for EP 98 30 3525; dated May 28, 1999; 2 Pages.
European Search Report for EP 99 30 6052; dated Dec. 28, 1999; 3 Pages.
European Search Report for EP 01 30 7547; dated Feb. 20, 2002; 1 Page.
Advisory Action regarding U.S. Appl. No. 11/214,179, dated Aug. 28, 2009.

(56) References Cited

OTHER PUBLICATIONS

Communication from European Patent Office concerning Substantive Examination regarding European Patent Application No. 06790063.9, dated Jun. 6, 2011.
European Search Report for EP 02 25 0266; dated May 17, 2002; 3 Pages.
European Search Report for EP 02 72 9050, dated Jun. 17, 2004, 2 pages.
European Search Report regarding Application No. EP02729051, dated Feb. 17, 2005.
Examination Report received from Australian Government IP Australia dated Oct. 29, 2009 regarding patent application No. 2008202088.
Examiner Interview regarding U.S. Appl. No. 11/256,641, dated Sep. 16, 2008.
Examiner Interview Summary regarding U.S. Appl. No. 11/394,380, dated Jul. 29, 2010.
Examiner Interview Summary regarding U.S. Appl. No. 10/940,877, dated Dec. 8, 2008.
Examiner Interview Summary regarding U.S. Appl. No. 10/940,877, dated Mar. 2, 2007.
Examiner Interview Summary regarding U.S. Appl. No. 10/940,877, dated Mar. 25, 2008.
Examiner-Initiated Interview Summary regarding U.S. Appl. No. 11/214,179, dated Dec. 11, 2009.
Examiner's First Report on Australian Patent Application No. 2002259066, dated Mar. 1, 2006.
Extended European Search Report regarding Application No. 07796879.0-1602 / 2041501 PCT/US2007016135, dated Jul. 14, 2014.
Final Office Action from related U.S. Appl. No. 13/269,188 dated May 23, 2013; 11 pages.
Final Office Action from related U.S. Appl. No. 13/369,067 dated May 1, 2014; 19 pages.
Final Office Action from related U.S. Appl. No. 13/767,479 dated Mar. 14, 2014; 6 pages.
Final Office Action from related U.S. Appl. No. 13/836,043 dated Mar. 12, 2014; 5 pages.
Final Office Action regarding U.S. Appl. No. 11/497,579, dated May 14, 2010.
Final Office Action regarding U.S. Appl. No. 11/497,644, dated Dec. 22, 2010.
Final Office Action regarding U.S. Appl. No. 11/214,179, dated Jul. 21, 2011.
Final Office Action regarding U.S. Appl. No. 10/061,964, dated Mar. 8, 2004.
Final Office Action regarding U.S. Appl. No. 10/940,877, dated Nov. 13, 2007.
Final Office Action regarding U.S. Appl. No. 10/940,877, dated Apr. 27, 2009.
Final Office Action regarding U.S. Appl. No. 10/940,877, dated May 2, 2006.
Final Office Action regarding U.S. Appl. No. 11/214,179, dated May 29, 2009.
Final Office Action regarding U.S. Appl. No. 11/256,641, dated Feb. 2, 2009.
Final Office Action regarding U.S. Appl. No. 11/337,918, dated Feb. 17, 2011.
Final Office action regarding U.S. Appl. No. 11/337,918, dated Feb. 4, 2010.
First Examination Communication regarding European Application No. EP02729051.9, dated Dec. 23, 2005.
First Examination Report regarding Australian Patent Application No. 2010319488, dated Jan. 10, 2013.
First Office Action from the Patent Office of the People's Republic of China dated Jun. 8, 2007, Application No. 200480027753.6 and Translation provided by CCPIT.
First Office Action received from the Chinese Patent Office dated Feb. 2, 2007 regarding Application No. 200480011463.2, translated by CCPIT Patent and Trademark Law Office.
First Office Action regarding Canadian Patent Application No. 2,777,349, dated Jul. 19, 2013.
First Official Report regarding Australian Patent Application No. 2007214381, dated Dec. 12, 2008.
International Preliminary Examination Report regarding PCT/US02/13456, dated Sep. 15, 2003.
International Preliminary Report on Patentability regarding Application No. PCT/US2010/056315, dated May 24, 2012.
International Search Report and Written Opinion of the International Searching Authority regarding International Application No. PCT/US06/33702, dated Sep. 26, 2007.
International Search Report for International Application No. PCT/US07/019563, dated Jan. 15, 2008, 3 pages.
International Search Report for PCT/US02/13459; ISA/US; dated Sep. 19, 2002.
International Search Report for PCT/US2012/026973, dated Sep. 3, 2012, 5 pages.
International Search Report for PCT/US2013/061389, dated Jan. 22, 2014, 7 pages.
International Search Report from PCT /US2008/060900, dated Aug. 4, 2008, 6 pages.
International Search Report regarding Application No. PCT/US2010/036601, dated Dec. 29, 2010.
International Search Report regarding Application No. PCT/US2010/056315, dated Jun. 28, 2011.
International Search Report, International Application No. PCT/US02/13456, dated Aug. 22, 2002, 2 Pages.
International Search Report, International Application No. PCT/US04/13384; dated Aug. 1, 2004; 1 Page.
International Search Report, International Application No. PCT/US2004/027654, dated Aug. 25, 2004, 4 Pages. cited by other.
International Search Report, International Application No. PCT/US2006/040964, dated Feb. 15, 2007, 2 Pages.
International Search Report, Int'l. App. No. PCT/US 06/05917, dated Sep. 26, 2007.
Interview Summary from related U.S. Appl. No. 12/054,011 dated Jan. 30, 2012.
Interview Summary regarding U.S. Appl. No. 11/497,644, dated May 4, 2010.
Interview Summary regarding U.S. Appl. No. 11/214,179, dated Jan. 30, 2009.
Interview Summary regarding U.S. Appl. No. 11/497,579, dated Jul. 15, 2010.
Issue Notification regarding U.S. Appl. No. 11/214,179, dated Mar. 14, 2012.
Non Final Office Action for related U.S. Appl. No. 13/369,067 dated Aug. 12, 2014.
Non Final Office Action for related U.S. Appl. No. 13/835,621 dated Aug. 8, 2014.
Non Final Office Action from related U.S. Appl. No. 13/269,188 dated Aug. 14, 2012; 9 pages.
Non Final Office Action from related U.S. Appl. No. 13/269,188 dated Oct. 4, 2013; 11 pages.
Non Final Office Action from related U.S. Appl. No. 13/269,188 dated Feb. 20, 2014; 9 pages.
Non Final Office Action from related U.S. Appl. No. 13/269,188 dated Jul. 17, 2014; 10 pages.
Non Final Office Action from related U.S. Appl. No. 13/369,067 dated Jan. 16, 2014; 16 pages.
Non Final Office Action from related U.S. Appl. No. 13/767,479 dated Oct. 24, 2013; 8 pages.
Non Final Office Action from related U.S. Appl. No. 13/767,479 dated Jul. 23, 2014; 9 pages.
Non Final Office Action from related U.S. Appl. No. 13/835,621 dated Oct. 30, 2013; 8 pages.
Non Final Office Action from related U.S. Appl. No. 13/835,621 dated Arp. 2, 2014; 11 pages.
Non Final Office Action from related U.S. Appl. No. 13/835,742 dated Oct. 7, 2013; 9 pages.
Non Final Office Action from related U.S. Appl. No. 13/835,810 dated Nov. 15, 2013; 9 pages.
Non Final Office Action from related U.S. Appl. No. 13/836,043 dated Oct. 23, 2013; 8 pages.
Non Final Office Action from related U.S. Appl. No. 13/836,043 dated Jul. 11, 2014; 5 pages.

(56) References Cited

OTHER PUBLICATIONS

Non Final Office Action from related U.S. Appl. No. 13/836,244 dated Oct. 15, 2013; 11 pages.
Non Final Office Action from related U.S. Appl. No. 13/836,244 dated Feb. 20, 2014; 10 pages.
Non Final Office Action from related U.S. Appl. No. 13/836,453 dated Aug. 20, 2013; 8 pages.
Non-Final Office Action in U.S. Appl. No. 13/784,890, dated Jun. 11, 2013.
Non-Final Office Action regarding U.S. Appl. No. 11/214,179, dated Jan. 24, 2011.
Non-Final Office Action regarding U.S. Appl. No. 11/214,179, dated Nov. 5, 2008.
Non-Final Office Action regarding U.S. Appl. No. 11/214,179, dated Jun. 8, 2010.
Non-Final Office Action regarding U.S. Appl. No. 12/943,626, dated Dec. 20, 2012.
Non-Final Office Action regarding U.S. Appl. No. 12/955,355, dated Sep. 11, 2012.
Non-Final Office Action regarding U.S. Appl. No. 13/435,543, dated Jun. 21, 2012.
Notice of Allowance and Fee(s) Due regarding U.S. Appl. No. 12/789,562, dated Oct. 26, 2012.
Notice of Allowance and Fees Due and Notice of Allowability regarding U.S. Appl. No. 11/256,641, dated May 19, 2009.
Notice of Allowance and Fees Due regarding U.S. Appl. No. 12/261,643, dated Jun. 23, 2014.
Notice of Allowance and Fees Due, Interview Summary and Notice of Allowability regarding U.S. Appl. No. 11/214,179, dated Nov. 23, 2011.
Notice of Allowance and Notice of Allowability regarding U.S. Appl. No. 10/286,419, dated Dec. 2, 2004.
Notice of Allowance and Notice of Allowability regarding U.S. Appl. No. 10/675,137, dated Dec. 16, 2005.
Notice of Allowance dated Dec. 21, 2007 from Related U.S. Appl. No. 11/417,609.
Notice of Allowance dated Dec. 3, 2007 from Related U.S. Appl. No. 11/130,562.
Notice of Allowance dated Feb. 12, 2007 from Related U.S. Appl. No. 11/130,871 (Kates.002A).
Notice of Allowance dated Jul. 13, 2006 from Related U.S. Appl. No. 11/130,601 (Kates.020A).
Notice of Allowance dated Jul. 25, 2007 from Related U.S. Appl. No. 10/916,223 (Kates.003A).
Notice of Allowance dated Jun. 11, 2007 from Related U.S. Appl. No. 10/916,222.
Notice of Allowance dated May 29, 2007 from Related U.S. Appl. No. 11/130,569 (Kates.022A).
Notice of Allowance dated Nov. 3, 2008 from Related U.S. Appl. No. 11/417,701.
Notice of Allowance dated Oct. 26, 2007 from Related U.S. Appl. No. 10/916,223.
Notice of Allowance for related U.S. Appl. No. 13/835,810 dated Aug. 5, 2014.
Notice of Allowance for U.S. Appl. No. 10/698,048, dated Sep. 1, 2005.
Notice of Allowance from related U.S. Appl. No. 13/835,742 dated Jan. 31, 2014; 7 pages.
Notice of Allowance from related U.S. Appl. No. 13/835,742 dated Jun. 2, 2014; 8 pages.
Notice of Allowance from related U.S. Appl. No. 13/835,810 dated Mar. 20, 2014; 9 pages.
Notice of Allowance from related U.S. Appl. No. 13/836,453 dated Jan. 14, 2014; 8 pages.
Notice of Allowance from related U.S. Appl. No. 13/836,453 dated Apr. 21, 2014; 8 pages.
Notice of Allowance from related U.S. Appl. No. 13/836,453 dated Aug. 4, 2014.
Notice of Allowance from related U.S. Appl. No. 13/836,244 dated Jul. 2, 2014; 8 pages.
Notice of Allowance regarding U.S. Appl. No. 10/061,964, dated Jul. 19, 2004.
Notice of Allowance regarding U.S. Appl. No. 10/940,877, dated Sep. 4, 2009.
Notice of Allowance regarding U.S. Appl. No. 12/685,424, dated Apr. 25, 2011.
Notice of Allowance regarding U.S. Appl. No. 13/303,286, dated Jul. 19, 2012.
Office Action dated Apr. 19, 2006 from Related U.S. Appl. No. 10/916,223 (Kates.003A).
Office Action dated Aug. 17, 2007 from Related U.S. Appl. No. 11/417,609.
Office Action dated Aug. 17, 2007 from Related U.S. Appl. No. 11/417,701.
Office Action dated Aug. 21, 2007 from Related U.S. Appl. No. 11/417,557.
Office Action dated Feb. 1, 2007 from Related U.S. Appl. No. 11/130,562 (Kates.021A).
Office Action dated Feb. 13, 2009 from Related U.S. Appl. No. 12/033,765.
Office Action dated Feb. 13, 2009 from Related U.S. Appl. No. 12/050,821.
Office Action dated Feb. 15, 2008 from Related U.S. Appl. No. 11/417,557.
Office Action dated Feb. 3, 2009 from Related U.S. Appl. No. 11/866,295.
Office Action dated Jan. 18, 2006 from Related U.S. Appl. No. 11/130,601 (Kates.020A).
Office Action dated Jan. 18, 2006 from Related U.S. Appl. No. 11/130,871 (Kates.002A).
Office Action dated Jan. 23, 2007 from Related U.S. Appl. No. 10/916,222.
Office Action dated Jan. 6, 2006 from Related U.S. Appl. No. 11/130,562 (Kates.021A).
Office Action dated Jan. 6, 2006 from Related U.S. Appl. No. 10/916,222.
Office Action dated Jul. 1, 2008 from Related U.S. Appl. No. 11/927,425.
Office Action dated Jul. 11, 2006 from Related U.S. Appl. No. 11/130,562 (Kates.021A).
Office Action dated Jul. 11, 2006 from Related U.S. Appl. No. 10/916,222.
Office Action dated Jul. 11, 2007 from Related U.S. Appl. No. 11/417,609 (Kates.021DV1).
Office Action dated Jul. 11, 2007 from Related U.S. Appl. No. 11/417,701 (Kates.020DV1).
Office Action dated Jul. 16, 2008 from Related U.S. Appl. No. 11/417,701.
Office Action dated Jul. 24, 2008 from Related U.S. Appl. No. 11/417,557.
Office Action dated Jul. 27, 2006 from Related U.S. Appl. No. 11/130,871 (Kates.002A).
Office Action dated Jun. 17, 2009 from Related U.S. Appl. No. 12/033,765.
Office Action dated Jun. 19, 2009 from Related U.S. Appl. No. 11/866,295.
Office Action dated Jun. 22, 2009 from Related U.S. Appl. No. 12/050,821.
Office Action dated Jun. 27, 2007 from Related U.S. Appl. No. 11/417,557 (Kates.012DV1).
Office Action dated Mar. 30, 2006 from Related U.S. Appl. No. 11/130,569 (Kates.022A).
Office Action dated May 4, 2005 from Related U.S. Appl. No. 10/916,223 (Kates.003A).
Office Action dated May 6, 2009 from Related U.S. Appl. No. 11/830,729.
Office Action dated Nov. 14, 2006 from Related U.S. Appl. No. 11/130,569 (Kates.022A).
Office Action dated Nov. 16, 2006 from Related U.S. Appl. No. 10/916,223 (Kates.003A).
Office Action dated Nov. 8, 2005 from Related U.S. Appl. No. 10/916,222.

(56) References Cited

OTHER PUBLICATIONS

Office Action dated Nov. 9, 2005 from Related U.S. Appl. No. 11/130,562 (Kates.021A).
Office Action dated Nov. 9, 2005 from Related U.S. Appl. No. 11/130,601 (Kates.020A).
Office Action dated Nov. 9, 2005 from Related U.S. Appl. No. 11/130,871 (Kates.002A).
Office Action dated Oct. 27, 2005 from Related U.S. Appl. No. 10/916,223 (Kates.003A).
Office Action dated Sep. 18, 2007 from Related U.S. Appl. No. 11/130,562.
Office Action for U.S. Appl. No. 11/394,380, dated Jan. 6, 2009.
Office Action for U.S. Appl. No. 11/497,579, dated Oct. 27, 2009.
Office Action for U.S. Appl. No. 11/497,644, dated Dec. 19, 2008.
Office Action for U.S. Appl. No. 11/497,644, dated Jul. 10, 2009.
Office Action regarding U.S. Appl. No. 10/286,419, dated Jun. 10, 2004.
Office Action regarding U.S. Appl. No. 11/120,166, dated Oct. 2, 2006.
Office Action regarding U.S. Appl. No. 11/120,166, dated Oct. 2, 2007.
Office Action regarding U.S. Appl. No. 11/120,166, dated Dec. 15, 2008.
Office Action regarding U.S. Appl. No. 11/120,166, dated Feb. 17, 2010.
Office Action regarding U.S. Appl. No. 11/120,166, dated Apr. 12, 2007.
Office Action regarding U.S. Appl. No. 11/120,166, dated Jun. 5, 2008.
Office Action regarding U.S. Appl. No. 11/120,166, dated Jul. 20, 2009.
Office Action regarding U.S. Appl. No. 11/394,380, dated Sep. 25, 2009.
Office Action regarding U.S. Appl. No. 11/497,644, dated Jan. 29, 2010.
Office Action regarding U.S. Appl. No. 11/497,644, dated Jun. 14, 2010.
Office Action regarding U.S. Appl. No. 10/061,964, dated Oct. 3, 2003.
Office Action regarding U.S. Appl. No. 10/675,137, dated Feb. 4, 2005.
Office Action regarding U.S. Appl. No. 10/675,137, dated Jun. 29, 2005.
Office Action regarding U.S. Appl. No. 10/675,137, dated Sep. 7, 2004.
Office Action regarding U.S. Appl. No. 10/698,048, dated Mar. 21, 2005.
Office Action regarding U.S. Appl. No. 10/940,877, dated Oct. 27, 2006.
Office Action regarding U.S. Appl. No. 10/940,877, dated Nov. 14, 2005.
Office Action regarding U.S. Appl. No. 10/940,877, dated Dec. 8, 2008.
Office Action regarding U.S. Appl. No. 10/940,877, dated May 21, 2007.
Office Action regarding U.S. Appl. No. 10/940,877, dated Jun. 5, 2008.
Office Action regarding U.S. Appl. No. 11/256,641, dated Apr. 29, 2008.
Office Action regarding U.S. Appl. No. 11/337,918, dated Mar. 25, 2008.
Office Action regarding U.S. Appl. No. 11/337,918, dated Aug. 17, 2009.
Office Action regarding U.S. Appl. No. 11/337,918, dated Oct. 28, 2008.
Office Action regarding U.S. Appl. No. 13/303,286, dated Mar. 26, 2012.
Restriction from related U.S. Appl. No. 13/269,188 dated Apr. 9, 2013; 5 pages.
Restriction Requirement regarding U.S. Appl. No. 10/940,877, dated Jul. 25, 2005.
Restriction Requirement regarding U.S. Appl. No. 11/214,179, dated Feb. 2, 2010.
Second Examination Communication regarding European Application No. EP02729051.9, dated Jul. 3, 2006.
Second Office Action received from the Chinese Patent Office dated Jun. 26, 2009 regarding Application No. 200480011463.2, translated by CCPIT Patent and Trademark Law Office.
Second Official Report regarding Australian Patent Application No. 2007214381, dated Oct. 30, 2009.
Supplementary European Search Report for EP 02 73 1544, dated Jun. 18, 2004, 2 Pages.
Supplementary European Search Report regarding Application No. PCT/US2006/005917, dated Nov. 23, 2009.
Supplementary European Search Report regarding European Application No. EP06790063, dated Jun. 15, 2010.
Written Opinion of the International Searching Authority regarding Application No. PCT/US2010/036601, dated Dec. 29, 2010.
Written Opinion of the International Searching Authority, Int'l. App. No. PCT/US 06/05917, dated Sep. 26, 2007.
Written Opinion regarding PCT/US02/13459, dated Apr. 23, 2003.
About CABA: CABA eBulletin, http://www.caba.org/aboutus/ebulletin/issue17/domosys.html, 2 pages, dated Sep. 22, 2004.
Case Studies: Automated Meter Reading and Load Shed System, http://groupalpha.corn/CaseStudies2.html, Aug. 23, 2004, 1 page.
Cost Cutting Techniques Used by the Unscrupulous, http://www.kellyshvac.com/howto.html, Oct. 7, 2004, 3 pages.
Home Comfort Zones, MyTemp Room-by-Room Zone Control, Nov. 2009.
Home Comfort Zones, MyTemp User Manual v4.3, May 2008.
Home Comfort Zones, Save Energy with MyTemp™ Zone Control, Dec. 2009.
Home Comfort Zones, Smart Controller™ MyTemp™ Room by Room Temperature Control and Energy Management, User Manual, Aug. 2007.
Honeywell, Alerts and Delta T Diagnostics with Prestige® 2.0 IAQ Thermostat, 69-2678-02, Sep. 2011.
Honeywell, Prestige System Installation Guide, THX9321/9421 Prestige® IAQ and RF EIM, 64-2490-03, Jul. 2011.
Honeywell, RedLINK™ Wireless Comfort Systems brochure, 50-1194, Sep. 2011.
HVAC Service Assistant, ACRx Efficiency and Capacity Estimating Technology, Field Diagnostics, 2004.
Jeffus, Larry, "Refrigeration and Air Conditioning: An Introduction to HVAC/R," Appendix C, pp. 1060-1063, Copyright 2004.
Jeffus, Larry, "Refrigeration and Air Conditioning: An Introduction to HVAC/R," Section II, Chapter 4, pp. 176-201, Copyright 2004.
Jeffus, Larry, "Refrigeration and Air Conditioning: An Introduction to HVAC/R," Section II, Chapter 5, pp. 239-245, Copyright 2004.
Jeffus, Larry, "Refrigeration and Air Conditioning: An Introduction to HVAC/R," Section II, Chapter 6, p. 322, Copyright 2004.
Jeffus, Larry, "Refrigeration and Air Conditioning: An Introduction to HVAC/R," Section IV, Chapter 9, pp. 494-504, Copyright 2004.
Li et al., "Development, Evaluation, and Demonstration of a Virtual Refrigerant Charge Sensor," Jan. 2009, HVAC&R Research, Oct. 27, 2008, 21 pages.
Nickles, Donald, "Broadband Communications Over Power Transmission Lines," A Guest Lecture From the Dr. Shreekanth Mandaynam Engineering Frontiers Lecture Series, May 5, 2004, 21 pages.
The LS2000 Energy Management System, User Guide, http://www.surfnetworks.com/htmlmanuals/IonWorksEnergyManagement-LS2000-Load-Shed -System-by-Surf-Networks,Inc.html, Sep. 2004, 20 pages.
Torcellini, P., et al., "Evaluation of the Energy Performance and Design Process of the Thermal Test Facility at the National Renewable Energy Laboratory", dated Feb. 2005.
Written Opinion of the International Searching Authority regarding Application No. PCT/US2012/026973, dated Sep. 3, 2012.
International Search Report and Written Opinion of the ISA regarding International Application No. PCT/US2014/032927, ISA/KR dated Aug. 21, 2014.

(56) References Cited

OTHER PUBLICATIONS

Written Opinion of the International Searching Authority regarding Application No. PCT/US2013/061389, dated Jan. 22, 2014.
Notice of Allowance and Fees Due regarding U.S. Appl. No. 12/943,626, dated Jun. 19, 2014.
Notice of Allowance for related U.S. Appl. No. 13/836,043, dated Oct. 9, 2014.
Notice of Allowance for related U.S. Appl. No. 13/836,244, dated Oct. 30, 2014.
Office Action for related U.S. Appl. No. 13/269,188, dated Oct. 6, 2014.
Office Action for related U.S. Appl. No. 13/767,479, dated Oct. 21, 2014.
International Search Report and Written Opinion for related PCT Application No. PCT/US2014/028859, dated Aug. 22, 2014.
Non Final Office Action for U.S. Appl. No. 13/407,180, dated Dec. 2, 2014.
Notice of Allowance and Fees Due regarding U.S. Appl. No. 13/737,566, dated Sep. 24, 2014.
Second Office Action from the State Intellectual Property Office of People's Republic of China regarding Chinese Patent Application No. 201110349785.X, dated Jul. 25, 2014. Translation provided by Unitalen Attorneys at Law.
Examiner's Report No. 1 regarding Australian Patent Application No. 2013202431, dated Nov. 25, 2014.
Patent Examination Report for Austrialian Application No. 2012223466 dated Jan. 6, 2015.
Notice of Allowance for U.S. Appl. No. 13/835,742 dated Dec. 24, 2014.
Notice of Allowance for U.S. Appl. No. 13/835,810 dated Jan. 2, 2015.
Notice of Allowance for U.S. Appl. No. 13/836,453 dated Dec. 24, 2014.
Office Action for U.S. Appl. No. 13/835,621 dated Dec. 29, 2014.
Final Office Action for U.S. Appl. No. 13/770,123 dated Dec. 22, 2014.
Notice of Allowance for U.S. Appl. No. 13/836,043 dated Feb. 4, 2015.
Office Action for U.S. Appl. No. 13/767,479 dated Feb. 6, 2015.
Office Action for U.S. Appl. No. 13/269,188 dated Feb. 10, 2015.
Office Action for Canadian Application No. 2,828,740 dated Jan. 12, 2015.
Third Chinese Office Action regarding Application No. 201110349785.X, dated Jan. 30, 2015. Translation provided by Unitalen Attorneys at Law.
Non-Final Office Action regarding U.S. Appl. No. 13/932,611, dated Jan. 30, 2015.
Notice of Allowance regarding U.S. Appl. No. 13/835,621, dated Mar. 10, 2015.
Interview Summary regarding U.S. Appl. No. 13/269,188, dated Mar. 18, 2015.
Final Office Action and Interview Summary regarding U.S. Appl. No. 13/407,180, dated Mar. 13, 2015.
Office Action regarding U.S. Appl. No. 13/770,479, dated Mar. 16, 2015.
Office Action regarding U.S. Appl. No. 13/770,123, dated Apr. 2, 2015.
Notice of Allowance regarding U.S. Appl. No. 13/767,479, dated Mar. 31, 2015.
Office Action from U.S. Appl. No. 13/369,067 dated Apr. 3, 2015.
Haiad et al., "EER & SEER as Predictors of Seasonal Energy Performance", Oct. 2004, Southern California Edison, http://www.doe2.com/download/DEER/SEER%2BProgThermostats/EER-SEER_CASE_ProjectSummary_Oct2004_V6a.pdf.
Notice of Allowance regarding U.S. Appl. No. 13/835,742, dated Apr. 17, 2015.
Notice of Allowance regarding U.S. Appl. No. 13/836,453, dated Apr. 15, 2015.
Advisory Action regarding U.S. Appl. No. 13/269,188, dated Apr. 13, 2015.
U.S. Office Action regarding U.S. Appl. No. 13/269,188, dated May 8, 2015.
U.S. Office Action regarding U.S. Appl. No. 14/212,632, dated May 15, 2015.
First Chinese Office Action regarding Application No. 201380005300.2, dated Apr. 30, 2015. Translation provided by Unitalen Attorneys at Law.
Advisory Action and Interview Summary regarding U.S. Appl. No. 13/407,180, dated May 27, 2015.
Interview Summary regarding U.S. U.S. Appl. No. 13/407,180, dated Jun. 11, 2015.
Interview Summary regarding U.S. Appl. No. 13/770,479, dated Jun. 16, 2015.
Extended European Search Report regarding European Application No. 08845689.2-1608/2207964, dated Jun. 19, 2015.
Extended European Search Report regarding European Application No. 08848538.8-1608 / 2220372, dated Jun. 19, 2015.
Notice of Allowance regarding U.S. Appl. No. 13/932,611, dated Jul. 6, 2015.
Restriction Requirement regarding U.S. Appl. No. 14/244,967, dated Jul. 14, 2015.
Interview Summary regarding U.S. Appl. No. 13/369,067, dated Jul. 16, 2015.
Applicant-Initiated Interview Summary and Advisory Action regarding U.S. Appl. No. 13/369,067, dated Jul. 23, 2015.
Faramarzi et al., "Performance Evaluation of Rooftop Air Conditioning Units at High Ambient Temperatures," 2004 ACEEE Summer Study on Energy Efficiency in Buildings—http://aceee.org/files/proceedings/2004/data/papers/SSO4_Panel3_Paper05.pdf.
Notice of Allowance regarding U.S. Appl. No. 12/261,643, dated Jul. 29, 2015.
Notice of Allowance regarding U.S. Appl. No. 13/770,123, dated Aug. 13, 2015.
Notice of Allowance and Interview Summary regarding U.S. Appl. No. 13/269,188, dated Aug. 26, 2015.
Office Action regarding Indian Patent Application No. 733/KOLNP/2009, dated Aug. 12, 2015.
Applicant-Initiated Interview Summary regarding U.S. Appl. No. 14/212,632, dated Sep. 2, 2015.
Notice of Allowance regarding U.S. Appl. No. 13/369,067, dated Sep. 2, 2015.
Notice of Allowance regarding U.S. Appl. No. 13/407,180, dated Sep. 4, 2015.
Final Office Action regarding U.S. Appl. No. 13/770,479, dated Sep. 4, 2015.
Office Action regarding U.S. Appl. No. 14/209,415, dated Sep. 10, 2015.
Search Report regarding European Patent Application No. 13736303.2-1806, dated Sep. 17, 2015.
First Office Action regarding Chinese Patent Application No. 201280010796.8, dated Sep. 14, 2015. Translation provided by Unitalen Attorneys At Law.
Notice of Allowance regarding U.S. Appl. No. 13/770,123, dated Oct. 1, 2015.
Office Action regarding Australian Patent Application No. 2013323760, dated Sep. 25, 2015.
Office Action and Interview Summary regarding U.S. Appl. No. 14/244,967, dated Oct. 7, 2015.
Office Action regarding U.S. Appl. No. 14/255,519, dated Nov. 9, 2015.
Office Action regarding U.S. Appl. No. 14/212,632, dated Nov. 19, 2015.
Interview Summary regarding U.S. Appl. No. 13/770,479, dated Nov. 25, 2015.
Office Action regarding Chinese Patent Application No. 201380049458.X, dated Nov. 13, 2015. Translation provided by Unitalen Attorneys at Law.
Search Report regarding European Patent Application No. 08251185.8-1605 / 2040016, dated Dec. 4, 2015.
Office Action regarding Chinese Patent Application No. 201380005300.2, dated Jan. 4, 2016. Translation provided by Unitalen Attorneys at Law.

(56) References Cited

OTHER PUBLICATIONS

Office Action regarding Australian Patent Application No. 2015207920, dated Dec. 4, 2015.
First Office Action issued by the Chinese Patent Office dated May 30, 2008 regarding Application No. 200580013451.8, 8 Pages. Translation provided by CCPIT Patent and Trademark Law Office.
Second Office Action issued by the Chinese Patent Office dated Mar. 6, 2009 regarding Application No. 200580013451.8, 7 Pages. Translation provided by CCPIT Patent and Trademark Law Office.
Advisory Action regarding U.S. Appl. No. 14/212,632, dated Feb. 9, 2016.
Office Action regarding U.S. Appl. No. 14/244,967, dated Feb. 12, 2016.
Office Action regarding European Patent Application No. 08848538.8-1608, dated Feb. 3, 2016.
Advisory Action regarding U.S. Appl. No. 14/212,632, dated Mar. 8, 2016.
Office Action regarding U.S. Appl. No. 14/209,415, dated Mar. 10, 2016.
Office Action regarding U.S. Appl. No. 14/212,632, dated Apr. 7, 2016.
Office Action regarding U.S. Appl. No. 12/943,626, dated May 4, 2016.
Office Action regarding Australian Patent Application No. 2014229103, dated Apr. 28, 2016.
Office Action regarding U.S. Appl. No. 14/617,451, dated Jun. 2, 2016.
Office Action regarding U.S. Appl. No. 14/193,568, dated Jun. 1, 2016.
Office Action regarding U.S. Appl. No. 14/080,473, dated Jun. 6, 2016.
Interview Summary regarding U.S. Appl. No. 14/209,415, dated Jun. 20, 2016.
Search Report regarding European Patent Application No. 13841699.5, dated Jun. 30, 2016.
Office Action regarding Chinese Patent Application No. 201480016023.X, dated Jun. 22, 2016. Translation provided by Unitalen Attorneys at Law.
Interview Summary regarding U.S. Appl. No. 14/617,451, dated Jul. 28, 2016.
Office Action regarding U.S. Appl. No. 14/208,636, dated Aug. 4, 2016.
Advisory Action regarding U.S. Appl. No. 14/193,568, dated Aug. 10, 2016.
Office Action regarding U.S. Appl. No. 14/727,756, dated Aug. 22, 2016.
Office Action regarding U.S. Appl. No. 14/244,967, dated Aug. 29, 2016.
Office Action regarding U.S. Appl. No. 13/770,479, dated Sep. 7, 2016.
Office Action regarding U.S. Appl. No. 15/096,196, dated Sep. 13, 2016.
Office Action regarding Canadian Patent Application No. 2,904,734, dated Sep. 13, 2016.
Office Action regarding U.S. Appl. No. 14/300,782, dated Sep. 30, 2016.
Office Action regarding U.S. Appl. No. 14/255,519, dated Oct. 5, 2016.
Office Action regarding Australian Patent Application No. 2015255255, dated Sep. 8, 2016.
Office Action regarding Canadian Patent Application No. 2,908,362, dated Sep. 21, 2016.
Search Report regarding European Patent Application No. 14764311.8, dated Oct. 27, 2016.
Search Report regarding European Patent Application No. 14763232.7, dated Oct. 27, 2016.
Office Action regarding U.S. Appl. No. 12/943,626, dated Nov. 4, 2016.
Louis Goodman et al. "Vertical Motion of Neutrally Buoyant Floats." Journal of Atmospheric and Oceanic Technology. vol. 7. Feb. 1990.
Search Report regarding European Patent Application No. 14780284.7, dated Nov. 2, 2016.
Office Action regarding U.S. Appl. No. 14/080,473, dated Nov. 16, 2016.
Applicant-Initiated Interview Summary regarding U.S. Appl. No. 13/770,479, dated Dec. 9, 2016.
Office Action regarding U.S. Appl. No. 14/244,967, dated Jan. 20, 2017.
Search Report regarding European Patent Application No. 16187893.9, dated Jan. 19, 2017.
Advisory Action regarding U.S. Appl. No. 14/080,473, dated Jan. 30, 2017.
Office Action regarding U.S. Appl. No. 14/208,636, dated Jan. 26, 2017.
Office Action regarding Indian Patent Application No. 102/KOLNP/2009, dated Mar. 10, 2017.
Office Action regarding U.S. Appl. No. 14/080,473, dated Mar. 14, 2017.
Office Action regarding U.S. Appl. No. 13/770,479, dated Mar. 17, 2017.
Advisory Action regarding U.S. Appl. No. 14/208,636, dated Mar. 23, 2017.
Richard E. Lofftus, Jr. "System Charge and Performance Evaluation." HVAC/R Training, Vatterott College. Jan. 2007.
Search Report regarding European Patent Application No. 12752872.7, dated May 4, 2017.
Interview Summary regarding U.S. Appl. No. 13/770,479, dated May 10, 2017.
Advisory Action and Examiner-Initiated Interview Summary regarding U.S. Appl. No. 13/770,479, dated May 23, 2017.
Office Action regarding Canadian Patent Application No. 2,934,860, dated May 4, 2017.
Restriction Requirement regarding U.S. Appl. No. 14/607,782, dated Jun. 29, 2017.
Search Report regarding European Patent Application No. 10830696.0, dated Jul. 18, 2017.
Office Action regarding European Patent Application No. 07811712.4, dated Jul. 25, 2017.
Office Action regarding U.S. Appl. No. 14/607,782, dated Sep. 21, 2017.
Examiner's Answer regarding U.S. Appl. No. 12/943,626, dated Sep. 19, 2017.
Office Action regarding Indian Patent Application No. 456/MUMNP/2010, dated Oct. 3, 2017.
Office Action regarding European Patent Application No. 07796879.0, dated Oct. 19, 2017.
Office Action regarding Australian Patent Application No. 2014248049, dated Oct. 10, 2017.
Corrected Notice of Allowability regarding U.S. Appl. No. 14/080,473 dated Dec. 27, 2017.
Office Action regarding Chinese Patent Application No. 201480016177.9, dated Apr. 7, 2017. Translation provided by Unitalen Attorneys at Law.
Office Action regarding U.S. Appl. No. 14/208,636 dated Jan. 3, 2018.
Final Office Action regarding U.S. Appl. No. 15/583,942 dated Apr. 18, 2018.
First Office Action regarding Chinese Application No. 201610422700.4 dated Apr. 2, 2018. Translation provided by Unitalen Attorneys at Law.
Search Report regarding Chinese Patent Application No. 201610244700.4, dated Mar. 25, 2018.
Notice of Allowance regarding U.S. Appl. No. 14/607,782 dated May 21, 2018.
Kim, Minsung et al., "Performance Of A Residential Heat Pump Operating In The Cooling Mode With Single Faults Imposed", Sep. 2006, U.S. Department of Commerce, NISTIR 7350 (175 pages).
Notice of Allowance regarding U.S. Appl. No. 15/645,970 dated Jun. 29, 2018.

(56) References Cited

OTHER PUBLICATIONS

Non-Final Office Action regarding U.S. Appl. No. 14/949,090 dated Jul. 5, 2018.
Notice of Allowance regarding U.S. Appl. No. 14/607,782 dated Jul. 3, 2018.
Notice of Allowance regarding U.S. Appl. No. 14/208,636 dated Jul. 30, 2018.
Notice of Allowance regarding U.S. Appl. No. 15/583,942 dated Aug. 7, 2018.
Non-Final Office Action regarding U.S. Appl. No. 15/613,375 dated Aug. 30, 2018.
Notice of Allowance regarding U.S. Appl. No. 14/208,636 dated Sep. 25, 2018.
Notice of Allowance regarding U.S. Appl. No. 15/096,186 dated Feb. 26, 2019.
Notice of Allowance regarding U.S. Appl. No. 15/633,657 dated Jun. 6, 2019.
Response to 312 Amendment regarding U.S. Appl. No. 15/096,186 dated Jun. 11, 2019.
Final Office Action regarding U.S. Appl. No. 14/949,090 dated Jul. 19, 2019.
Notice of Allowance regarding U.S. Appl. No. 16/113,271 dated Jun. 13, 2019.
Applicant-Initiated Interview Summary regarding U.S. Appl. No. 14/949,090 dated Aug. 13, 2019.
Supplemental Notice of Allowability regarding U.S. Appl. No. 16/113,271 dated Aug. 14, 2019.

* cited by examiner

SYSTEM FOR REFRIGERANT CHARGE VERIFICATION

CROSS-REFERENCE TO RELATED APPLICATIONS

This application is a continuation of U.S. application Ser. No. 14/193,568, filed on Feb. 28, 2014, which claims the benefit of U.S. Provisional Application No. 61/789,913, filed on Mar. 15, 2013. The entire disclosures of the above applications are incorporated herein by reference.

FIELD

The present disclosure relates to refrigeration systems and more specifically to a charge-verification system for use with a refrigeration system.

BACKGROUND

The statements in this section merely provide background information related to the present disclosure and may not constitute prior art.

Compressors are used in a wide variety of industrial and residential applications to circulate refrigerant within a refrigeration, heat pump, HVAC, or chiller system (generically referred to as "refrigeration systems") to provide a desired heating and/or cooling effect. In any of the foregoing systems, the compressor should provide consistent and efficient operation to ensure that the particular refrigeration system functions properly.

Refrigeration systems and associated compressors may include a protection system that selectively restricts power to the compressor to prevent operation of the compressor and associated components of the refrigeration system (i.e., evaporator, condenser, etc.) when conditions are unfavorable. The types of faults that may cause protection concerns include electrical, mechanical, and system faults. Electrical faults typically have a direct effect on an electrical motor associated with the compressor, while mechanical faults generally include faulty bearings or broken parts. Mechanical faults often raise a temperature of working components within the compressor and, thus, may cause malfunction of and possible damage to the compressor.

In addition to electrical and mechanical faults associated with the compressor, the compressor and refrigeration system components may be affected by system faults attributed to system conditions such as an adverse level of fluids (i.e., refrigerant) disposed within the system or a blocked-flow condition external to the compressor. Such system conditions may raise an internal compressor temperature or pressure to high levels, thereby damaging the compressor and causing system inefficiencies and/or failures.

SUMMARY

A charge-verification tool is provided for use with a charge-verification system to diagnose and remedy a charge condition. The charge-verification tool includes a device having a controller configured to communicate with a system controller in the charge-verification system and a display configured to display measurements and instructions to an installer. The device is a user interface and is configured to provide communication between the installer and the system controller in the charge-verification system. The controller prompts the installer to input charge-verification system information including refrigeration line length and diameter. The controller receives a subcooling temperature calculated by the system controller and determines whether the subcooling temperature is between a threshold and a target subcooling temperature. The controller displays an amount of charge to add to the charge-verification system based on whether the subcooling temperature is between the threshold and the target subcooling temperature.

The charge-verification tool may further include the controller displaying a system stabilization indication received from the system controller when the charge-verification system stabilizes after startup and after the installer adds charge to the charge-verification system.

The charge-verification tool may further include the controller displaying the subcooling temperature and the target subcooling temperature on the display.

The charge-verification tool may further include the controller displaying a "done" indication if the subcooling temperature is equal to the target subcooling temperature.

The charge-verification tool may further include the controller determining that an undercharge condition exists if the subcooling temperature is between the threshold and the target subcooling temperature.

The charge-verification tool may further include the controller determining that an overcharge condition exists if the subcooling temperature is greater than the target subcooling temperature.

The charge-verification tool may further include the controller displaying a negative amount of charge to add to the charge-verification system, indicating that charge should be removed from the system, if the overcharge condition exists.

The charge-verification tool may further include a threshold that is two degrees Fahrenheit.

The charge-verification tool may further include a target subcooling temperature that is ten degrees.

The charge-verification tool may further include the controller determining the subcooling temperature based on at least two of a saturated condensing temperature, a liquid line temperature, a first coil temperature, and a second coil temperature.

In another configuration, a method of charge verification for use with a charge-verification system to diagnose and remedy a charge condition, is provided. The method includes prompting, by a device controller, an installer to input charge-verification system information including refrigeration line length and diameter; receiving, by the device controller, a subcooling temperature calculated by a system controller for the charge-verification system; determining, by the device controller, whether the subcooling temperature is between a threshold and a target subcooling temperature; and displaying, by the device controller, an amount of charge to add to the charge-verification system based on whether the subcooling temperature is between the threshold and the target subcooling temperature.

The method may further include displaying, by the device controller, a system stabilization indication received from the system controller when the charge-verification system stabilizes after startup and after the installer adds charge to the charge-verification system.

The method may further include displaying, by the device controller, the subcooling temperature and the target subcooling temperature on the display.

The method may further include displaying, by the device controller, a "done" indication if the subcooling temperature is equal to the target subcooling temperature.

The method may further include determining an undercharge condition if the subcooling temperature is between the threshold and the target subcooling temperature.

The method may further include determining an overcharge condition if the subcooling temperature is greater than the target subcooling temperature.

The method may further include displaying, by the device controller, a negative amount of charge to add to the charge-verification system, indicating that charge should be removed from the system, if the overcharge condition exists.

The method may further include wherein the threshold is two degrees Fahrenheit and the target subcooling temperature is ten degrees.

The method may further include prompting the installer to add the charge in two increments if the amount of charge to be added to the charge-verification system is greater than a predetermined threshold.

The method may further include determining the subcooling temperature based on at least two of a saturated condensing temperature, a liquid line temperature, a first coil temperature, and a second coil temperature.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The drawings described herein are for illustration purposes only and are not intended to limit the scope of the present disclosure in any way. The present disclosure will become more fully understood from the detailed description and the accompanying drawings, wherein.

DETAILED DESCRIPTION

Figure 1:
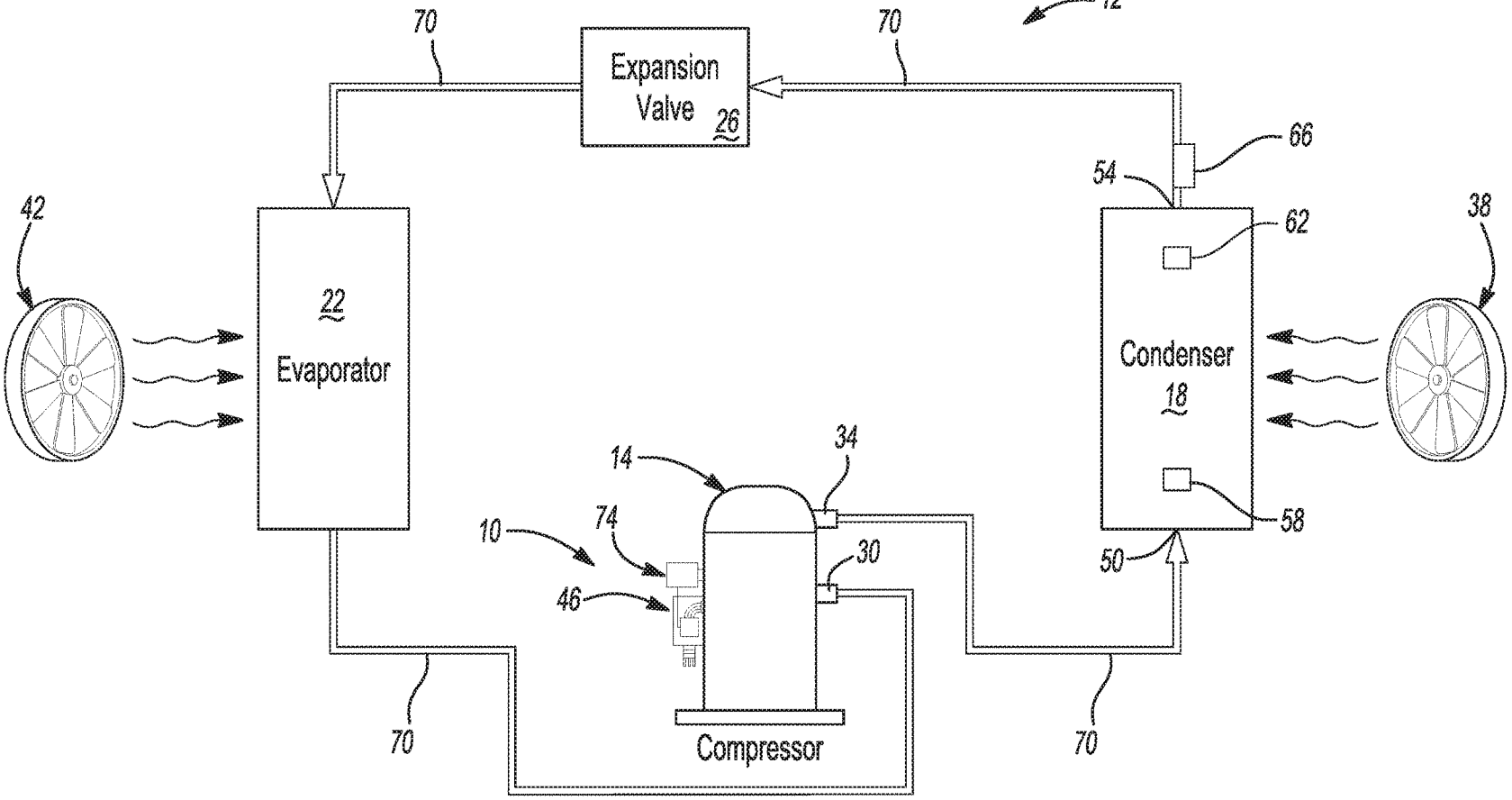
FIG. 1 is a schematic representation of charge-verification system in accordance with the principles of the present disclosure implemented in a refrigeration system.

Example embodiments will now be described more fully with reference to the accompanying drawings.

Example embodiments are provided so that this disclosure will be thorough and will fully convey the scope to those who are skilled in the art. Numerous specific details are set forth such as examples of specific components, devices, and methods to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, a charge-verification system 10 is provided. The charge-verification system 10 may be used in conjunction with a refrigeration system 12 including a compressor 14, a condenser 18, an evaporator 22, and an expansion valve 26. While the refrigeration system 12 is described and shown as including a compressor 14, a condenser 18, an evaporator 22, and an expansion valve 26, the refrigeration system 12 may include additional and/or alternative components. Further, the present disclosure is applicable to various types of refrigeration systems including, but not limited to, heating, ventilating, air conditioning (HVAC), heat pump, refrigeration, and chiller systems.

During operation of the refrigeration system 12, the compressor 14 circulates refrigerant generally between the condenser 18 and the evaporator 22 to produce a desired heating and/or cooling effect. Specifically, the compressor 14 receives refrigerant in vapor form through an inlet fitting 30 and compresses the refrigerant. The compressor 14 provides pressurized refrigerant in vapor form to the condenser 18 via a discharge fitting 34.

All or a portion of the pressurized refrigerant received from the compressor 14 may be converted into the liquid state within the condenser 18. Specifically, the condenser 18 transfers heat from the refrigerant to the surrounding air, thereby cooling the refrigerant. When the refrigerant vapor is cooled to a temperature that is less than a saturation temperature, the refrigerant changes state from a vapor to a liquid. The condenser 18 may include a condenser fan 38 that increases the rate of heat transfer away from the refrigerant by forcing air across a heat-exchanger coil associated with the condenser 18. The condenser fan 38 may be a variable-speed fan that is controlled by the charge-verification system 10 based on a cooling demand.

The refrigerant passes through the expansion valve 26 prior to reaching the evaporator 22. The expansion valve 26 expands the refrigerant prior to the refrigerant reaching the evaporator 22. A pressure drop caused by the expansion valve 26 may cause a portion of the liquefied refrigerant to change state from a liquid to a vapor. In this manner, the evaporator 22 may receive a mixture of vapor refrigerant and liquid refrigerant.

The refrigerant absorbs heat in the evaporator 22. Accordingly, liquid refrigerant disposed within the evaporator 22 changes state from a liquid to a vapor when warmed to a temperature that is greater than or equal to the saturation temperature of the refrigerant. The evaporator 22 may include an evaporator fan 42 that increases the rate of heat transfer to the refrigerant by forcing air across a heat-exchanger coil associated with the evaporator 22. The evaporator fan 42 may be a variable-speed fan that is controlled by the charge-verification system 10 based on a cooling demand.

As the liquid refrigerant absorbs heat, the ambient air disposed proximate to the evaporator 22 is cooled. The evaporator 22 may be disposed within a space to be cooled such as a building or refrigerated case where the cooling effect produced by the refrigerant absorbing heat is used to cool the space. The evaporator 22 may also be associated with a heat-pump refrigeration system where the evaporator 22 may be located remote from the building such that the cooling effect is lost to the atmosphere and the rejected heat generated by the condenser 18 is directed to the interior of a space to be heated.

A system controller 46 may be associated with the charge-verification system 10 and/or the compressor 14 and may monitor, control, protect, and/or diagnose the compressor 14 and/or the refrigeration system 12. The system controller 46 may utilize a series of sensors to determine both measured and non-measured operating parameters of the compressor 14 and/or the refrigeration system 12. While the system controller 46 is shown as being associated with the compressor 14, the system controller 46 could be located anywhere within or outside of the refrigeration system 12. The system controller 46 may use the non-measured operating parameters in conjunction with the measured operating parameters to monitor, control, protect, and/or diagnose the compressor 14 and/or the refrigeration system 12. Such non-measured operating parameters may also be used to check the sensors to validate the measured operating parameters and to determine a refrigerant charge level and/or a fault of the refrigeration system 12.

The system controller 46 may control the condenser fan 38 and the evaporator fan 42 such that operation of the condenser fan 38 and the evaporator fan 42 is coordinated with operation of the compressor 14. For example, the system controller 46 may control one or both fans 38, 42 to operate at a full or reduced speed depending on the output of the compressor 14.

The condenser 18, having an inlet 50 and an outlet 54, may further include a first coil temperature sensor 58 and a second coil temperature sensor 62 positioned on first and second heat-exchanger coil circuit tubes (not shown). The first coil temperature sensor 58 may be located within a first predetermined range of the coil circuit length from the condenser inlet 50. For example, the first coil temperature sensor 58 may be located at approximately forty percent of the coil circuit length from the condenser inlet 50 or at any location between thirty percent and fifty percent of the coil circuit length from the condenser inlet 50. The second coil temperature sensor 62 may be located within a second predetermined range of the coil circuit length from the condenser inlet 50. For example, the second coil temperature sensor 62 may be located at approximately seventy percent of the coil circuit length from the condenser inlet 50 or at any location between sixty percent and ninety percent of the coil circuit length from the condenser inlet 50. The first and second coil temperature sensors 58, 62 detect a temperature of the refrigerant circulating in the condenser 18 and may be used by the system controller 46 of the charge-verification system 10 to determine a saturated condensing temperature (SCT) of the refrigerant.

While the condenser 18 is illustrated as a Plate-Fin Heat Exchanger Coil, the present disclosure is applicable to other heat exchangers such as a smaller 5 mm microtube, a Microchannel, Spine-Fin Heat Exchanger Coils, or other heat exchangers known in the art. Further, the condensing coil may include various different parallel circuits with different heat exchanger designs. The first and second coil temperature sensors 58, 62 may be associated with any of the heat exchangers of the various parallel circuits.

A liquid-line temperature sensor 66 may be located along a conduit 70 extending between the condenser 18 and the expansion valve 26 and may provide an indication of a temperature of the liquid refrigerant within the refrigeration system 12 or liquid-line temperature (LLT) to the system controller 46. While the liquid-line temperature sensor 66 is described as being located along the conduit 70 extending between the condenser 18 and the expansion valve 26, the liquid-line temperature sensor 66 could alternatively be placed anywhere within the refrigeration system 12 that allows the liquid-line temperature sensor 66 to provide an indication of a temperature of liquid refrigerant within the refrigeration system 12 to the system controller 46.

An outdoor/ambient temperature sensor 74 may be located external to the compressor 14 and generally provides an indication of the outdoor/ambient temperature (OAT) adjacent to the compressor 14 and/or the charge-verification system 10. The outdoor/ambient temperature sensor 74 may be positioned adjacent to the compressor 14 such that the outdoor/ambient temperature sensor 74 is in close proximity to the system controller 46. Placing the outdoor/ambient temperature sensor 74 in close proximity to the compressor 14 provides the system controller 46 with a measure of the temperature generally adjacent to the compressor 14. While the outdoor/ambient temperature sensor 74 is described as being located adjacent to the compressor 14, the outdoor/ambient temperature sensor 74 could be placed anywhere within the refrigeration system 12 that allows the outdoor/ambient temperature sensor 74 to provide an indication of the outdoor/ambient temperature proximate to the compressor 14 to the system controller 46. Additionally, or alternatively, local weather data could be retrieved using the internet, for example, to determine ambient temperature.

The system controller 46 receives sensor data from the coil temperature sensors 58, 62, the liquid-line temperature sensor 66, and the outdoor/ambient temperature sensor 74 for use in controlling and diagnosing the refrigeration system 12 and/or the compressor 14. The system controller 46 may additionally use the sensor data from the respective sensors 58, 62, 66, and 74 to determine non-measured operating parameters of the refrigeration system 12 and/or the compressor 14 using the relationships shown in FIGS. 3, 4, 5, 6, and 7.

The system controller 46 determines which of the temperatures received from the first coil temperature sensor 58 and the second coil temperature sensor 62 is closer to the actual SCT and uses that sensor in conjunction with the temperature reading from the liquid-line temperature sensor 66 to determine a subcooling and the charge level of the refrigeration system 12, as will be described in greater detail below.

Figure 2:
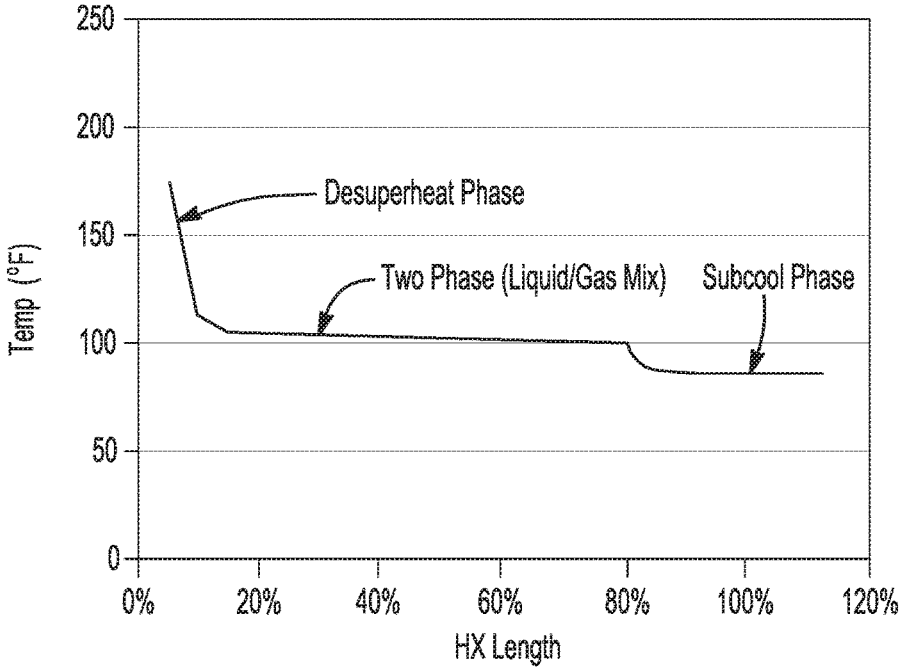
FIG. 2 is a graph showing coil temperature versus a percentage position of the coil circuit length during a normal charge condition according to the present disclosure.

With particular reference to FIG. 2, a graph showing coil temperature versus a percentage position of the coil circuit length during a normal charge condition is illustrated. Upon exiting the condenser 18, approximately ten to twenty percent of the refrigerant is in a gaseous state or de-superheating phase, approximately ten to twenty percent of the refrigerant is in a liquid state or subcooling phase, and the remaining sixty to seventy percent of the refrigerant is in a liquid/vapor state or two-phase condensing state. The subcooling phase typically yields approximately ten degrees Fahrenheit (10° F.) subcooling and is considered a normal charge level.

When the charge-verification system 10 operates under normal charge conditions, placement of the temperature sensor on a coil circuit tube at approximately a midpoint of the condenser 18 provides the system controller 46 with an indication of the temperature of the condenser 18 that approximates the saturated condensing temperature and saturated condensing pressure. When the charge-verification system 10 is normally charged such that the refrigerant within the refrigeration system 12 is within +/−fifteen percent of an optimum-charge condition, the information detected by the temperature sensor positioned at approximately the midpoint of the coil circuit tube is closer to the actual SCT.

Figure 3:
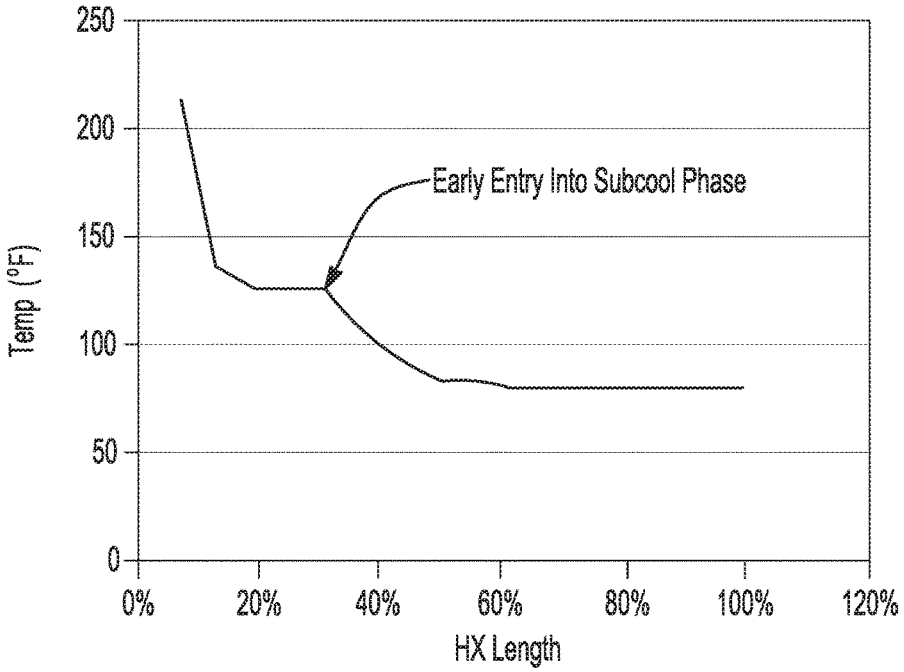
FIG. 3 is a graph showing coil temperature versus a percentage position of the coil circuit length during an overcharge condition according to the present disclosure.

With particular reference to FIG. 3, a graph showing coil temperature versus a percentage position of the coil circuit length during an overcharge condition is illustrated. An overcharge condition may exist when the subcooling temperature is greater than approximately thirty degrees Fahrenheit (30° F.). When the condenser 18 is in an overcharge state, the coil mid-point temperature may already be subcooled, thus providing a much lower value than actual SCT based on pressure. An excess amount of refrigerant may be disposed within the refrigeration system 12, as the refrigerant disposed within the condenser 18 changes state from a gas to a liquid before reaching the midpoint of the condenser 18.

The refrigerant exiting the compressor 14 and entering the condenser 18 is at a reduced temperature and may be in an approximately 40/60 gas/liquid mixture. The reduced-temperature refrigerant converts from the vapor state to the liquid state at an earlier point along the length of the condenser 18 and therefore may be at a partial or fully liquid state when the refrigerant approaches the temperature sensor disposed at the midpoint of the condenser 18. Because the refrigerant is at a lower temperature, the temperature sensor at the midpoint reports a temperature to the system controller 46 that is lower than the actual SCT.

When the refrigeration system 12 operates in the overcharge condition, the subcooled liquid phase increases and the reading of the second coil temperature sensor 62 may be lower than the reading of the first coil temperature sensor 58 because the tube where the second coil temperature sensor is located is subcooled compared to the tube where the first coil temperature sensor is located. Therefore, during an overcharge condition, the temperature from the first coil temperature sensor 58 is closer to the actual SCT than the temperature from the second coil temperature sensor 62.

Figure 4:
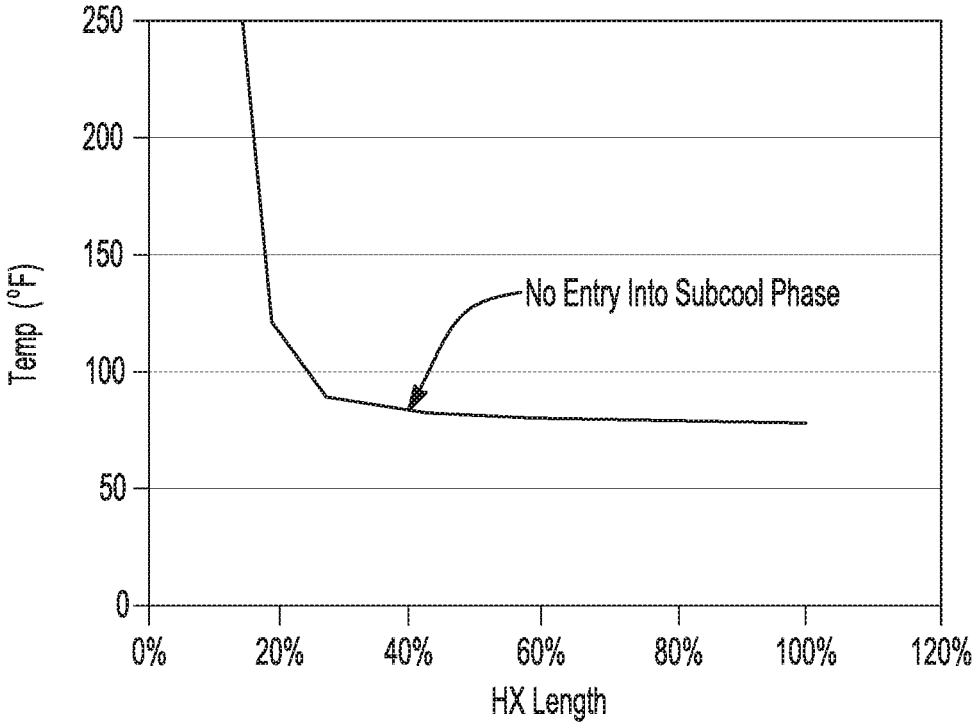
FIG. 4 is a graph showing coil temperature versus a percentage position of the coil circuit length during an undercharge condition according to the present disclosure.

With particular reference to FIG. 4, a graph showing coil temperature versus a percentage position of the coil circuit length during an undercharge condition is illustrated. An undercharge condition may exist when the subcooling temperature is less than zero degrees Fahrenheit (0° F.). When the condenser 18 is in an undercharge state, any coil circuit tube after approximately the twenty percent de-superheating phase adequately measures the actual SCT temperature because the remaining portion of the condenser 18 is in two-phase condensing without any subcooled liquid phase.

When the refrigeration system 12 operates in the undercharge condition, the subcooled liquid phase decreases and the reading of the second coil temperature sensor 62 may approach the reading of the outlet liquid-line temperature sensor 66. Eventually, when the subcooling phase disappears because both sensors 58, 62 are detecting only the condensing phase, the readings of temperature sensors 58, 62 are approximately equal. In this situation, the temperature from the first coil temperature sensor 58 approximately equals the temperature from the second coil temperature sensor 62, which, in turn, approximates the actual SCT.

Figure 5:
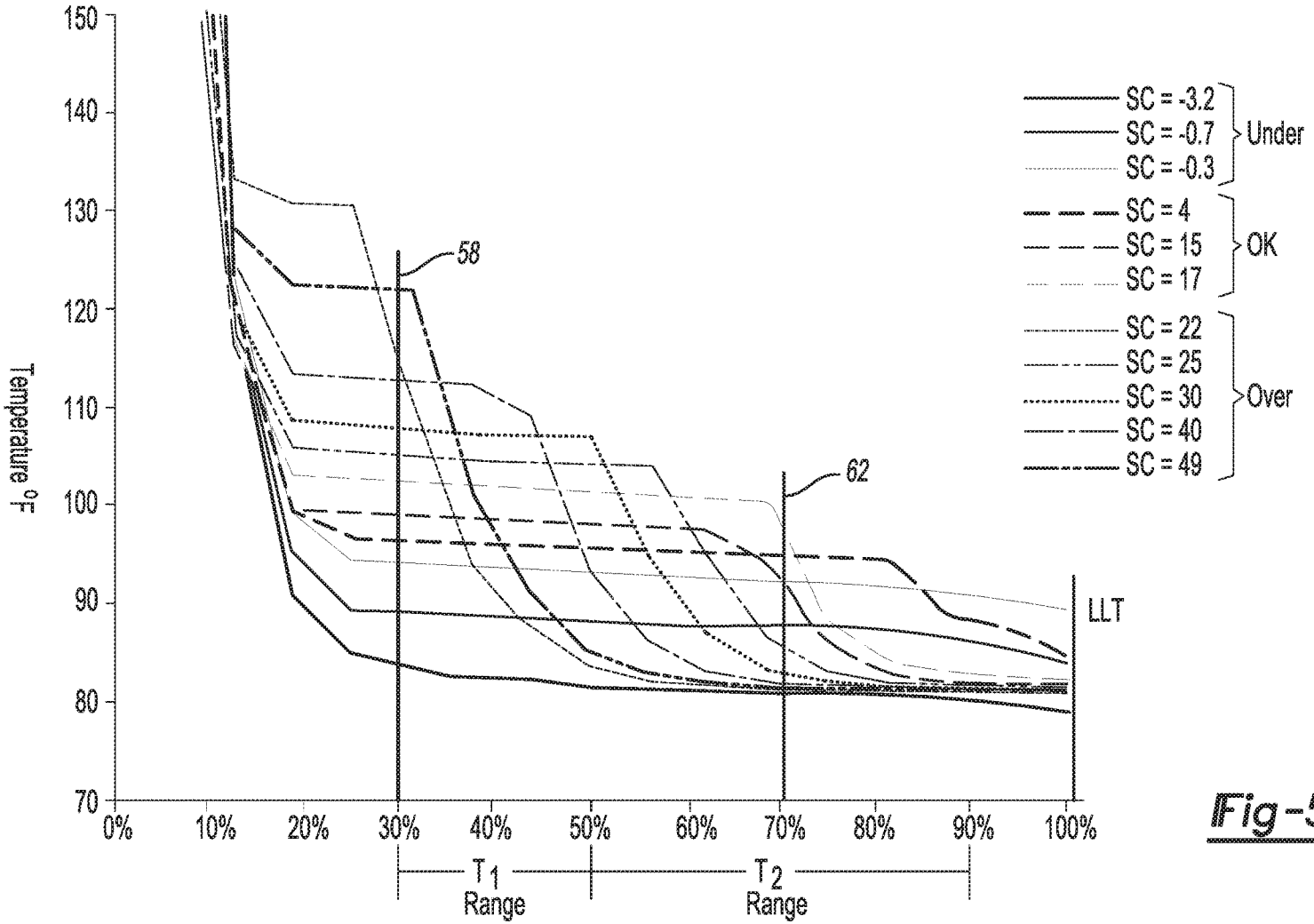
FIG. 5 is a graph showing coil temperature versus a percentage position of the coil circuit length for two coil temperature sensors mounted at approximately forty percent and seventy percent, respectively, of the coil circuit length according to the present disclosure.

With reference to FIG. 5, a graph showing coil temperature versus a percentage position of the coil circuit length is illustrated. The positions of the first and second coil temperature sensors 58, 62 along a length of the condenser 18 are schematically represented by vertical lines at approximately thirty percent (30%) and seventy percent (70%), respectively. Each plotted line on the graph represents a different charge condition. Intersection between the plotted lines and the respective vertical lines of the first and second coil temperature sensors 58, 62 may be used by the controller 46 to identify amongst the various charge conditions.

In the condensing phase, the temperature changes mainly as a function of pressure drop; thus, the temperature changes very gradually, at approximately less than three degrees (3°

F.) per coil circuit. When in the subcooled phase, the temperature changes much more rapidly, at approximately greater than ten degrees (10° F.) per coil circuit.

When the temperature from the first coil temperature sensor 58 is greater than the temperature from the second coil temperature 62 sensor plus approximately two degrees Fahrenheit (2° F.) and both are greater than the LLT plus approximately seven degrees Fahrenheit (7° F.) (Tcoil1>Tcoil2+2° F.>LLT+7° F.), a normal charge condition is declared. When the temperature from the first coil temperature sensor 58 is approximately equal to the temperature from the second coil temperature sensor 62—which is approximately equal to the LLT (Tcoil1≅Tcoil2≅LLT)—an undercharge condition is declared; indicating that refrigerant should be added to the system. When the temperature from the first coil temperature sensor 58 is greater than the temperature from the second coil temperature sensor 62 plus approximately five degrees Fahrenheit (5° F.) and both are greater than the LLT plus approximately two degrees Fahrenheit (2° F.) (Tcoil1>Tcoil2+5° F.>LLT+2° F.), an overcharge condition is declared; indicating that refrigerant should be removed from the system.

For example, when the refrigeration system 12 is operating in an undercharged condition, the first coil temperature sensor 58 may be reporting eighty-four degrees Fahrenheit (84° F.), eighty-nine degrees Fahrenheit (89° F.), or ninety-five degrees Fahrenheit (95° F.) and the second coil temperature sensor 62 may be reporting eighty-three degrees Fahrenheit (83° F.), eighty-nine degrees Fahrenheit (89° F.), or ninety-four degrees Fahrenheit (94° F.). If the first coil temperature sensor 58 is reporting eighty-four degrees Fahrenheit (84° F.) and the second coil temperature sensor 62 is reporting eighty-three degrees Fahrenheit (83° F.), the subcooling temperature is 3.2° F. If the first coil temperature sensor 58 is reporting eighty-nine degrees Fahrenheit (89° F.) and the second coil temperature sensor 62 is reporting eighty-nine degrees Fahrenheit (89° F.), the subcooling temperature is 0.7° F. If the first coil temperature sensor 58 is reporting ninety-five degrees Fahrenheit (95° F.) and the second coil temperature sensor 62 is reporting ninety-four degrees Fahrenheit (94° F.), the subcooling temperature is 0.3° F. The graph illustrates similar relations for normal operation and overcharged operation as well. The controller 46 may therefore use the data from the first coil temperature sensor 58 and the second coil temperature sensor 62 along with the LLT to diagnose the charge level of the system.

Based on the temperature readings from the first and second coil temperature sensors 58, 62, the system controller 46 determines the subcooling temperature and the charge condition (as shown in FIG. 5). Based on the subcooling temperature and the charge condition, the system controller 46 may determine remedial actions that may be necessary, such as addition of refrigerant to the system or removal of refrigerant from the system.

Dependent upon the amount of refrigerant that needs to be added or removed from the system, the refrigerant may be added or removed in a series of incremental additions or removals to ensure that too much refrigerant is not added or removed. Between each of the series of incremental additions or removals, the system controller 46 may determine the subcooling temperature and the charge condition.

Figure 6:
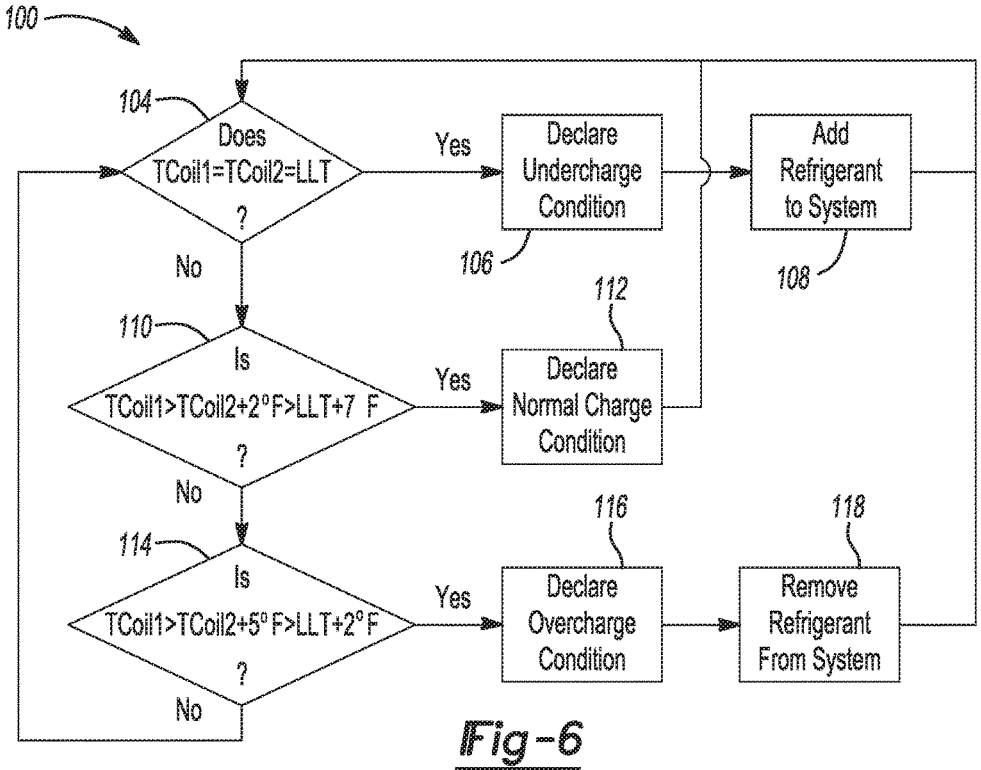
FIG. 6 is a flow chart detailing operation of a charge-verification system according to the present disclosure.

Now referring to FIG. 6, a charge verification method 100 is illustrated. The charge verification method 100 may be performed by the controller 46 during operation of the refrigeration system 12.

At 104, the method 100 determines whether the Tcoil1 equals the Tcoil2 and whether both of these values are approximately equal to the LLT (Tcoil1=Tcoil2=LLT). If true, the method 100 determines that the refrigeration system 12 is operating in an undercharged condition at 106. At step 108, the method 100 recommends adding refrigerant to the system. The method 100 then returns to step 104 to continue evaluating the Tcoil1, the Tcoil2, and the LLT.

If false at step 104, the method 100 determines whether a first coil temperature (Tcoil1) is greater than a second coil temperature (Tcoil2) plus approximately two degrees Fahrenheit (2° F.) and whether both of these values are greater than the LLT plus approximately seven degrees Fahrenheit (7° F.) (Tcoil1>Tcoil2+2° F.>LLT+7° F.) at 110. If true, the method 100 determines that the refrigeration system 12 is operating in a normal charge condition at 112. The method 100 returns to step 104 to continue evaluating the Tcoil1, the Tcoil2, and the LLT.

If false at step 104, the method 100 moves to step 110 and if false at step 110, the method 100 moves to step 114 and determines whether the Tcoil1 is greater than the Tcoil2 plus approximately five degrees Fahrenheit (5° F.) and whether both of these are greater than the LLT plus approximately two degrees Fahrenheit (2° F.) (Tcoil1>Tcoil2+5° F.>LLT+2° F.). If true, the method 100 determines that the refrigeration system 12 is operating in an overcharged condition at 116. At 118, the method 100 recommends removing refrigerant from the system. The method 100 then returns to step 104 to continue evaluating the Tcoil1, the Tcoil2, and the LLT.

If false at step 114, the method 100 returns to step 104 to continue evaluating the Tcoil1, the Tcoil2, and the LLT.

Figure 7:
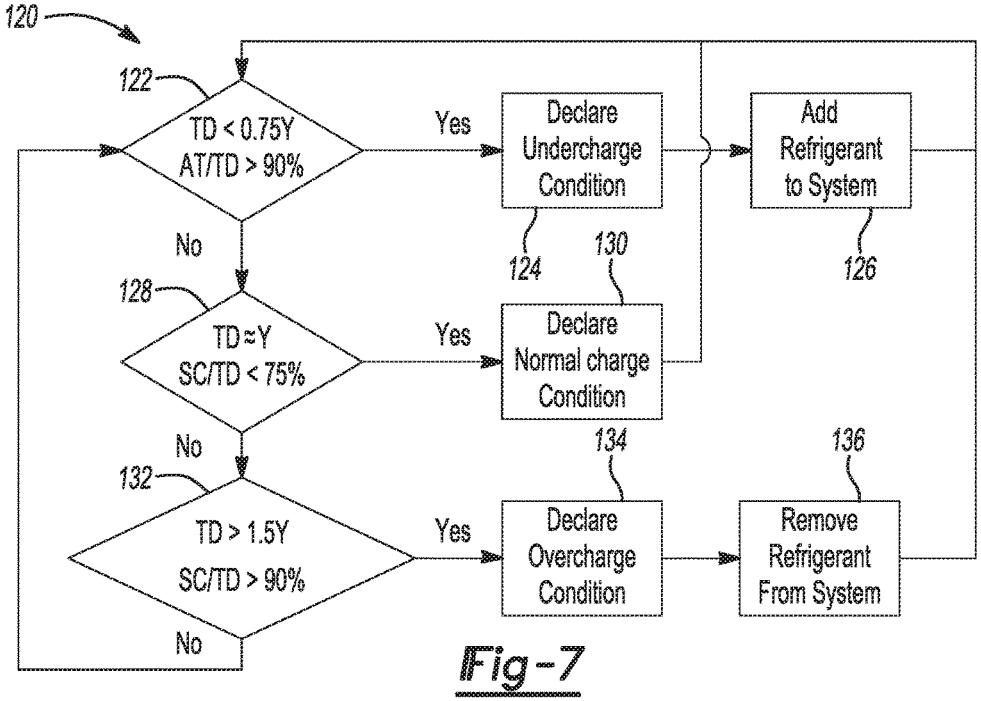
FIG. 7 is a flow chart detailing operation of a charge-verification system accordingly to the present disclosure.

With particular reference to FIG. 7, another charge-verification method 120 is provided. As with the charge-verification method 100, the charge-verification method 120 may be performed by the controller 46 during operation of the refrigeration system 12.

The charge-verification method 120 may be used by the controller 46 in conjunction with or in place of the charge-verification method 100 when determining the charge of the refrigeration system 12. If the methods 100, 120 are used in conjunction with one another, the methods 100, 120 may independently determine the charge of the refrigeration system 12 (i.e., normal charge, undercharge, or overcharge) and may be used by the controller 46 to verify the results of each method 100, 120. Namely, the result obtained by one of the methods 100, 120 may be used by the controller 46 to verify the result obtained by the other method 100, 120 by comparing the results obtained via each method 100, 120.

At 122, the method 120 determines whether the TD is less than approximately 0.75Y (i.e., 75% of Y) and whether a ratio of AT/TD is greater than approximately 90%, whereby the variable (Y) represents a predetermined desired TD value, which may be determined based on system efficiency. If true, the method 120 determines that the refrigeration system 12 is operating in an undercharged condition at 124. At step 126, the method 120 recommends adding refrigerant to the system. The method 120 then returns to step 122 to continue evaluating the system 12.

If false at step 122, the method 120 moves to step 128 and determines whether the TD is approximately equal to the predetermined desired TD value Y (i.e., +/−15% of Y) and whether the ratio of SC/TD is less than approximately 75%. If true, the method 120 determines that the refrigeration system 12 is operating in a normal charge condition at 130. The method 120 returns to step 122 to continue evaluating the system 12.

If false at step 122, the method 120 moves to step 128 and if false at step 128, the method 120 moves to step 132 and determines whether the TD is greater than approximately 1.5Y and whether a ratio of SC/TD is greater than approximately 90%. If true, the method 120 determines that the refrigeration system 12 is operating in an overcharged condition at 134. At 136, the method 120 recommends removing refrigerant from the system. The method 120 then returns to step 122 to continue evaluating the system 12.

If false at step 132, the method 120 returns to step 122 to continue evaluating the system 12.

The controller 46 may execute the foregoing methods 100, 120 simultaneously. Further, while the controller 46 monitors the system 12 for the undercharge condition prior to the normal-charge condition and the overcharge condition, the controller 46 could perform operations 104, 110, 114 of method 100 and operations 122, 128, 132 of method 120 in any order. The controller 46 is only described as performing operations 104 and 122 first, as most commercial refrigeration systems 12 are manufactured and shipped with a small volume of refrigerant and, therefore, are typically in the undercharge condition when initially installed.

In another configuration, the system controller 46 may additionally determine faults in the refrigeration system 12 along with determining the subcooling temperature and the charge condition. For example, the system controller 46 may determine a temperature difference (TD) between the SCT and the OAT (TD=SCT−OAT). The TD increases with an overcharge condition and decreases with an undercharge condition. The system controller 46 may further determine an approach temperature (AT) by subtracting the OAT from the LLT (AT=LLT−OAT). The AT decreases with an overcharge condition and increases with an undercharge condition.

Based on the foregoing, the system controller 46 is able to determine a refrigerant charge level and/or a fault by analyzing the AT, the TD and the SC without requiring additional temperature sensors (as illustrated in FIG. 1). Further, because the TD is equivalent to the SC plus the AT (TD=SC+AT), the percent split or ratio between the SC and the AT (making up the TD) is a good indicator of which fault is occurring.

For overcharge conditions, the TD is high, but the AT is small, thus an SC/TD ratio is greater than approximately ninety percent (90%). For undercharge conditions, the TD is low and the SC is low, thus an AT/TD ratio is greater than approximately ninety percent (90%). Accordingly, the controller 46 may differentiate between other faults as well, as described in detail below.

Figure 9:
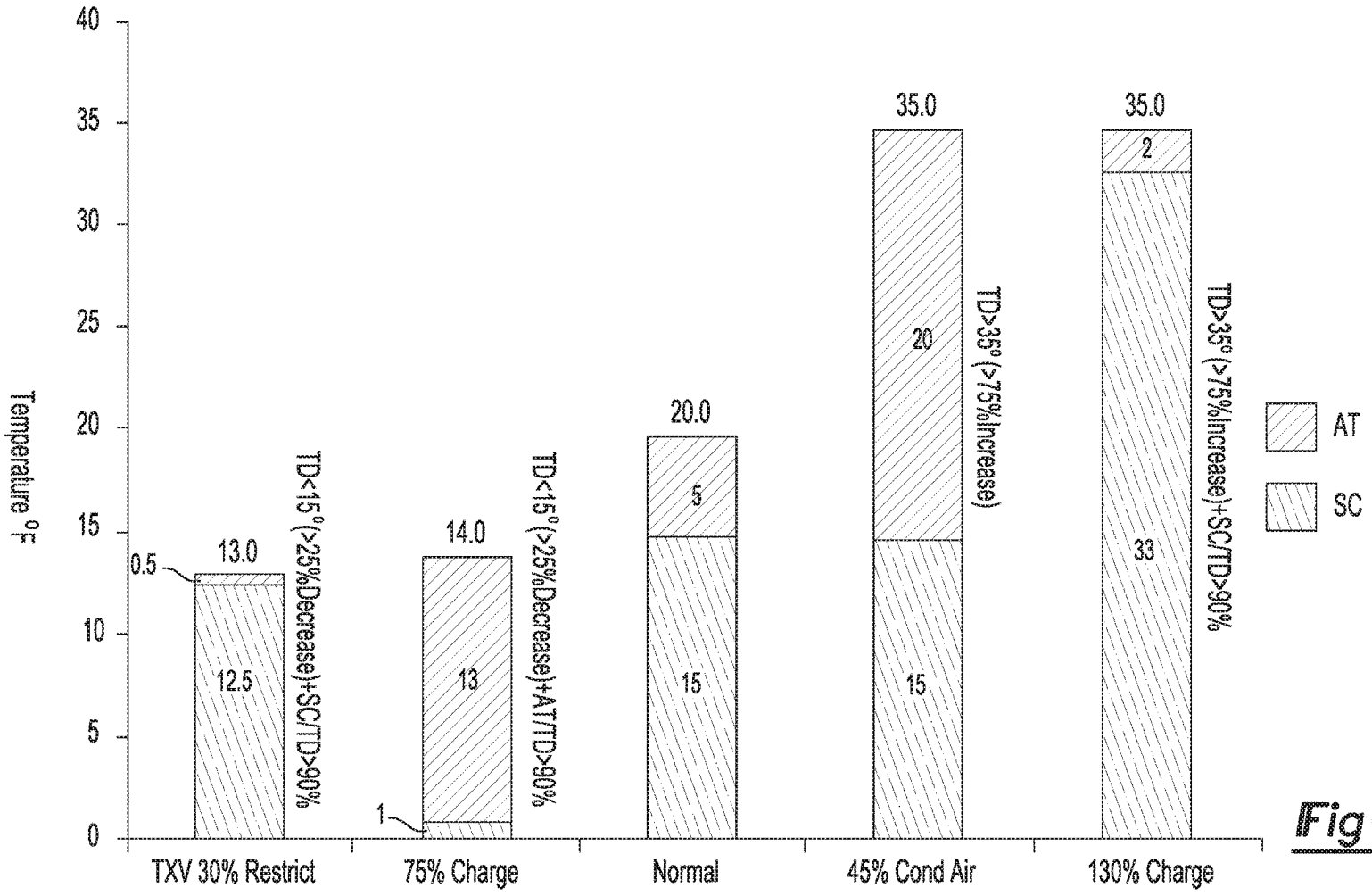
FIG. 9 is a bar graph showing various combinations of condenser temperature difference (TD), subcooling (SC), and approach temperature (AT) at different temperature and refrigerant charge conditions.

With particular reference to FIG. 9, a bar graph detailing different refrigerant charge conditions and other faults for the refrigeration system 12 is provided. Each bar in the graph illustrates the values and/or the relationship among TD, SC, and/or AT for different conditions. For example, the normal charge condition may be declared by the system controller 46 when the following conditions are true: AT≅5° F., SC≅15° F., and TD≅AT+SC≅20° F.

When diagnosing faults in the system, the system controller 46 may perform additional calculations to assist in the diagnosis. For example, the system controller 46 may utilize other data that signifies a particular operating condition to allow the controller 46 to differentiate amongst faults having similar characteristics. For example, the TDs for a one hundred thirty percent (130%) charge (overcharge) condition and a low condenser air flow condition (dirty coil) are both high (for example only, 35° F.). In order to differentiate between these two faults, the system controller 46 may determine a ratio of SC to TD. The controller 46 may declare an overcharge condition when SC/TD is greater than approximately ninety percent (90%), and may declare a low condenser air flow fault (e.g. blocked or dirty condenser coil or condenser fan fault) when SC/TD is less than approximately ninety percent (90%).

The TDs for both a seventy-five percent (75%) charge (undercharge) condition and a thermal expansion valve (TXV) flow control restriction are low (for example only, 14° F. and 13° F., respectively). In order to differentiate between these two faults, the system controller 46 may determine a ratio of AT to TD. The undercharge condition may be declared when the ratio of AT/TD is greater than approximately ninety percent (90%) and the TXV fault may be declared when the ratio of AT/TD is less than approximately ten percent (10%).

As previously described, the coil temperature sensors 58, 62 may be used to determine the charge condition of the refrigeration system 12. This information may be useful when installing a new refrigeration system 12 or, alternatively, when monitoring or charging an existing system 12 following maintenance. In one configuration, the temperature sensors 58, 62 may be used in conjunction with an algorithm that utilizes information from the temperature sensors 58, 62 to aid in providing the refrigeration system 12 with the proper amount of refrigerant.

Figure 8:
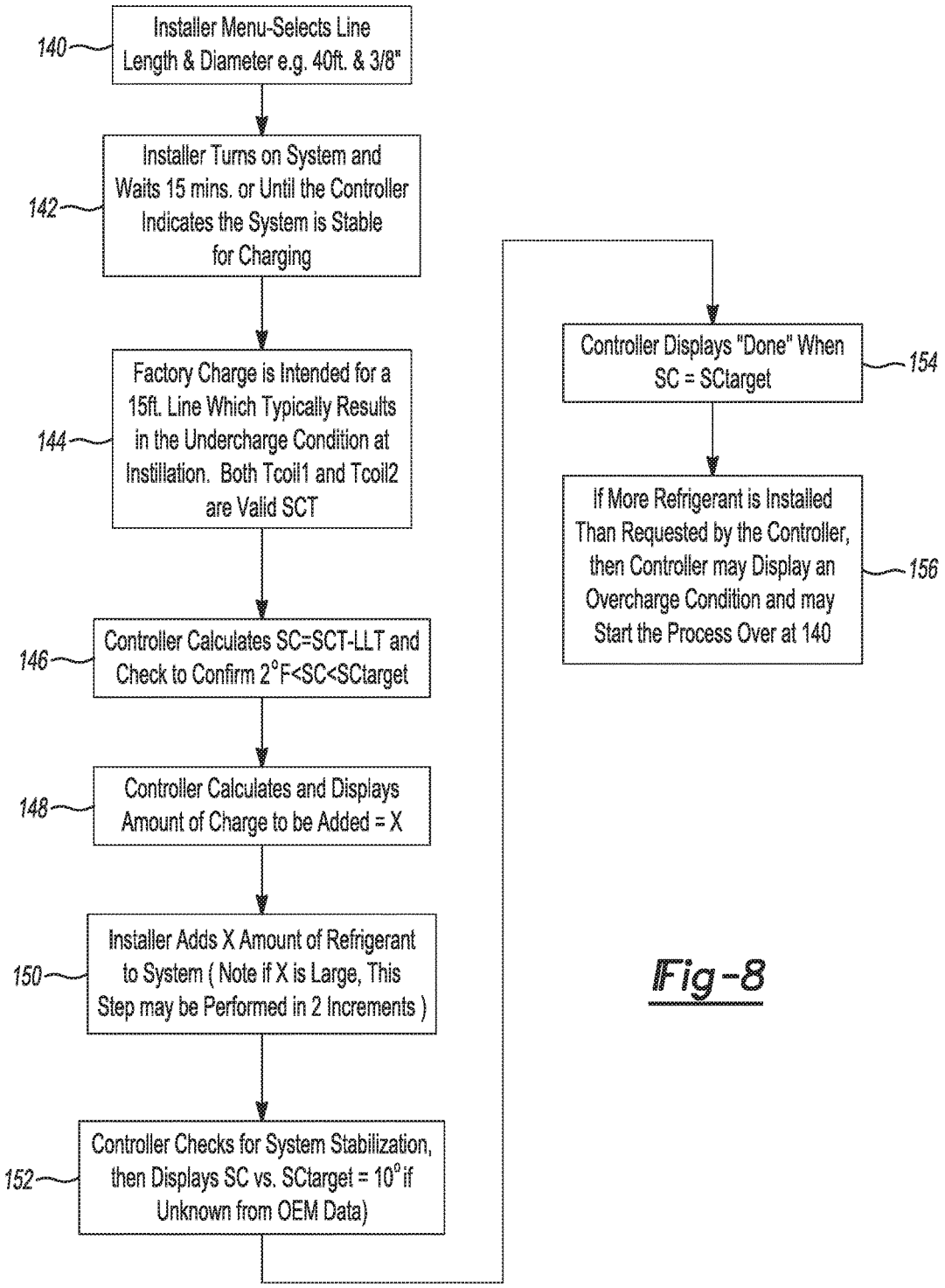
FIG. 8 is a flow chart detailing operation of a device that may operate one or both of the charge-verification systems of FIGS. 6 and 7.

The algorithm may be performed by a computer such as, for example, a hand-held device or a laptop computer (FIG. 8). The computing device may prompt the installer to first select a line length of a refrigeration line set and a diameter of the line set at 140. For example, the line length and diameter may respectively be forty feet and three-eighths of an inch (40 1/32 ft). The installer may power on the system and wait approximately fifteen minutes or until the system controller 46 indicates that the system is stable for charging at 142. Because the factory charge is intended for only fifteen feet (15 ft) of refrigeration line, this particular unit may be undercharged, as described at 144. Thus, both the temperature reading from the first coil temperature sensor 58 and the temperature reading from the second coil temperature sensor 62 are valid SCTs in this situation. The controller 46 may calculate the SC using the formula SC=SCT−LLT and confirm whether approximately two degrees Fahrenheit is less than the SC and whether the SC is less than a target SC (2° F.<SC<SCtarget) at 146, where the target SC is approximately ten degrees Fahrenheit (10° F.). If the target SC is provided from original equipment manufacturer data, the system controller 46 will use this as the target SC instead.

The system controller 46 may calculate and display an amount of charge (X) to be added at 148. The system controller may prompt the installer to add X charge to the system at 150 (if X is large, the addition may be performed in a plurality of increments). The system controller 46 may check for system stabilization and may display the SC versus the target SC on the computing device at 152. When the SC is approximately equal to the target SC, the system controller 46 may indicate that the charge is complete at 154. If the installer adds more charge than requested by the system controller 46, the system controller 46 may determine an overcharge condition and may prompt the installer to recover and start the charge process again at 156.

The charge-verification system 10 and method 100 may also be applied to a split heat pump operating in a heating mode if both the first coil temperature sensor 58 and the second coil temperature sensor 62 are positioned on the indoor coil of the heat pump system. The SCT determined may be used to calculate a Discharge Superheat (DSH). Further, the charge-verification system 10 and method 100 are intended for both initial installation as well as on-going monitoring and maintenance service of the refrigeration system 12.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Those skilled in the art may now appreciate from the foregoing that the broad teachings of the present disclosure may be implemented in a variety of forms. Therefore, while this disclosure has been described in connection with particular examples thereof, the true scope of the disclosure should not be so limited since other modifications will become apparent to the skilled practitioner upon a study of the drawings, the specification and the following claims.

What is claimed is:

1. A charge-verification tool for use with a charge-verification system to diagnose and remedy a charge condition, the charge-verification tool comprising:

a device having a controller configured to communicate with a system controller in the charge-verification system and a display configured to display measurements and instructions to an installer, wherein the device is a user interface and is configured to provide communication between the installer and the system controller in the charge-verification system, the controller prompts the installer to input charge-verification system information including refrigeration line length and diameter, the controller receives a subcooling temperature determined by the system controller and determines whether the subcooling temperature is between a threshold and a target subcooling temperature, the subcooling temperature being determined based on a liquid line temperature and one of a first coil temperature and a second coil temperature, wherein the system controller determines the one of the first coil temperature and the second coil temperature based on which of the first coil temperature and the second coil temperature is closer to an actual saturated condensing temperature, and the controller displays an amount of charge to add to the charge-verification system based on whether the subcooling temperature is between the threshold and the target subcooling temperature.

2. The charge-verification tool of claim 1, wherein the controller displays a system stabilization indication received from the system controller when the charge-verification system stabilizes after startup and after the installer adds charge to the charge-verification system.

3. The charge-verification tool of claim 1, wherein the controller displays the subcooling temperature and the target subcooling temperature on the display.

4. The charge-verification tool of claim 1, wherein the controller displays a "done" indication if the subcooling temperature is equal to the target subcooling temperature.

5. The charge-verification tool of claim 1, wherein if the subcooling temperature is between the threshold and the target subcooling temperature, an undercharge condition exists.

6. The charge-verification tool of claim 1, wherein if the subcooling temperature is greater than the target subcooling temperature, an overcharge condition exists.

7. The charge-verification tool of claim 6, wherein if the overcharge condition exists, the controller displays a negative amount of charge to add to the charge-verification system, indicating that charge should be removed from the system.

8. The charge-verification tool of claim 1, wherein the threshold is two degrees Fahrenheit.

9. The charge-verification tool of claim 1, wherein the target subcooling temperature is ten degrees.

10. The charge-verification tool of claim 1, wherein the liquid line temperature is a temperature of liquid in the refrigeration line downstream of an outlet of a condenser.

11. A method of charge verification for use with a charge-verification system to diagnose and remedy a charge condition, the method comprising:

prompting, by a device controller, an installer to input charge-verification system information including refrigeration line length and diameter;

receiving, by the device controller, a subcooling temperature determined by a system controller for the charge-verification system, the subcooling temperature being determined based on a liquid line temperature and one of a first coil temperature and a second coil temperature, wherein the system controller determines the one of the first coil temperature and the second coil temperature based on which of the first coil temperature and the second coil temperature is closer to an actual saturated condensing temperature;

determining, by the device controller, whether the subcooling temperature is between a threshold and a target subcooling temperature; and displaying, by the device controller, an amount of charge to add to the charge-verification system based on whether the subcooling temperature is between the threshold and the target subcooling temperature.

12. The method of claim 11, further comprising displaying, by the device controller, a system stabilization indication received from the system controller when the charge-verification system stabilizes after startup and after the installer adds charge to the charge-verification system.

13. The method of claim 11, further comprising displaying, by the device controller, the subcooling temperature and the target subcooling temperature on the display.

14. The method of claim 11, further comprising displaying, by the device controller, a "done" indication if the subcooling temperature is equal to the target subcooling temperature.

15. The method of claim 11, wherein if the subcooling temperature is between the threshold and the target subcooling temperature, an undercharge condition exists.

16. The method of claim 11, wherein if the subcooling temperature is greater than the target subcooling temperature, an overcharge condition exists.

17. The method of claim 16, further comprising displaying, by the device controller, a negative amount of charge to add to the charge-verification system, indicating that charge should be removed from the system, if the overcharge condition exists.

18. The method of claim 11, wherein the threshold is two degrees Fahrenheit and the target subcooling temperature is ten degrees.

19. The method of claim 11, further comprising prompting the installer to add the charge in two increments if the amount of charge to be added to the charge-verification system is greater than a predetermined threshold.

20. The method of claim 11, wherein the liquid line temperature is a temperature of liquid in the refrigeration line downstream of an outlet of a condenser.

* * * * *